US009188916B2

(12) United States Patent
Murakami

(10) Patent No.: US 9,188,916 B2
(45) Date of Patent: Nov. 17, 2015

(54) FUSER AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/340,113

(22) Filed: Jul. 24, 2014

(65) Prior Publication Data

US 2015/0030345 A1 Jan. 29, 2015

(30) Foreign Application Priority Data

Jul. 25, 2013 (JP) ..... 2013-154515

(51) Int. Cl.
*G03G 15/20* (2006.01)

(52) U.S. Cl.
CPC ..... *G03G 15/2039* (2013.01); *G03G 15/2003* (2013.01); *G03G 15/2032* (2013.01); *G03G 15/2078* (2013.01); *G03G 2215/2016* (2013.01); *G03G 2215/2032* (2013.01)

(58) Field of Classification Search
CPC ..... G03G 15/20
USPC ..... 399/67, 69, 45, 68, 334, 70, 329, 88, 399/341, 325, 92, 12, 321, 326
See application file for complete search history.

(56) References Cited

U.S. PATENT DOCUMENTS 5,937,230 A * 8/1999 Iwase et al. ..... 399/69
6,122,476 A * 9/2000 Bowler, Jr. ..... 399/328
8,126,383 B2 * 2/2012 Kagawa ..... 399/329
2004/0264991 A1 * 12/2004 Yoshikawa ..... 399/69
2005/0180768 A1 * 8/2005 Inoue ..... 399/69
2007/0217803 A1 * 9/2007 Nakayama ..... 399/68
2007/0230984 A1 * 10/2007 Noguchi ..... 399/69
2007/0297825 A1 * 12/2007 Kostyk et al. ..... 399/67
2009/0028595 A1 * 1/2009 Yano ..... 399/69
2011/0081157 A1 * 4/2011 Mitsuoka et al. ..... 399/69
2011/0188875 A1 * 8/2011 Nakayama ..... 399/69
2013/0164015 A1 * 6/2013 Kawai et al. ..... 399/69
2015/0030345 A1 * 1/2015 Murakami ..... 399/69

FOREIGN PATENT DOCUMENTS

JP 2013-073207 A 4/2013

* cited by examiner

*Primary Examiner* — Clayton E Laballe
*Assistant Examiner* — Kevin Butler
(74) *Attorney, Agent, or Firm* — Muncy, Geissler, Olds & Lowe, P.C.

(57) ABSTRACT

A fuser includes a pressure application part that applies pressure to a medium for forming a print image; an annular body rotatably supported for carrying the medium for applying heat to the medium for forming the print image; a fuser part heat generation body arranged for generating heat to apply heat to the annular body; a first temperature detection end arranged in contact with one end part outside a medium carrying corresponding range of a surface of the annular body and detects temperature of the annular body outside the medium carrying corresponding range. The medium carrying corresponding range is a range in which the medium is carried. A heat generation interruption part that, in response to the temperature of the annular body that is detected via the first temperature detection end, interrupts heat generation of the fuser part heat generation body.

21 Claims, 19 Drawing Sheets

FUSER AND IMAGE FORMING APPARATUS

CROSS REFERENCE

The present application is related to, claims priorities from and incorporates by reference Japanese Patent Application No. 2013-154515 filed on Jul. 25, 2013.

TECHNICAL FIELD

The present invention relates to a fuser and an image forming apparatus, and can be suitably applied to, for example, an electrophotographic printer (hereinafter, this is also referred to as a printer) and a fuser unit provided in the printer.

BACKGROUND

In a conventional printer, there is a fuser part for fusing developer on a recording sheet, and a thermistor is provided on a fuser belt, which carries the recording sheet in the fuser part, for detecting temperature of the fuser belt (for example, see Japanese Patent Laid-Open Publication No. 2013-73207 (pages 5 and 12, and FIG. 1)).

SUMMARY

In the conventional printer, it is necessary to improve accuracy of the temperature detection of the thermistor so that the temperature of the fuser does not rise too high.

In order to resolve the subject, a fuser disclosed in the application includes, a pressure application part that applies pressure to a medium for forming a print image; an annular body that is rotatably supported for carrying the medium in a manner that the medium is sandwiched between the annular body and the pressure application part for applying heat to the medium for forming the print image; a fuser part heat generation body that is arranged on an inner side of the annular body for generating heat to apply heat to the annular body; a first temperature detection end that is arranged in contact with one end part outside a medium carrying corresponding range of a surface of the annular body and detects temperature of the annular body outside the medium carrying corresponding range, the medium carrying corresponding range being a range in which the medium is carried; and a heat generation interruption part that, in response to the temperature of the annular body that is detected via the first temperature detection end, interrupts heat generation of the fuser part heat generation body.

Therefore, in the present invention, temperature of a fuser is accurately detected and, in response to the detection, heat generation of a heat generation part can be interrupted.

DETAILED DESCRIPTION OF EMBODIMENTS

Figure 1:
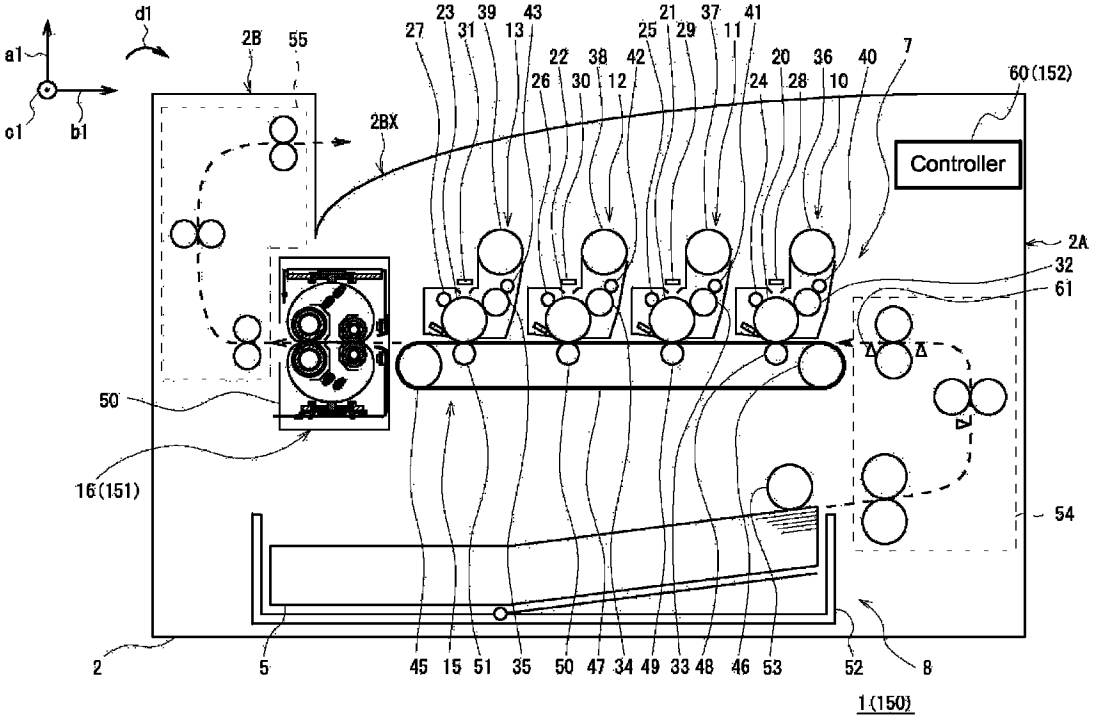
FIG. 1 illustrates a schematic side view of a configuration of a color printer according to a first embodiment.

In the following, with reference to the drawings, best modes (hereinafter, these are also referred to as embodiments) for carrying out the invention are described. The description will be given in the following order:

(1) First Embodiment (2) Second Embodiment (3) Other Embodiments (1) First Embodiment (1-1) Internal Configuration of Color Printer In FIG. 1, a reference numeral symbol 1 indicates as a whole a color printer according to a first embodiment. The color printer 1 has, for example, a substantially box-shaped case (hereinafter, this is also referred to as a printer case) 2. In the following description, an upward direction of the color printer 1 as indicated by an arrow a1 in FIG. 1 when the color printer 1 is viewed from a direction opposing a front surface 2A of the printer case 2 is also referred to as a printer upward direction; a direction opposite to the printer upward direction is also referred to as a printer downward direction; and, when it is not necessary to particularly distinguish between the printer upward direction and the printer downward direction, they both may also be collectively referred to as a printer up-down direction. Further, in the following description, a frontward direction of the color printer 1 as indicated by an arrow b1 in FIG. 1 when the color printer 1 is viewed from the direction opposing the front surface 2A of the printer case 2 is also referred to as a printer frontward direction; a direction opposite to the printer frontward direction is also referred to as a printer rearward direction; and, when it is not necessary to particularly distinguish between the printer frontward direction and the printer rearward direction, they both may also be collectively referred to as a printer front-rear direction. Further, in the following description, a leftward direction of the color printer 1 as indicated by an arrow c1 in FIG. 1 when the color printer 1 is viewed from the direction opposing the front surface 2A of the printer case 2 is also referred to as a printer leftward direction; a direction opposite to the printer leftward direction is also referred to as a printer rightward direction; and, when it is not necessary to particularly distinguish between the printer leftward direction and the printer rightward direction, they both may also be collectively referred to as a printer left-right direction.

As illustrated in FIG. 1, an arrow b1 indicates a direction opposite to a carrying direction of a medium. The arrow b1 indicates an upstream side of the medium carrying direction.

On a rear end part of an upper surface 2B, for example, of the printer case 2, a recess part (hereinafter, this is also referred to as a recording sheet delivery part) 2BX is formed for placing thereon a quadrangular (for example, rectangular) recording sheet 5 as a medium, on a surface of which a print image is formed, to be delivered to a user. Further, at a predetermined position on a rear inner wall of the recording sheet delivery part 2BX of the printer case 2, a recording sheet ejection port (not illustrated in the drawings) is formed for ejecting the recording sheet 5, on which the print image is formed, from inside of the printer case 2 to the recording sheet delivery part 2BX.

On the other hand, at a central part inside the printer case 2, an image forming part 7 is provided for forming a print image by printing a color image of a print target on a surface of the recording sheet 5 while carrying the rectangular recording sheet 5 in a manner that a short side of the recording sheet 5 on one side is oriented toward a carrying direction from a front side toward a rear side. Further, at a lower end part inside the printer case 2, a recording sheet feeding part (hereinafter, this is also referred to as a sheet feeding part) 8 is provided for feeding (that is, sheet feeding) the recording sheet 5 from the short side on the one side to the image forming part 7 for forming a print image.

The image forming part 7 has four image forming units 10-13 corresponding to four colors of black (K), yellow (Y), magenta (M) and cyan (C) (that is, the four image forming units 10-13 use toners of the four colors of black (K), yellow (Y), magenta (M) and cyan (C) to each form a toner image using one color without duplicating). In the following description, the image forming unit 10 corresponding to black (K) is also referred to as a first image forming unit 10, and the image forming unit 11 corresponding to yellow (Y) is also referred to as a second image forming unit 11. Further, in the following description, the image forming unit 12 corresponding to magenta (M) is also referred to as a third image forming unit 12, and the image forming unit 13 corresponding to cyan (C) is also referred to as a fourth image forming unit 13. Further, the image forming part 7 also has a transfer part 15 for transferring the toner images of the four colors (that is, black, yellow, magenta and cyan) that are formed by the first-fourth image forming units 10-13 to the surface of the recording sheet 5 by sequentially superimposing the toner images while carrying the recording sheet 5, for example, from the front side to the rear side. Further, the image forming part 7 has a fuser unit 16 for forming a print image on the surface of the recording sheet 5 by fusing the toner images of the four colors that are transferred by the transfer part 15.

The first-fourth image forming units 10-13 are removably arranged at equal intervals from the front side to the rear side (that is, from an upstream side to a downstream side in the carrying direction when the recording sheet 5 is carried by the transfer part 15) in the order of the first image forming unit 10, the second image forming unit 11, the third image forming unit 12 and the fourth image forming unit 13. Further, the first-fourth image forming units 10-13 are similarly configured except that they each use a mutually different monochromatic color toner for the formation of the toner image. That is, in the first-fourth image forming units 10-13, photosensitive drums 20-23 are provided each rotatable in an one rotation direction indicated by an arrow d1 in FIG. 1 about a rotation shaft parallel to the printer left-right direction. Further, in the first-fourth image forming units 10-13, charging rollers 24-27 for charging surfaces of the respective photosensitive drums 20-23 into a state that allows an electrostatic latent image to be formed are provided each rotatable in the other rotation direction that is opposite to the one rotation direction about a roller rotation shaft parallel to the printer left-right direction. Further, in the first-fourth image forming units 10-13, exposure heads 28-31 each having, for example, a plurality of LED elements and lens arrays are provided for exposing charged portions of the surfaces of the respective photosensitive drums 20-23 to form electrostatic latent image. Further, in the first-fourth image forming units 10-13, development rollers 32-35 for transferring (attaching) toners to the electrostatic latent images on the surfaces of the respective photosensitive drums 20-23 to develop the electrostatic latent images (that is, to form toner images by visualizing the electrostatic latent images with the toners) are provided each rotatable in the other rotation direction about a roller rotation shaft parallel to the printer left-right direction. Further, in the first-fourth image forming units 10-13, toner containers 36-39 containing toners of the respective corresponding colors are provided and supply rollers 40-43 supplying toners discharged from the toner containers 36-39 to the development rollers 32-35 are provided each rotatable in the other rotation direction about a rotation shaft parallel to the printer left-right direction.

In the first-fourth image forming units 10-13, the rotation shafts of the photosensitive drums 20-23, the charging rollers 24-27, the development rollers 32-35 and the supply rollers 40-43 are respectively linked to an output shaft of a formation unit drive motor (not illustrated in the drawings) that is provided inside the printer case 2. As a result, in the first-fourth image forming units 10-13, during the formation of the print image, in response to operation of the formation unit drive motor, the photosensitive drums 20-23, the charging rollers 24-27, the development rollers 32-35 and the supply rollers 40-43 can be rotated in the one rotation direction or the other rotation direction. Further, in the first-fourth image forming units 10-13, the charging rollers 24-27, the development rollers 32-35 and the supply rollers 40-43 are respectively electrically connected to predetermined voltage sources (not illustrated in the drawings) that are provided inside the printer case 2. As a result, in the first-fourth image forming units 10-13, during the formation of the print image, in response to applications of a DC voltage from the voltage source, the surfaces of the photosensitive drums 20-23 can be charged, via the charging rollers 24-27, into a state that allows an electrostatic latent image to be formed. Further, in the first-fourth image forming units 10-13, during the formation of the print image, in response to applications of a DC voltage from the voltage source, toners can be supplied, via the supply rollers 40-43, to the development rollers 32-35, and, in response to application of a DC voltage from the voltage source, toners can be transferred (attached), via the development rollers 32-35, to the electrostatic latent images on the surfaces of the photosensitive drums 20-23 and the electrostatic latent images can be developed.

The transfer part 15 is arranged at a central part in the printer case 2 extending from a position below the first image forming unit 10 to a position below the fourth image forming unit 13. That is, in the transfer part 15, below the fourth image forming unit 13, a drive roller 45 is provided rotatable in the other rotation direction about a rotation shaft parallel to the printer left-right direction and, below the first image forming unit 10, a tension roller 46 is provided rotatable in the other rotation direction about a rotation shaft parallel to the printer left-right direction. Further, in the transfer part 15, an annular or endless carrying belt (hereinafter, this is also referred to as a transfer belt) 47 is stretched from the drive roller 45 to the tension roller 46 for carrying the recording sheet 5 for transferring the toner images. As a result, in the transfer part 15, four places on a surface of a flat portion on an upper side (hereinafter, this is also referred to as an upper side flat portion), which is one of a pair of flat portions of the transfer belt 47 between the drive roller 45 and the tension roller 46, are pressed against the surfaces of the first-fourth photosensitive drums 20-23 of the first-fourth image forming units 10-13 for transferring the toner images to the surface of the recording sheet 5. In the following description, the four places on the surface of the upper side flat portion of the transfer belt 47 that are in contact with the surfaces of the first-fourth photosensitive drums 20-23 of the first-fourth image forming units 10-13 are also referred to as first-fourth transfer execution positions in the order from the front side to the rear side. In the transfer part 15, the rotation shaft of the drive roller 45 is linked to an output shaft of a transfer part drive motor (not illustrated in the drawings) that is provided inside the printer case 2. As a result, in the transfer part 15, during the formation of the print image, in response to operation of the transfer part drive motor, the drive roller 45 can be rotated in the other rotation direction and, in conjunction with the rotation of the drive roller 45, the tension roller 46 and the transfer belt 47 can also be rotated in the other rotation direction.

Further, in the transfer part 15, on an inner side of the transfer belt 47, four transfer rollers 48-51 for transferring the toner images to the surface of the recording sheet 5 are provided, at the first-fourth transfer execution positions, each rotatable in the other rotation direction about a rotation shaft parallel to the printer left-right direction. In the transfer part 15, the transfer rollers 48-51 are respectively electrically connected to a predetermined voltage source that is provided inside the printer case 2. As a result, in the transfer part 15, during the formation of the print image, while the recording sheet 5 is carried by being sequentially sandwiched between the upper side flat portion of the transfer belt 47 and the first-fourth photosensitive drums 20-23 of the first-fourth image forming units 10-13, due to the transfer rollers 48-51, in response to application of a DC voltage from the voltage source, the toner images on the surfaces of the first-fourth photosensitive drums 20-23 can be transferred to the surface of the recording sheet 5.

The fuser unit 16 has, for example, a relatively long and substantially box-shaped case (hereinafter, this is also referred to as a unit case) 50, and is removably arranged on a rear side of the fourth image forming unit 13 and the transfer part 15 in a manner that a longitudinal direction of the unit case 50 (hereinafter, this is also referred to as a unit longitudinal direction) is parallel to the printer left-right direction. That is, the fuser unit 16 is removably arranged in a central part inside the printer case 2 on the rear side of the fourth image forming unit 13 and the transfer part 15, the rear side being a more downstream side than the fourth image forming unit 13 and the transfer part 15 in the carrying direction of the recording sheet 5. Further, in the fuser unit 16, various parts are contained inside the unit case 50 for applying heat and pressure to the recording sheet 5, to the surface of which the toner images of the four colors are transferred, and forming the print image on the surface of the recording sheet 5. A description about a detailed configuration of the fuser unit 16 will be given later and is omitted here.

On the other hand, the sheet feeding part 8 has a sheet feeding tray 52 in which a plurality of the recording sheets 5 can be loaded in a stacked state, and a feeding-out roller 53 for feeding out the recording sheet 5 one by one from the sheet feeding tray 52. The sheet feeding tray 52 is provided to be capable of being pulled out and put in with respect to the printer case 2, and has a loading part that allows any of the recording sheets 5 of sizes of a plurality of kinds such as the A3 size and the A4 size to be loaded in a state in which a width direction of the recording sheet 5 (hereinafter, this is also referred to as a recording sheet width direction) is parallel to the printer left-right direction. The recording sheet width direction is a direction along a side of the recording sheet 5 parallel to a direction that is orthogonal to the carrying direction when the quadrangular recording sheet 5 is carried. In the case of this embodiment, the recording sheets 5 of sizes of a plurality of kinds are respectively formed in rectangular shapes such the A3 size and the A4 size. In the color printer 1, for example, the recording sheets 5 of different sizes are respectively carried for formation of a print image in a carrying orientation in which a pair of short sides are parallel to a direction that is orthogonal to the carrying direction. Therefore, in the case of this embodiment, the recording sheet width direction is the direction along the short sides of the recording sheet 5. In the following description, in the recording sheets 5 of sizes of a plurality of kinds, a direction orthogonal to the recording sheet width direction (that is, in this embodiment, a direction along long sides of the recording sheet 5) is also referred to as a recording sheet longitudinal direction. Further, in the following description, in the recording sheets 5 of sizes of a plurality of kinds, a length of a side parallel to the recording sheet width direction (that is, in this embodiment, a short side of the recording sheet 5) is also referred to as a sheet width, and a length of a side parallel to the recording sheet longitudinal direction (that is, in this embodiment, a long side of the recording sheet 5) is also referred to as a sheet length.

In this case, in the sheet feeding tray 52, a depth (that is, length in the printer front-rear direction) of the loading part is selected to be a predetermined length that is longer than a length of a long side of a recording sheet 5 that has a longest long side (that is, a side parallel to the recording sheet longitudinal direction) among the recording sheets 5 of the sizes of the plurality of kinds to be loaded. Further, in the sheet feeding tray 52, a width (that is, length in the printer left-right direction) of the loading part is selected to be a predetermined length that is longer than a length of a short side of a recording sheet 5 that has a longest short side (that is, a side parallel to the recording sheet width direction) among the recording sheets 5 of the sizes of the plurality of kinds to be loaded. Further, in the sheet feeding tray 52, at a rear end part, a rear guide (not illustrated in the drawings) is provided displaceable in the printer front-rear direction for defining a depth of a loading area of the recording sheets 5 in the loading part with respect to a front wall surface of the loading part to match a size (that is, sheet length) of the recording sheet 5 by narrowing frontward and extending rearward.

Further, in the sheet feeding tray 52, at a right end part, a side guide (not illustrated in the drawings) is provided displaceable in the printer left-right direction for defining a width of the loading area of the recording sheets 5 in the loading part with respect to a left wall surface of the loading part to match a size (that is, sheet width) of the recording sheet 5 by narrowing leftward and extending rightward. As a result, in the sheet feeding tray 52, in accordance with the size of the recording sheets 5 loaded in the loading part, by suitably displacing the rear guide and the side guide, a plurality of the recording sheets 5 of the same size can be loaded in the loading part in a stacked state in which short sides on one side (that is, sides on one side in the recording sheet width direction) of the recording sheets 5 are brought into contact with the front wall surface and are aligned and long sides on one side (that is, sides on one side in the recording sheet longitudinal direction) are brought into contact with the left wall surface and are aligned. Further, the feeding-out roller 53 is provided in a vicinity of an upper side of a front end part of the sheet feeding tray 52 in a manner rotatable in the other rotation direction about a rotation shaft parallel to the printer left-right direction, and the rotation shaft is linked to an output shaft of a feeding-out drive motor (not illustrated in the drawings) that is provided inside the printer case 2. As a result, in the sheet feeding part 8, during the formation of the print image, in response to operation of the feeding-out drive motor, the feeding-out roller 53 can be rotated in the other rotation direction.

In addition, in the printer case 2, a carrying part (hereinafter, this is also referred to as a sheet feeding carrying part) 54 for carrying the recording sheet 5 to the image forming part 7 for sheet feeding is arranged extending from a vicinity of a front side of the sheet feeding tray 52 to a vicinity of a front side of the first image forming unit 10 and the transfer part 15. The sheet feeding carrying part 54 has various kinds of carrying path formation parts such as a plurality of carrying rollers, a plurality of carrying guides and a carrying motor, and these various kinds of the carrying path formation parts form a carrying path (hereinafter, this is also referred to as a sheet feeding carrying path) for carrying the recording sheet 5 fed out from the sheet feeding tray 52 to the image forming part 7 as described above in a carrying orientation in which a pair of long sides of the recording sheet 5 are parallel to the carrying direction and a pair of short sides are parallel to the direction orthogonal to the carrying direction. Further, in the printer case 2, a carrying part (hereinafter, this is also referred to as an ejection carrying part) 55 for carrying the recording sheet 5 (on a surface of which a print image is formed) for ejection from the recording sheet ejection port is arranged extending from a vicinity of a rear side of the fuser unit 16 to a vicinity of the recording sheet ejection port. Similar to the sheet feeding carrying part 54, the ejection carrying part 55 also has various kinds of carrying path formation parts such as a plurality of carrying rollers, a plurality of carrying guides and a carrying motor, and these various kinds of the carrying path formation parts form a carrying path (hereinafter, this is also referred to as an ejection carrying path) for carrying the recording sheet 5 (that is, the recording sheet 5 on the surface of which a print image is formed) fed out from the fuser unit 16 toward the recording sheet ejection port as described above in a carrying orientation in which the pair of the long sides of the recording sheet 5 are parallel to the carrying direction and the pair of the short sides are parallel to the direction orthogonal to the carrying direction.

In the printer case 2, a controller 60 such as a microcomputer or a CPU (Central Processing Unit) is provided that integrally controls the entire color printer 1. Further, the color printer 1 is connected via a wired or wireless connection to a host device (not illustrated in the drawings), such as a personal computer, that instructs the color printer 1 to print a color image of a print target. Therefore, the controller 60 receives image data representing a color image of a print target from the host device and, when an instruction to print the color image is received, executes a print image formation process to form (that is, to print) a print image on the surface of the recording sheet 5. When executing the print image formation process, the controller 60 drives the first-fourth image forming units 10-13 and the transfer part 15 via the above-described formation unit drive motor and the transfer part drive motor, and respectively applies DC voltages of corresponding voltage values via the above-described voltage sources to the first-fourth image forming units 10-13 and the transfer part 15.

Further, the controller 60 causes the fuser unit 16 to operate to apply heat and pressure to the recording sheet 5, as will be described later, via a fuser unit drive motor (not illustrated in the drawings) and a heater power source (not illustrated in the drawings) that are provided in the printer case 2 for driving the fuser unit 16. Further, the controller 60 causes the carrying motor to operate to drive the sheet feeding carrying part 54 and the ejection carrying part 55, and causes the feeding-out drive motor to operate to rotate the feeding-out roller 53 in the other rotation direction. As a result, the controller 60 feeds out via the feeding-out roller 53 the recording sheet 5 one by one from the sheet feeding tray 52 and carries the fed out recording sheet 5 via the sheet feeding carrying path toward the image forming part 7 while suitably correcting the carrying orientation of the recording sheet 5. In this case, while carrying the recording sheet 5 via the sheet feeding carrying path toward the image forming part 7, the controller 60 monitors via a sensor 61 whether or not the recording sheet 5 has arrived at a predetermined passing detection position on the sheet feeding carrying path. When the controller 60 detects via the sensor 61 that the recording sheet 5 has arrived at the passing detection position on the sheet feeding carrying path, in response to the detection, the controller 60 begins to sequentially control the exposure heads 28-31 of the first-fourth image forming units 10-13 in accordance with corresponding color components (black, yellow, magenta and cyan) of a color image of a print target based on the image data at predetermined time intervals before the recording sheet 5 sequentially arrives at the first-fourth transfer execution positions. Therefore, before the recording sheet 5 arrives at the first transfer execution position on the transfer belt 47, the first image forming unit 10, under the control of the controller 60, forms an electrostatic latent image on the surface of the photosensitive drum 20 by using the exposure head 28, and begins to form a toner image by developing the electrostatic latent image with the toner of the corresponding color (black) by using the development roller 32. Further, similarly, before the recording sheet 5 arrives at the corresponding second-fourth transfer execution positions on the transfer belt 47, the second-fourth image forming units 11-13, under the control of the controller 60, also sequentially form electrostatic latent images on the surfaces of the photosensitive drums 21-23 by using the exposure heads 29-31, and begin to form toner images by developing the electrostatic latent images with the toners of the corresponding colors (yellow, magenta and cyan) by using the development rollers 33-35.

In this way, while the controller 60 causes the first-fourth image forming units 10-13 to sequentially begin to form the toner images, when the recording sheet 5 is carried via the sheet feeding carrying path to the transfer part 15, the controller 60 passes the recording sheet 5 on to the transfer belt 47. When the recording sheet 5 arrives at the first transfer execution position in the transfer part 15, while the recording sheet 5 is carried in a manner being sandwiched between the transfer belt 47 and the photosensitive drum 20 of the first image forming unit 10, the controller 60 transfers the toner image (that is, the toner image of black) that is formed on the surface of the photosensitive drum 20 to the surface of the recording sheet 5. Further, similarly, when the recording sheet 5 sequentially arrives at the second-fourth transfer execution positions in the transfer part 15, while the recording sheet 5 is carried in a manner being sandwiched between the transfer belt 47 and the photosensitive drums 21-23 of the second-fourth image forming units 11-13, the controller 60 transfers the toner images (that is, the toner images of yellow, magenta and cyan) that are formed on the surfaces of the photosensitive drums 21-23 to the surface of the recording sheet 5. In this way, after the toner images of the four colors of black, yellow, magenta and cyan are transferred to the surface of the recording sheet 5 in the transfer part 15 by sequentially superimposing the toner images, controller 60 passes the recording sheet 5, to which the toner images are transferred, on to the fuser unit 16. In the fuser unit 16, as will be described later, by applying heat and pressure to the recording sheet 5, the toner images of the four colors are fused onto the surface of the recording sheet 5 by being temporarily melted once and a color print image is formed. Thereafter, the controller 60 passes the recording sheet 5 on to the ejection carrying path. In this way, the controller 60 can carry the recording sheet 5 on which the print image is formed by the fuser unit 16 toward the recording sheet ejection port via the ejection carrying path and can eject the recording sheet 5 to the recording sheet delivery part 2BX to be passed on to a user.

(1-2) Configuration of Fuser Unit

Figure 2:
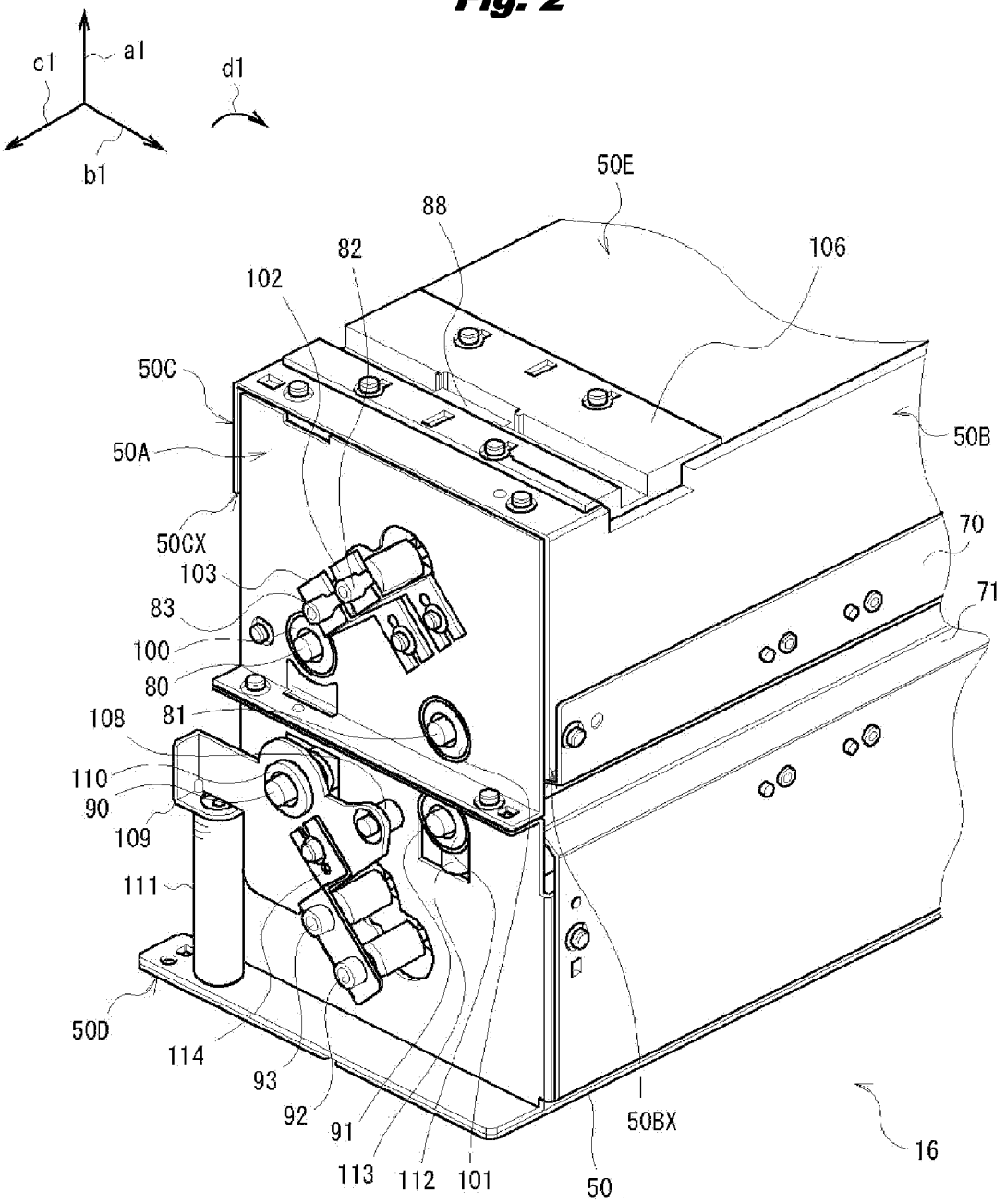
FIG. 2 illustrates a schematic perspective view of an external configuration of a fuser unit according to the first embodiment.
Figure 3:
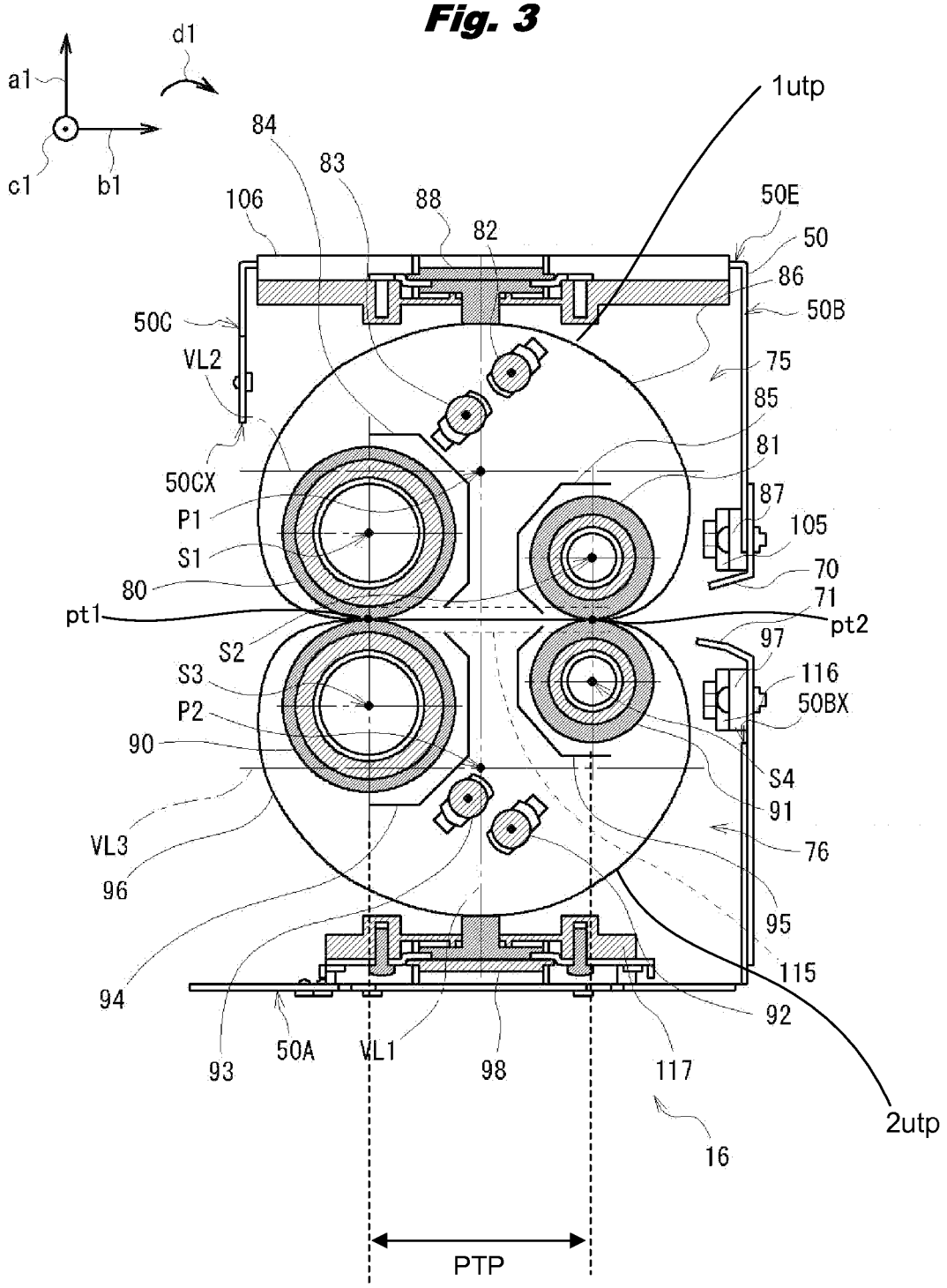
FIG. 3 illustrates a schematic side view of an internal configuration (1) of the fuser unit according to the first embodiment.
Figure 4:
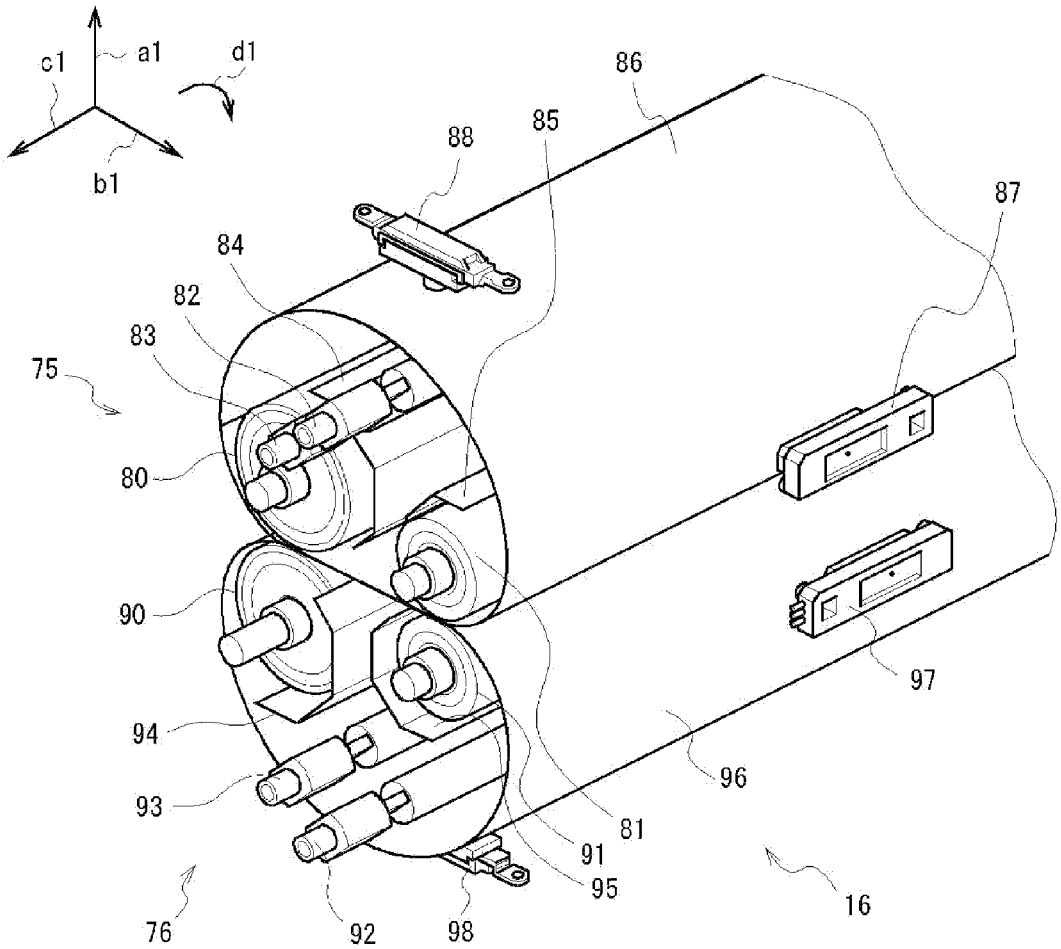
FIG. 4 illustrates a schematic perspective view of an internal configuration (2) of the fuser unit according to the first embodiment.

Next, a specific configuration of the fuser unit 16 is described. As illustrated in FIGS. 2-4, the fuser unit 16 has the substantially box-shaped unit case 50 that is long in the printer left-right direction as described above. The unit case 50 has a lateral width (that is, a length from a left side plate 50A to a right side plate (not illustrated in the drawings) along the unit longitudinal direction; this is also referred to as a case lateral width) that is selected to a predetermined length longer than a sheet width (hereinafter, this is also referred to as a maximum sheet width) that is the maximum among the various sheet widths of the recording sheets 5 of different sizes. Further, the unit case 50 has a slit (hereinafter, this is also referred to as a recording sheet inlet) 50AX that is formed at a central part of a front plate 50B extending from the left side plate 50A to the right side plate for taking in a recording sheet. The unit case 50 has a substantially angle-shaped recording sheet inlet guide (hereinafter, this is also referred to as an upper side inlet guide) 70 that is provided at an upper edge portion of the recording sheet inlet 50AX on an outer surface of the front plate 50B in a manner that an edge portion of the upper side inlet guide 70 on one side enters into the recording sheet inlet 50AX. Further, the unit case 50 has a substantially angle-shaped recording sheet inlet guide (hereinafter, this is also referred to as a lower side inlet guide) 71 that is provided at a lower side of the recording sheet inlet 50AX on the outer surface of the front plate 50B in a manner that an edge portion of the lower side inlet guide 71 on one side enters into the recording sheet inlet 50AX. Further, the unit case 50 has an opening (hereinafter, this is also referred to as a recording sheet outlet) 50CX that is formed in a range from a predetermined position near an upper edge of a rear plate 50C to a bottom edge of the rear plate 50C extending from the left side plate 50A to the right side plate for feeding-out the recording sheet. Inside the unit case 50, a fuser part 75 for fusing the toner images on the surface of the recording sheet 5 and a pressure application part 76 for applying pressure, together with the fuser part 75, to the recording sheet 5 are provided adjacent to each other in an up-down direction.

The fuser part 75 has a roller 80 for driving a belt, a roller 81 that rotates along with rotation of a belt 86 to follow rotation of the roller 80, a pair of a fuser part first heater 82 and a fuser part second heater 83 as fuser part heat generation bodies for applying heat to a belt, a pair of reflection plates 84, 85, the belt 86 for fusing the toner images onto the surface of the recording sheet 5, a temperature sensor 87 for detecting temperature of an outer surface of the belt 86, and a thermostat 88 for preventing a significant temperature rise of the fuser part 75 (that is, around the pair of heaters 82, 83). In the following description, in the fuser part 75, the roller 80 for driving a belt is also referred to as a belt drive roller 80, and the roller 81 that is rotated by the rotation of the belt drive roller 80 is also referred to as a fuser part driven roller 81. Further, in the following description, in the fuser part 75, one of the pair of the heaters 82, 83 for applying heat to a belt is also referred to as a fuser part first heater 82 and the other is also referred to as a fuser part second heater 83; and, one of the pair of the reflection plates 84, 85 as reflection parts is also referred to as a fuser part first reflection plate 84 and the other is also referred to as a fuser part second reflection plate 85. Further, in the following description, in the fuser part 75, the belt 86 for fusing the toner images onto the surface of the recording sheet 5 is also referred to as a fuser belt 86; the temperature sensor 87 for detecting the temperature of the outer surface of the fuser belt 86 is also referred to as a fuser part temperature sensor 87; and the thermostat 88 as a fuser part heat generation interruption part for preventing a significant temperature rise of the fuser part 75 is also referred to as a fuser part thermostat 88.

On the other hand, the pressure application part 76 has a roller 90 for applying pressure to the recording sheet 5 by being driven to rotate by the rotation of the belt drive roller 80 via the fuser belt 86 and a belt 96, a roller 91 that rotates along with the rotation of the belt 96 and the rotation of the fuser part driven roller 81 to follow the rotation of the roller 90, a pair of heaters 92, 93 as pressure application part heat generation body for applying heat to a belt, a pair of reflection plates 94, 95, the belt 96 for applying pressure to the recording sheet 5, a temperature sensor 97 for detecting temperature of an outer surface of the belt 96, and a thermostat 98 for preventing a significant temperature rise of the pressure application part 76 (that is, around the pair of the heaters 92, 93). In the following description, in the pressure application part 76, the roller 90 for applying pressure to the recording sheet 5 is also referred to as a pressure application roller 90, and the roller 91 that rotates to follow the rotation of the pressure application roller 90 is also referred to as a pressure application part driven roller 91. Further, in the following description, in the pressure application part 76, one of the pair of the heaters 92, 93 for applying heat to a belt is also referred to as a pressure application part first heater 92 and the other is also referred to as a pressure application part second heater 93; and, one of the pair of the reflection plates 94, 95 is also referred to as a pressure application part first reflection plate 94 and the other is also referred to as a pressure application part second reflection plate 95. Further, in the following description, in the pressure application part 76, the belt 96 for applying pressure to the recording sheet 5 is also referred to as a pressure application belt 96; the temperature sensor 97 for detecting the temperature of the outer surface of the pressure application belt 96 is also referred to as a pressure application part temperature sensor 97; and the thermostat 98 for preventing a significant temperature rise of the pressure application part 76 is also referred to as a pressure application part thermostat 98.

Figure 5A:
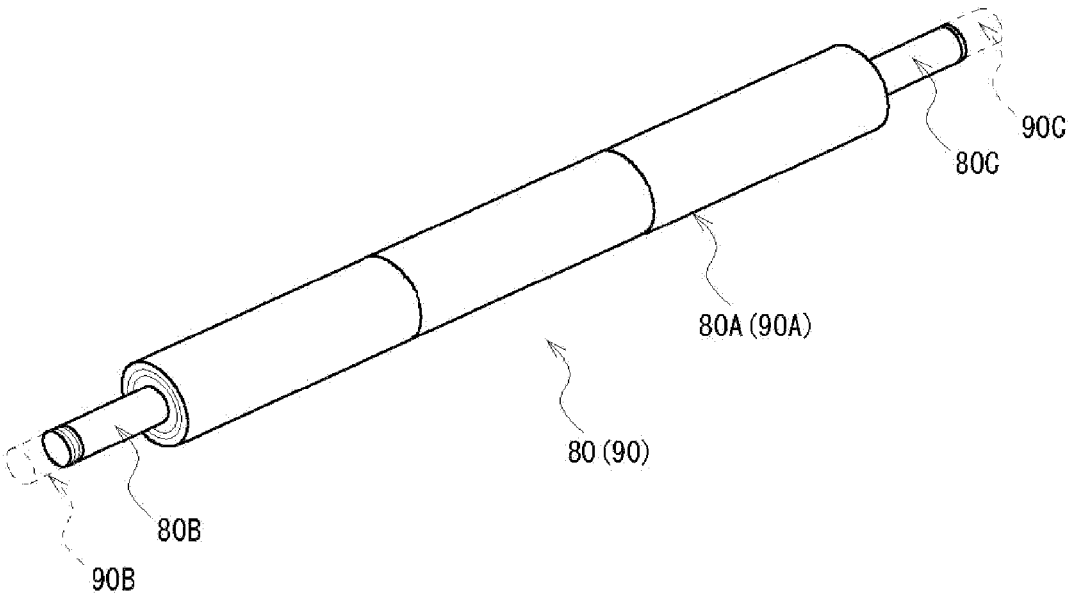
FIGS. 5A and 5B respectively illustrate a schematic perspective view and a schematic cross-sectional view of configurations of a belt drive roller and a pressure application roller.
Figure 5B:
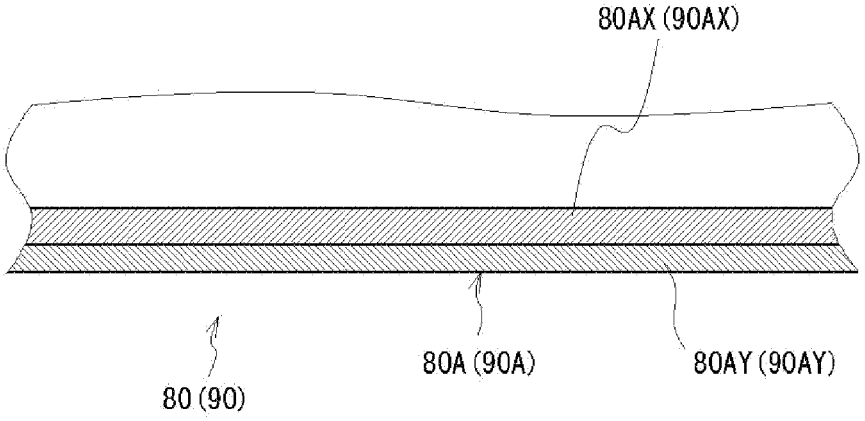

As illustrated in FIGS. 5A and 5B, in the fuser part 75, the belt drive roller 80 has a roller body 80A that is formed, for example, by providing an elastic layer 80AY having a substantially uniform predetermined thickness on an entire outer peripheral surface of a cylindrical core part 80AX that has a predetermined diameter and of which two ends are closed. That is, the roller body 80A of the belt drive roller 80 is formed to have a predetermined outer diameter that is substantially the same at any place between one end surface and the other end surface thereof. The core part 80AX of the belt drive roller 80 is formed, for example, using STMK (carbon steel tubes for machine structural purposes), and the elastic layer 80AY is formed, for example, using a silicon rubber that is selected to have heat resistance and a rubber hardness of, for example, about ASKER-C 75°-ASKER-C 80°. A length of the roller body 80A of the belt drive roller 80 from the one end surface to the other end surface, for example, is selected to be a predetermined length that is longer than the maximum sheet width and slightly narrower than the case lateral width. Further, on the one end surface and the other end surface of the roller body 80A of the belt drive roller 80, for example, a pair of drive roller rotation shafts 80B, 80C are fixedly provided in a manner aligned with a central axis of the belt drive roller 80.

Further, at predetermined opposing positions near centers of rear end parts of the left side plate 50A and the right side plate of the unit case 50 (FIG. 2), shaft insertion holes are respectively drilled and rotation bearings 100 for the belt drive roller 80 are respectively provided in the shaft insertion holes. Therefore, in a manner that a longitudinal direction of the belt drive roller 80 is in parallel to the unit longitudinal direction (that is, the printer left-right direction), the drive roller rotation shaft 80B on one side is installed in the rotation bearing 100 of the left side plate 50A and the drive roller rotation shaft 80C on the other side is installed in the rotation bearing of the right side plate. As a result, on the unit case 50 (FIGS. 2-4), via the pair of the rotation bearings 100 of the left side plate 50A and the right side plate, the belt drive roller 80 is supported rotatable in the one rotation direction about the pair of the drive roller rotation shafts 80B, 80C parallel to the unit longitudinal direction (that is, the printer left-right direction).

Figure 6A:
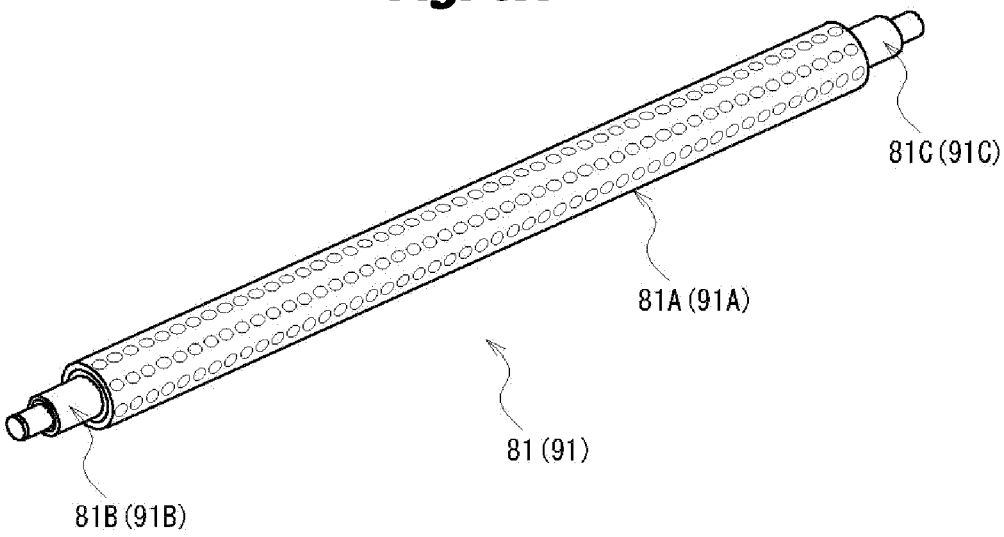
FIGS. 6A and 6B respectively illustrate a schematic perspective view and a schematic cross-sectional view of configurations of a fuser part driven roller and a pressure application part driven roller.
Figure 6B:
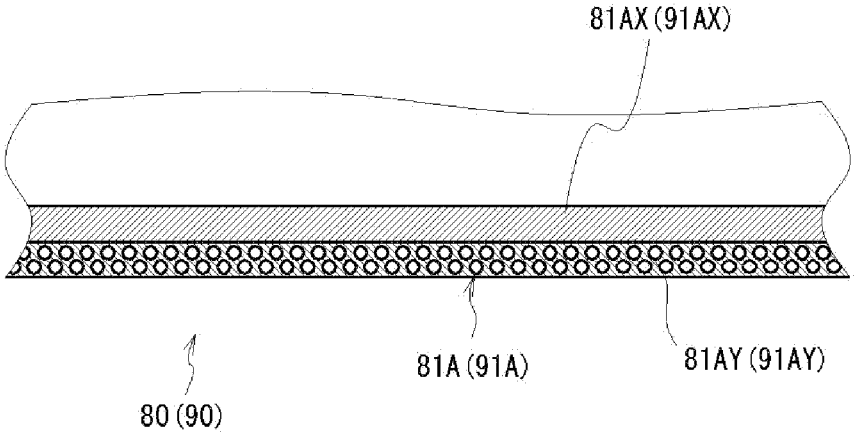

As illustrated in FIGS. 6A and 6B, the fuser part driven roller 81 has a roller body 81A that is formed, for example, by providing an elastic layer 81AY having a substantially uniform predetermined thickness on an entire outer peripheral surface of a cylindrical core part 81AX that has a predetermined diameter smaller than the diameter of the roller body 80A of the belt drive roller 80 and of which two ends are closed. That is, although the roller body 81A of the fuser part driven roller 81 has an outer diameter smaller than the outer diameter of the roller body 80A of the belt drive roller 80, the roller body 81A of the fuser part driven roller 81 is formed to have a predetermined outer diameter that is substantially the same at any place between one end surface and the other end surface thereof. The core part 81AX of the fuser part driven roller 81 is formed, for example, using STMK (carbon steel tubes for machine structural purposes), and the elastic layer 81AY is formed, for example, using a foamed silicon rubber having heat resistance and heat insulation properties. A length of the roller body 81A of the fuser part driven roller 81 from one end surface to the other end surface, for example, is selected to be substantially the same as the length of the roller body 80A of the belt drive roller 80. Further, on the one end surface and the other end surface of the roller body 81A of the fuser part driven roller 81, for example, a pair of driven roller rotation shafts 81B, 81C are fixedly provided in a manner aligned with a central axis of the fuser part driven roller 81.

Further, at predetermined opposing positions near centers of front end parts of the left side plate 50A and the right side plate of the unit case 50 (FIG. 2), shaft insertion holes are respectively drilled and rotation bearings 101 for the fuser part driven roller 81 are respectively provided in the shaft insertion holes. Therefore, in a manner that a longitudinal direction of the fuser part driven roller 81 is in parallel to the unit longitudinal direction (that is, the printer left-right direction), the driven roller rotation shaft 81B on one side is installed in the rotation bearing 101 of the left side plate 50A and the driven roller rotation shaft 81C on the other side is installed in the rotation bearing of the right side plate. As a result, on the unit case 50 (FIGS. 2-4), via the pair of the rotation bearings 101 of the left side plate 50A and the right side plate, the fuser part driven roller 81 is supported rotatable in the one rotation direction about the pair of the driven roller rotation shafts 81B, 81C parallel to the unit longitudinal direction (that is, the printer left-right direction). That is, in the unit case 50, the fuser part driven roller 81 is at a predetermined distance away from the belt drive roller 80, and is rotatably supported in a state in which a height position from a bottom plate 50D to a lowermost portion of an outer peripheral surface of the roller body 81A is aligned with a height position from the bottom plate 50D to a lowermost portion of an outer peripheral surface of the roller body 80A of the belt drive roller 80.

The fuser part first heater 82 is, for example, a halogen lamp that generates heat as infrared rays, and a length of a cylindrical heater body is selected to be a predetermined length that is longer than the maximum sheet width and a width of the fuser belt 86 and is slightly narrower than the case lateral width. In this case, the fuser part first heater 82 is formed, for example, in such a manner that substantially an entire heater body becomes a heat generation part (that is, a light emitting part), and heater terminals are respectively provided on one end and the other end of the heater body. Further, at predetermined opposing positions near centers of upper end parts of the left side plate 50A and the right side plate of the unit case 50 (FIG. 2), heater terminal insertion holes are respectively drilled. In the unit case 50, in a state in which the heater terminal of the fuser part first heater 82 on one side is inserted into the heater terminal insertion hole of the left side plate 50A and the heater terminal on the other side is inserted into the heater terminal insertion hole of the right side plate, these heater terminals on the one side and the other side are respectively supported by heater support parts 102 that are installed on the left side plate 50A and the right side plate. That is, in the unit case 50 (FIGS. 3 and 4), for example, at a predetermined position on an obliquely rear and upper side of the fuser part driven roller 81, the fuser part first heater 82 is supported in a state in which a longitudinal direction of the fuser part first heater 82 is parallel to the unit longitudinal direction (that is, the printer left-right direction).

The fuser part second heater 83 is, for example, a halogen lamp that generates heat as infrared rays, and a length of a cylindrical heater body is selected to be a length that is substantially equal to the length of the heater body of the fuser part first heater 82. In this case, the fuser part second heater 83 is formed, for example, in such a manner that a portion of the heater body from a vicinity of one end to a central part becomes a heat generation part (that is, a light emitting part), and heater terminals are respectively provided on one end and the other end of the heater body. In the unit case 50, in a state in which the heater terminal of the fuser part second heater 83 on one side is inserted into the heater terminal insertion hole of the left side plate 50A and the heater terminal on the other side is inserted into the heater terminal insertion hole of the right side plate, these heater terminals on the one side and the other side are respectively supported by heater support parts 103 that are installed on the left side plate 50A and the right side plate. That is, in the unit case 50 (FIGS. 3 and 4), for example, at a predetermined position between the belt drive roller 80 and the fuser part first heater 82, the fuser part second heater 83 is supported in a state in which a longitudinal direction of the fuser part second heater 83 is parallel to the unit longitudinal direction (that is, the printer left-right direction).

Figure 7A:
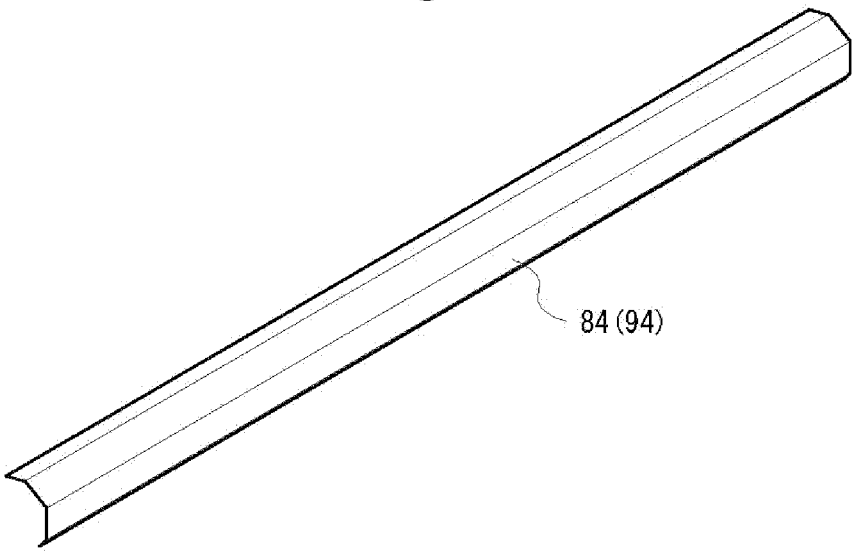
FIGS. 7A and 7B respectively illustrate a schematic perspective view and a schematic cross-sectional view of configurations of a fuser part first reflection plate and pressure application part first reflection plate.
Figure 7B:
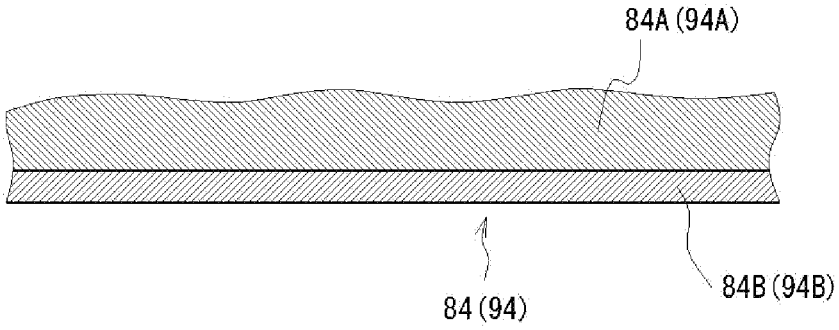

As illustrated in FIGS. 7A and 7B, the fuser part first reflection plate 84 is formed, for example, by providing a reflection layer 84B having a substantially uniform predetermined thickness on entire one surface of a plate part 84A that is bent at multiple places along a portion of the outer peripheral surface of the roller body 80A of the belt drive roller 80. The plate part 84A of the fuser part first reflection plate 84 is formed, for example, by bending aluminum plate, and the reflection layer 84B is formed, for example, by vapor depositing highly reflective aluminum on the entire one surface of the plate part 84A. An entire outer surface of the reflection layer 84B of the fuser part first reflection plate 84 becomes a reflection surface that reflects radiant heat of the fuser part first heater 82 and the fuser part second heater 83, and the other surface of the plate part 84A becomes a back surface of the fuser part first reflection plate 84 itself. Further, a length of the fuser part first reflection plate 84 from one end to the other end, for example, is selected to be a predetermined length that longer than the maximum sheet width and the width of the fuser belt 86 and is substantially equal to the case lateral width. Further, one end and the other end of the fuser part first reflection plate 84 (FIGS. 3 and 4) are fixed on an inner surface of the left side plate 50A and an inner surface of the right side plate in a state in which a longitudinal direction of the fuser part first reflection plate 84 is parallel to the unit longitudinal direction (that is, the printer left-right direction) and the back surface is brought close to a portion of the outer peripheral surface of the belt drive roller 80 extending from a front side portion to a portion on the fuser part second heater 83 side (that is, in a state in which the reflection surface is oriented toward the fuser part first heater 82 side and the fuser part second heater 83 side). However, in the unit case 50, an arrangement position of the fuser part first reflection plate 84 is suitably selected in a manner that, even when the belt drive roller 80 thermally expands and rotationally vibrates, the back surface of the fuser part first reflection plate 84 does not come into contact with the outer peripheral surface of the belt drive roller 80. In this way, in the unit case 50, the fuser part first reflection plate 84 covers the elastic layer 80AY of the belt drive roller 80 so that the elastic layer 80AY does not directly receive the radiant heat of the fuser part first heater 82 and the fuser part second heater 83.

The fuser part second reflection plate 85 is formed, for example, by providing a reflection layer having a substantially uniform predetermined thickness on entire one surface of a plate part that is bent at multiple places along a portion of the outer peripheral surface of the roller body 81A of the fuser part driven roller 81. Similar to the fuser part first reflection plate 84, the plate part of the fuser part second reflection plate 85 is also formed, for example, by bending aluminum plate, and the reflection layer is also formed, for example, by vapor depositing highly reflective aluminum on the entire one surface of the plate part. An entire outer surface of the reflection layer of the fuser part second reflection plate 85 also becomes a reflection surface that reflects the radiant heat of the fuser part first heater 82 and the fuser part second heater 83, and the other surface of the plate part also becomes a back surface of the fuser part second reflection plate 85. Further, a length of the fuser part second reflection plate 85 from one end to the other end, for example, is selected to be a predetermined length that longer than the maximum sheet width and the width of the fuser belt 86 and is substantially equal to the case lateral width. Further, one end and the other end of the fuser part second reflection plate 85 (FIGS. 3 and 4) are fixed on the inner surface of the left side plate 50A and the inner surface of the right side plate in a state in which a longitudinal direction of the fuser part second reflection plate 85 is parallel to the unit longitudinal direction (that is, the printer left-right direction) and the back surface is brought close to a portion of the outer peripheral surface of the fuser part driven roller 81 extending from a rear side portion to a portion on the fuser part first heater 82 side (that is, in a state in which the reflection surface is oriented toward the fuser part first heater 82 side and the fuser part second heater 83 side). However, in the unit case 50, an arrangement position of the fuser part second reflection plate 85 is suitably selected in a manner that, even when the fuser part driven roller 81 thermally expands and rotationally vibrates, the back surface of the fuser part second reflection plate 85 does not come into contact with the outer peripheral surface of the fuser part driven roller 81. In this way, in the unit case 50, the fuser part second reflection plate 85 covers the elastic layer 81AY of the fuser part driven roller 81 so that the elastic layer 81AY does not directly receive the radiant heat of the fuser part first heater 82 and the fuser part second heater 83.

Figure 8A:
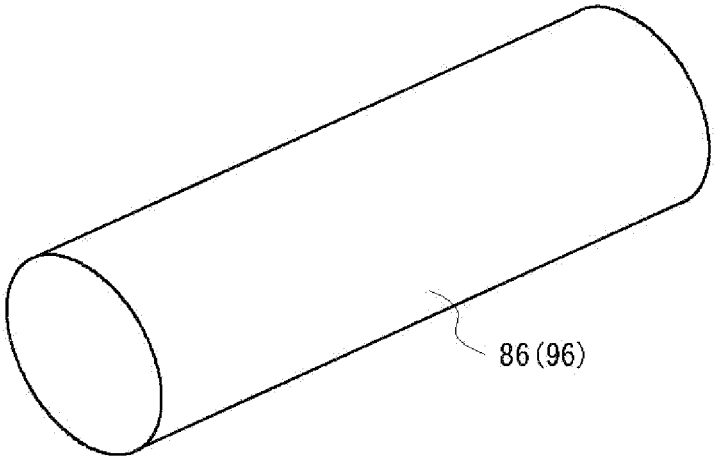
FIGS. 8A and 8B respectively illustrate a schematic perspective view and a schematic cross-sectional view of configurations of a fuser belt and a pressure application belt.
Figure 8B:
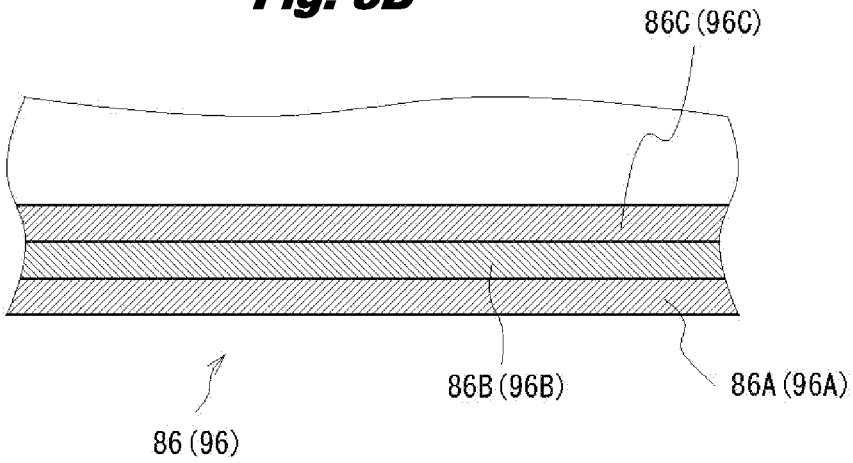

As illustrated in FIGS. 8A and 8B, the fuser belt 86 is formed in a three-layer structure in which, on an entire outer surface of an annular belt body 86A having a predetermined thickness, an elastic layer 86B having a substantially uniform predetermined thickness and a release layer 86C having a substantially uniform predetermined thickness are sequentially laminated. That is, an inner surface of the belt body 86A of the fuser belt 86 is formed as an inner surface of the fuser belt 86 itself, and an outer surface of the release layer 86C of the fuser belt 86 is formed as an outer surface of the fuser belt 86 itself. Further, the inner surface of the fuser belt 86 is coated, for example, with a predetermined coating material of black. As a result, efficiency in absorbing the radiant heat of the fuser part first heater 82 and the fuser part second heater 83 by the inner surface of the fuser belt 86 is increased and the fuser belt 86 can be easily heated. The belt body 86A of the fuser belt 86 is formed, for example, using stainless steel (SUS: Steel Special Use Stainless) and the like to have a predetermined strength and a predetermined elasticity, and is preferably formed to have a thickness of about 40-70 [μm] and appropriate rigidity and flexibility. Further, the elastic layer 86B of the fuser belt 86 is formed, for example, using a silicon rubber. The elastic layer 86B deforms so as to match fine irregularities of the toner images that are transferred to the surface of the recording sheet 5, thereby improving adhesion with respect to the surface of the recording sheet 5. Further, the release layer 86C of the fuser belt 86 is formed, for example, using a predetermined resin such as a fluorine-based resin such as PFA (tetrafluoroethylene-perfluoroalkyl vinyl ether copolymer) or PTFE (polytetrafluoroethylene) (for example, using fluorine-based resin tube covering or fluorine-based resin coating) to improve releasability from the surface of the recording sheet 5 and the toner images on the surface of the recording sheet 5.

In this case, a width (hereinafter, this is also referred to as a fuser belt width) of the fuser belt 86 from one end (that is, an opening on one side) to the other end (that is, an opening on the other side) is selected, for example, to be a predetermined length that is wider than the maximum sheet width but is narrower than the case lateral width. Further, the fuser belt 86 has a perimeter that is selected to be a predetermined length that is relatively longer than a distance from a rearmost portion of the outer peripheral surface of the belt drive roller 80 to a foremost portion of the outer peripheral surface of the fuser part driven roller 81. As a result, the fuser belt 86 is hung in a state in which one end is positioned on a left side and the other end is positioned on a right side, and a tensional force is not applied to the belt drive roller 80 and the fuser part driven roller 81. In the following description, the one end of the fuser belt 86 that is positioned on the left side is also referred to as a left end and the other end that is positioned on the right side is also referred to as a left end.

The fuser part temperature sensor 87 (FIGS. 3 and 4) is, for example, a thermistor, and is installed on an inner surface of the front plate 50B at a predetermined position of an upper edge portion of the recording sheet inlet 50AX in a state in which a temperature detection end is brought close to the outer surface of the fuser belt 86 via a sensor holding part 105 (that is, in a non-contact state).

Figure 9:
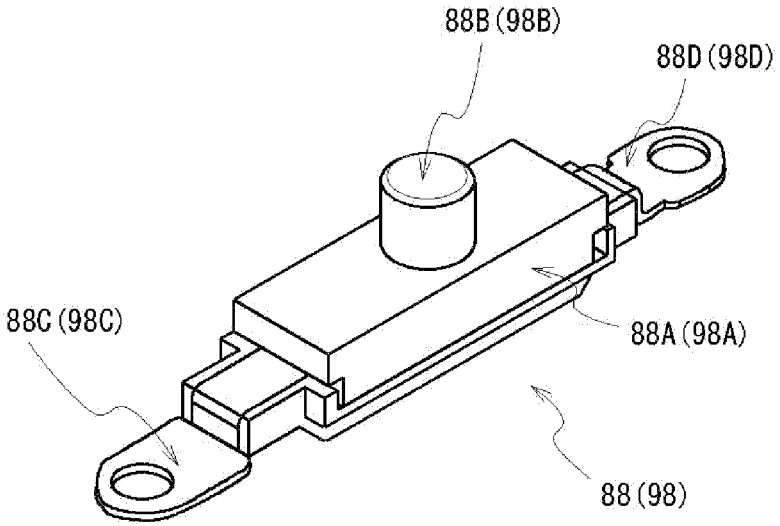
FIG. 9 illustrates a schematic perspective view of a configuration of a fuser part thermostat and a pressure application part thermostat.

As illustrated in FIG. 9, the fuser part thermostat 88 has, for example, a substantially flat rectangular body part 88A that is formed by embedding a conductor in a heat-resistant resin or a ceramic material, and a substantially column-shaped heat sensing part 88B is provided in a projecting manner at a central part on one surface of the body part 88A. Further, on one end and the other end of the body part 88A of the fuser part thermostat 88, terminals 88C, 88D are provided, and the pair of the terminals 88C, 88D are electrically and mechanically connected to two ends of the conductor in the body part 88A. Further, the unit case 50 (FIGS. 2 and 3) has a slit that is formed, for example, at a predetermined position on a left end part of a top plate 50E extending from the front plate 50B to the rear plate 50C. Further, the fuser part 75 has a substantially hat-shaped thermostat holding part 106 for holding the fuser part thermostat 88. The thermostat holding part 106 is formed, for example, using a non-conductive resin to have a length that is substantially equal to a length of the slit of the unit case 50, and a heat sensing part insertion hole is drilled at a central part of a bottom surface of a groove.

The fuser part thermostat 88 is arranged at the central part of the groove of the thermostat holding part 106, and a front end portion of the heat sensing part 88B of the fuser part thermostat 88 projects from a convex portion through the heat sensing part insertion hole. Further, the thermostat holding part 106 is installed on the top plate 50E of the unit case 50 by inserting the convex portion of the thermostat holding part 106 into the slit. As a result, in the unit case 50, a front end (that is, a heat sensing surface that is a circular end surface), which is a temperature detection end of the heat sensing part 88B, of the fuser part thermostat 88 is pressed against an upper side portion of the outer surface of the fuser belt 86. The terminal 88C on one side of the fuser part thermostat 88 is electrically connected the heater terminal on one side of the fuser part first heater 82 and the heater terminal on one side of the fuser part second heater 83.

On the other hand, in the pressure application part 76, the pressure application roller 90 is formed, for example, in substantially the same manner as the belt drive roller 80 described above with respect to FIGS. 5A and 5B. That is, the pressure application roller 90 has a roller body 90A that is formed by providing an elastic layer 90AY on an entire outer peripheral surface of a core part 90AX to have an outer diameter that is equal to the outer diameter of the roller body 80A of the belt drive roller 80. However, on one end surface and the other end surface of the roller body 90A of the pressure application roller 90, a pair of pressure application roller rotation shafts 90B, 90C having a predetermined length longer than the length of the pair of the drive roller rotation shafts 80B, 80C of the belt drive roller 80 are fixedly provided. Further, at predetermined opposing positions directly below the shaft insertion holes for the belt drive roller 80 on a rear end part of the left side plate 50A and a rear end part of the right side plate of the unit case 50 (FIG. 2), shaft insertion long holes that are long in the up-down direction are respectively drilled. Further, at predetermined positions on front sides of the respective shaft insertion long holes on an outer surface of the left side plate 50A and an outer surface of the right side plate of the unit case 50, rotation shafts 108 are implanted. A front end part of each of the rotation shafts 108 is engaged by being inserted into an insertion hole that is drilled at one end part of a substantially L-shaped plate-like roller support part 109. As a result, the roller support parts 109 are supported via the respective rotation shafts 108 on the left side plate 50A and the right side plate of the unit case 50 in a manner rotatable in the one rotation direction and the other rotation direction. Further, shaft insertion holes are drilled at predetermined positions on central parts of the pair of the roller support parts 109 that oppose the respective left and right shaft insertion long holes of the unit case 50, and rotation bearings 110 for the pressure application roller 90 are respectively provided in these shaft insertion holes.

Therefore, in a manner that a longitudinal direction of the pressure application roller 90 is in parallel to the unit longitudinal direction (that is, the printer left-right direction), the pressure application roller rotation shaft 90B on one side is inserted through the shaft insertion long hole of the left side plate 50A on one side and thereafter is installed on the rotation bearing 110 provided on the roller support part 109 on one side, and the pressure application roller rotation shaft 90C on the other side is inserted through the shaft insertion long hole of the right side plate and thereafter is installed on the rotation bearing provided on the roller support part on the other side. As a result, the pressure application roller 90 is supported via the pair of the roller support parts 109 on the unit case 50 (FIGS. 2-4) in a manner displaceable in the up-down direction and rotatable in the other rotation direction about the pair of the pressure application roller rotation shafts 90B, 90C parallel to the unit longitudinal direction (that is, the printer left-right direction).

A left end part of the bottom plate 50D of the unit case 50 protrudes to an outer surface side (that is, the left side) of the left side plate 50A, and an right end part of the bottom plate 50D protrudes to an outer surface side (that is, the right side) of the right side plate. Further, the pressure application part 76 has a pair of compression coil springs (hereinafter, these are also referred to as pressure application roller biasing springs) 111 for biasing the pressure application roller 90. One end part of the pressure application roller biasing spring 111 on one side is engaged with a left rear end part of the bottom plate 50D on the outer surface side of the left side plate 50A of the unit case 50, and the other end part of the pressure application roller biasing spring 111 is engaged with the other end part of the roller support part 109 on one side. Further, one end part of the pressure application roller biasing spring on the other side is engaged with a right rear end part of the bottom plate 50D on the outer surface side of the right side plate of the unit case 50, and the other end part of the pressure application roller biasing spring 111 is engaged with the other end part of the roller support part on the other side. As a result, in the unit case 50, the pressure application roller 90 is biased by the pair of the pressure application roller biasing springs 111 to displace upward.

The pressure application part driven roller 91 is formed, for example, in the same manner as the fuser part driven roller 81 described above with respect to FIGS. 6A and 6B. That is, the pressure application part driven roller 91 has a pair of driven roller rotation shafts 91B, 91C that are fixedly provided on one end surface and the other end surface of a roller body 91A that is formed by providing an elastic layer 91AY on an entire outer peripheral surface of a core part 91AX to have an outer diameter equal to the outer diameter of the roller body 81A of the fuser part driven roller 81 Further, at predetermined opposing positions directly below the shaft insertion holes for the fuser part driven roller 81 on a rear end part of the left side plate 50A and a front end part of the right side plate of the unit case 50 (FIG. 2), shaft insertion long holes that are long in the up-down direction are respectively drilled. Further, on the left side plate 50A and the right side plate of the unit case 50, rotation bearings 112 for the pressure application part driven roller 91 are respectively provided in these shaft insertion long holes in a manner displaceable in the up-down direction (that is, the printer up-down direction). Therefore, in a manner that a longitudinal direction of the pressure application part driven roller 91 is in parallel to the unit longitudinal direction (that is, the printer left-right direction), the driven roller rotation shaft 91B on one side is installed in the rotation bearing 112 of the left side plate 50A and the driven roller rotation shaft 91C on the other side is installed in the rotation bearing of the right side plate. As a result, on the unit case 50 (FIGS. 2-4), via the pair of the rotation bearings 112 of the left side plate 50A and the right side plate, the pressure application part driven roller 91 is supported in a manner displaceable in the up-down direction and rotatable in the other rotation direction about the pair of the driven roller rotation shafts 91B, 91C parallel to the unit longitudinal direction (that is, the printer left-right direction).

The pressure application part 76 has a pair of compression coil springs (hereinafter, these are also referred to as driven roller biasing springs) 113 for biasing the pressure application part driven roller 91. One end part of the driven roller biasing spring 113 on one side is engaged with a lower edge of the shaft insertion long hole for the pressure application part driven roller 91 on the left side plate 50A of the unit case 50, and the other end part of the driven roller biasing spring 113 is engaged with the rotation bearing 112 on one side. Further, one end part of the driven roller biasing spring on the other side is engaged with a lower edge of the shaft insertion long hole for the pressure application part driven roller 91 on the right side plate of the unit case 50, and the other end part of the driven roller biasing spring is engaged with the rotation bearing on the other side. As a result, in the unit case 50, the pressure application part driven roller 91 is biased by the pair of the driven roller biasing springs 113 to displace upward.

The pressure application part first heater 92 is formed, for example, in the same manner as the above-described fuser part first heater 82. That is, the pressure application part first heater 92 is formed in such a manner that substantially an entire heater body having a length that is longer than the maximum sheet width and the width of the fuser belt 86 and is equal to the length of the heater body of the fuser part first heater 82 becomes a heat generation part, and heater terminals are respectively provided on one end and the other end of the heater body. The pressure application part second heater 93 is formed, for example, in the same manner as the above-described fuser part second heater 83. That is, the pressure application part second heater 93 is formed in such a manner that, in a heater body having a length that is longer than the maximum sheet width and the width of the fuser belt 86 and is equal to the length of the heater body of the fuser part second heater 83, a portion of the heater body from a vicinity of one end to a central part becomes a heat generation part, and heater terminals are respectively provided on one end and the other end of the heater body. Further, at predetermined opposing positions near centers of lower end parts of the left side plate 50A and the right side plate of the unit case 50 (FIG. 2), heater terminal insertion holes are respectively drilled. In the unit case 50, in a state in which the heater terminals of the pressure application part first heater 92 and the pressure application part second heater 93 on one side are respectively inserted into the heater terminal insertion holes of the left side plate 50A and the heater terminals on the other side are respectively inserted into the heater terminal insertion holes of the right side plate, these heater terminals on the one side and the other side are respectively supported by heater support parts 114 that are installed on the roller support parts 109 on one side and on the other side. That is, in the unit case 50 (FIGS. 3 and 4), for example, at a predetermined position on an obliquely rear and lower side of the pressure application part driven roller 91, the pressure application part first heater 92 is supported in a state in which a longitudinal direction of the pressure application part first heater 92 is parallel to the unit longitudinal direction (that is, the printer left-right direction). Further, in the unit case 50, for example, at a predetermined position between the pressure application roller 90 and the pressure application part first heater 92, the pressure application part second heater 93 is supported in a state in which a longitudinal direction of the pressure application part second heater 93 is parallel to the unit longitudinal direction (that is, the printer left-right direction).

The pressure application part first reflection plate 94 is formed, for example, in the same manner as the fuser part first reflection plate 84 described above with respect to FIGS. 7A and 7B. That is, the pressure application part first reflection plate 94 has a length from one end to the other end that is selected to be a predetermined length that is longer than the maximum sheet width and the width of the fuser belt 86 and is also longer than the length of the roller body 90A of the pressure application roller 90, and is formed by providing a reflection layer 94B on entire one surface of a plate part 94A that is bent at multiple places along a portion of the outer peripheral surface of the roller body 90A of the pressure application roller 90. Further, one end and the other end of the pressure application part first reflection plate 94 (FIGS. 3 and 4) are fixed on the inner surface of the left side plate 50A and the inner surface of the right side plate in a state in which a longitudinal direction of the pressure application part first reflection plate 94 is parallel to the unit longitudinal direction (that is, the printer left-right direction) and a back surface is brought close to a portion of the outer peripheral surface of the pressure application roller 90 extending from a front side portion to a portion on the pressure application part second heater 93 side (that is, in a state in which a reflection surface is oriented toward the pressure application part first heater 92 side and the pressure application part second heater 93 side). However, in the unit case 50, an arrangement position of the pressure application part first reflection plate 94 is suitably selected in a manner that, even when the pressure application roller 90 thermally expands and rotationally vibrates, the back surface of the pressure application part first reflection plate 94 does not come into contact with the outer peripheral surface of the pressure application roller 90. In this way, in the unit case 50, the pressure application part first reflection plate 94 covers the elastic layer 90AY of the pressure application roller 90 so that the elastic layer 90AY does not directly receive radiant heat of the pressure application part first heater 92 and the pressure application part second heater 93.

The pressure application part second reflection plate 95 is formed, for example, in the same manner as the above-described fuser part second reflection plate 85. That is, the pressure application part second reflection plate 95 has a length from one end to the other end that is selected to be a predetermined length that is longer than the maximum sheet width and the width of the fuser belt 86 and is also longer than the length of the roller body 91A of the pressure application part driven roller 91, and is formed by providing a reflection layer on entire one surface of a plate part that is bent at multiple places along a portion of the outer peripheral surface of the roller body 91A of the pressure application part driven roller 91. Further, one end and the other end of the pressure application part second reflection plate 95 (FIGS. 3 and 4) are fixed on the inner surface of the left side plate 50A and the inner surface of the right side plate in a state in which a longitudinal direction of the pressure application part second reflection plate 95 is parallel to the unit longitudinal direction (that is, the printer left-right direction) and a back surface is brought close to a portion of the outer peripheral surface of the pressure application part driven roller 91 extending from a rear side portion to a portion on the pressure application part first heater 92 side (that is, in a state in which a reflection surface is oriented toward the pressure application part first heater 92 side and the pressure application part second heater 93 side). However, in the unit case 50, an arrangement position of the pressure application part second reflection plate 95 is suitably selected in a manner that, even when the pressure application part driven roller 91 thermally expands and rotationally vibrates, the back surface of the pressure application part second reflection plate 95 does not come into contact with the outer peripheral surface of the pressure application part driven roller 91. In this way, in the unit case 50, the pressure application part second reflection plate 95 covers the elastic layer 91AY of the pressure application part driven roller 91 so that the elastic layer 91AY does not directly receive the radiant heat of the pressure application part first heater 92 and the pressure application part second heater 93.

The pressure application belt 96 is formed, for example, in the same manner as the fuser belt 86 described above with respect to FIGS. 8A and 8B. That is, the pressure application belt 96 is formed in a three-layer structure in which, on an entire outer surface of a annular belt body 96A having a width (hereinafter, this is also referred to as a pressure application belt width) from one end (that is, an opening on one side) to the other end (that is, an opening on the other side) equal to the fuser belt width, an elastic layer 96B and a release layer 96C are sequentially laminated. Further, the inner surface of the pressure application belt 96 is coated with a predetermined coating material of black. As a result, efficiency in absorbing the radiant heat of the pressure application part first heater 92 and the pressure application part second heater 93 by the inner surface of the pressure application belt 96 is increased and the pressure application belt 96 can be easily heated. Further, since the pressure application belt 96 has a perimeter that is equal to the perimeter of the fuser belt 86 (that is, since the perimeter of the pressure application belt 96 is relatively longer than a distance from a rearmost portion of the outer peripheral surface of the pressure application roller 90 to a foremost portion of the outer peripheral surface of the pressure application part driven roller 91), the pressure application belt 96 is hung in a state in which one end is positioned on a left side and the other end is positioned on a right side, and a tensional force is not applied to the pressure application roller 90 and the pressure application part driven roller 91. In the following description, the one end of the pressure application belt 96 that is positioned on the left side is also referred to as a left end and the other end that is positioned on the right side is also referred to as a right end.

As described above, the pressure application roller 90 is biased by the pair of the pressure application roller biasing springs 111 to displace upward. Therefore, in accordance with the bias force due to the pair of the pressure application roller biasing springs 111, an upper side portion of the outer peripheral surface of the pressure application roller 90 is pressed against a lower side portion of the outer peripheral surface of the belt drive roller 80 with a predetermined pressing force sequentially via the pressure application belt 96 and the fuser belt 86. Further, as described above, the pressure application part driven roller 91 is biased by the pair of the driven roller biasing springs 113 to displace upward. Therefore, in accordance with the bias force due to the pair of the driven roller biasing springs 113, an upper side portion of the outer peripheral surface of the pressure application part driven roller 91 is pressed against a lower side portion of the outer peripheral surface of the fuser part driven roller 81 with a predetermined pressing force sequentially via the pressure application belt 96 and the fuser belt 86. The perimeter of the fuser belt 86 in the fuser unit 16 is suitably selected. Therefore, in the fuser unit 16, with respect to the belt drive roller 80 and the fuser part driven roller 81, the fuser belt 86 is hung by positioning an intersection point P1 between an imaginary straight line VL1 that bisects a distance between a foremost position and a rearmost position of the outer surface of the fuser belt 86 and an imaginary straight line VL2 that bisects a distance between an uppermost position and lowermost position of the outer surface on an upper side of a center S1 of the belt drive roller 80 and a center S2 of the fuser part driven roller 81. That is, in the fuser unit 16, with respect to the belt drive roller 80 and the fuser part driven roller 81, the fuser belt 86 is hung in a state being deformed with a curvature as small as possible without being given an extremely crushing load.

Further, in the fuser unit 16, the perimeter of the pressure application belt 96 is selected in the same manner as the perimeter of the fuser belt 86. Therefore, in the fuser unit 16, with respect to the pressure application roller 90 and the pressure application part driven roller 91, the pressure application belt 96 is hung by positioning an intersection point P2 between the imaginary straight line VL1 that bisects a distance between a foremost position and a rearmost position of the outer surface of the pressure application belt 96 and an imaginary straight line VL2 that bisects a distance between an uppermost position and lowermost position of the outer surface on a lower side of a center S3 of the pressure application roller 90 and a center S4 of the pressure application part driven roller 91. That is, in the fuser unit 16, with respect to the pressure application roller 90 and the pressure application part driven roller 91, the pressure application belt 96 is hung in a state being deformed with a curvature as small as possible without being given an extremely crushing load. As a result, in the pressure application part 76, portions of the pressure application belt 96 and the fuser belt 86 from a pressing position of the outer peripheral surface of the pressure application roller 90 against the outer peripheral surface of the belt drive roller 80 to a pressing position of the outer peripheral surface of the pressure application part driven roller 91 against the outer peripheral surface of the fuser part driven roller 81 are mutually flat without being recessed, and these mutually flat portions form a sandwiching part 115 for carrying while sandwiching the recording sheet 5 for applying heat and pressure to the recording sheet 5.

When the sandwiching part 115 is from a point Pt1 sandwiched by the belt drive roller 80 and the pressure application roller to a point Pt2 sandwiched by the fuser part driven roller 81 and the pressure application part driven roller 91, other portions of the fuser belt 86 and the pressure application belt 96 are defined as flexible portions (1utp, 2utp). A length of the sandwiching part 115 is indicated using PTP in FIG. 3.

The pressure application part temperature sensor 97 (FIGS. 3 and 4) is formed in the same manner as the above-described fuser part temperature sensor 87, and is installed at a predetermined position directly below the fuser part temperature sensor 87, in an upper end part on an inner surface of the lower side inlet guide 71, in a state in which a temperature detection end is brought close to the outer surface of the pressure application belt 96 via a sensor holding part 116 (that is, in a non-contact state).

The pressure application part thermostat 98 is formed, for example, in the same manner as the fuser part thermostat 88 described above with respect to FIG. 9. That is, a heat sensing part 98B is provided in a projecting manner at a central part on one surface of a body part 98A of the pressure application part thermostat 98, and terminals 98C, 98D are provided on one end and the other end of the body part 98A. The pair of the terminals 98C, 98D are electrically and mechanically connected to two ends of a conductor in the body part 98A. Further, the pressure application part 76 (FIG. 3) has a substantially hat-shaped thermostat holding part 117 for holding the pressure application part thermostat 98. The thermostat holding part 117 is formed, for example, using a non-conductive resin to have a predetermined length, and a heat sensing part insertion hole is drilled at a central part of a bottom surface of a groove. The pressure application part thermostat 98 is arranged at the central part of the groove of the thermostat holding part 117, and a front end portion of the heat sensing part 98B of the pressure application part thermostat 98 projects from a convex portion through the heat sensing part insertion hole. Further, at a position on the bottom plate SOD of the unit case 50 and directly below the fuser part thermostat 88, thermostat holding part 117 is installed with the convex portion facing upward. As a result, in the unit case 50, a front end (that is, a heat sensing surface that is a circular end surface), which is a temperature detection end of the heat sensing part 98B, of the pressure application part thermostat 98 is pressed against a lower side portion of the outer surface of the pressure application belt 96. The terminal 98C on one side of the pressure application part thermostat 98 is electrically connected the heater terminal on one side of the pressure application part first heater 92 and the heater terminal on one side of the pressure application part second heater 93.

In the printer case 2, for example, at a predetermined position opposing the left side plate 50A of the unit case 50, a predetermined rotation transmission mechanism (not illustrated in the drawings) is provided for transmitting rotation of an output shaft of the fuser unit drive motor to the belt drive roller 80 as rotation in the one rotation direction. Further, the drive roller rotation shaft 80B on one side of the belt drive roller 80 protrudes from the left side plate 50A of the unit case 50, and a predetermined drive roller link mechanism (not illustrated in the drawings) for linking the drive roller rotation shaft 80B on one side to the rotation transmission mechanism is provided on the left side plate 50A. When the fuser unit 16 is installed in the color printer 1, the drive roller rotation shaft 80B on one side of the belt drive roller 80 is linked via the drive roller link mechanism to the rotation transmission mechanism. As a result, in the fuser unit 16, during the formation of the print image, in response to operation of the fuser unit drive motor, the belt drive roller 80 can be rotated in the one rotation direction and, in conjunction with the rotation of the belt drive roller 80, the fuser part driven roller 81 and the fuser belt 86 can also be rotated in the one rotation direction. Further, in the fuser unit 16, by pressing the pressure application roller 90 and the pressure application part driven roller 91 against the belt drive roller 80 and the fuser part driven roller 81, in this case, in conjunction with the rotation of the fuser belt 86 in the one rotation direction, the pressure application belt 96, together with the pressure application roller 90 and the pressure application part driven roller 91, can be rotated in the other rotation direction opposite to the rotation direction of the fuser belt 86. Therefore, in the fuser unit 16, during the formation of the print image, due to the fuser belt 86 and the pressure application belt 96 that are rotating in mutually opposite directions, the above-described sandwiching part 115 is formed, and the recording sheet 5 that is taken in via the recording sheet inlet 50AX from the transfer part 15 can be pressed while being carried in a manner being sandwiched by the sandwiching part 115.

In addition, when the fuser unit 16 is installed in the color printer 1, together with the terminal 88D on the other side of the fuser part thermostat 88, the heater terminal on the other side of the fuser part first heater 82 and the heater terminal on the other side of the fuser part second heater 83 are respectively electrically connected to a first heater power source on one side of a pair of the first heater power source and a second heater power source. Further, when the fuser unit 16 is installed in the color printer 1, together with the terminal 98D on the other side of the pressure application part thermostat 98, the heater terminal on the other side of the pressure application part first heater 92 and the heater terminal on the other side of the pressure application part second heater 93 are respectively electrically connected to the second heater power source on the other side of the pair of the first heater power source and the second heater power source. Further, when the fuser unit 16 is installed in the color printer 1, the fuser part temperature sensor 87 and the pressure application part temperature sensor 97 are electrically connected to the above-described controller 60. Therefore, in the fuser unit 16, during the formation of the print image, in response to a current (that is, an AC current, which is hereinafter also referred to as a heat generation control current) of a predetermined current value for heater heat generation that is supplied from the first heater power source to the fuser part first heater 82 and the fuser part second heater 83, the fuser part first heater 82 and the fuser part second heater 83 are caused to generate heat and thereby, the fuser belt 86 can be heated from an inner surface side while being rotated in the one rotation direction. Further, the fuser unit 16 causes the controller 60 to detect, via the fuser part temperature sensor 87, the temperature of the outer surface of the fuser belt 86 and, in response to the detection result, to ON/OFF-control the first heater power source (that is, to ON/OFF-control the supply of the heat generation control current from the first heater power source to the fuser part first heater 82 and the fuser part second heater 83), and thereby, the temperature of the outer surface of the fuser belt 86 can be adjusted to a predetermined temperature that is required for fusing the toner images on the recording sheet 5 (that is, required for melting the toners).

Therefore, in the fuser unit 16, during the formation of the print image, in response to a heat generation control current that is supplied from the second heater power source to the pressure application part first heater 92 and the pressure application part second heater 93, the pressure application part first heater 92 and the pressure application part second heater 93 are caused to generate heat and thereby, the pressure application belt 96 can be heated from an inner surface side while being rotated in the other rotation direction. Further, the fuser unit 16 causes the controller 60 to detect, via the pressure application part temperature sensor 97, the temperature of the outer surface of the pressure application belt 96 and, in response to the detection result, to ON/OFF-control second heater power source (that is, to ON/OFF-control the supply of the heat generation control current from the second heater power source to the pressure application part first heater 92 and the pressure application part second heater 93), and thereby, the temperature of the outer surface of the pressure application belt 96 can be adjusted in the same manner as the temperature of the outer surface of the fuser belt 86. As a result, in the fuser unit 16, during the formation of the print image, the recording sheet 5 that is taken in via the recording sheet inlet 50AX from the transfer part 15 can be heated, in addition to being pressed, while being carried in a manner being sandwiched by the sandwiching part 115 of the fuser belt 86 and the pressure application belt 96 that are rotating in mutually opposite directions.

Here, in the fuser unit 16, the belt drive roller 80, fuser part driven roller 81, fuser part first heater 82, fuser part second heater 83, fuser part first reflection plate 84, fuser part second reflection plate 85 and fuser belt 86 of the fuser part 75 and the respective corresponding pressure application roller 90, pressure application part driven roller 91, pressure application part first heater 92, pressure application part second heater 93, pressure application part first reflection plate 94, pressure application part second reflection plate 95 and pressure application belt 96 of the pressure application part 76 are formed in the same manner, and are symmetrically arranged with respect to the flat outer surfaces of the fuser belt 86 and the pressure application belt 96 at the sandwiching part 115. As a result, in the fuser unit 16, during the formation of the print image, although the fuser belt 86 and the pressure application belt 96 are individually heated, the temperatures of the fuser belt 86 and the pressure application belt 96 can be made substantially equal each other. Therefore, in the fuser unit 16, in the elastic layer 80AY of the belt drive roller 80 and the elastic layer 90AY of the pressure application roller 90, in which temperatures of the fuser belt 86 and the pressure application belt 96 propagate, temperatures can be made substantially equal to each other and thermal expansion amounts can also be made substantially equal to each other. Therefore, in the fuser unit 16, occurrence of a difference between the adhesion of the surface of the belt drive roller 80 with respect to the inner surface of the fuser belt 86 and the adhesion of the surface of the pressure application roller 90 with respect to the inner surface of the pressure application belt 96 can be prevented.

Further, in the fuser unit 16, in the elastic layer 81AY of the fuser part driven roller 81 and the elastic layer 91AY of the pressure application part driven roller 91, in which the temperatures of the fuser belt 86 and the pressure application belt 96 propagate, temperatures can be made substantially equal to each other and thermal expansion amounts can also be made substantially equal to each other. Therefore, in the fuser unit 16, occurrence of a difference between the adhesion of the surface of the fuser part driven roller 81 with respect to the inner surface of the fuser belt 86 and the adhesion of the surface of the pressure application part driven roller 91 with respect to the inner surface of the pressure application belt 96 can also be prevented. Therefore, in the fuser unit 16, when the fuser belt 86 and the pressure application belt 96 rotate in a state of having been heated, without causing any sliding of the upper side flat portion of the outer surface of the pressure application belt 96 with respect to the lower side flat portion of the outer surface of the fuser belt 86, the sandwiching part 115 can be formed by the mutually flat portions. That is, in the fuser unit 16, when the fuser belt 86 and the pressure application belt 96 rotate in the state of having been heated, by the mutually flat portions, the sandwiching part 115 can be formed that allows the recording sheet 5 to be unerringly sandwiched without any sliding with respect to the flat portions.

Figure 10:
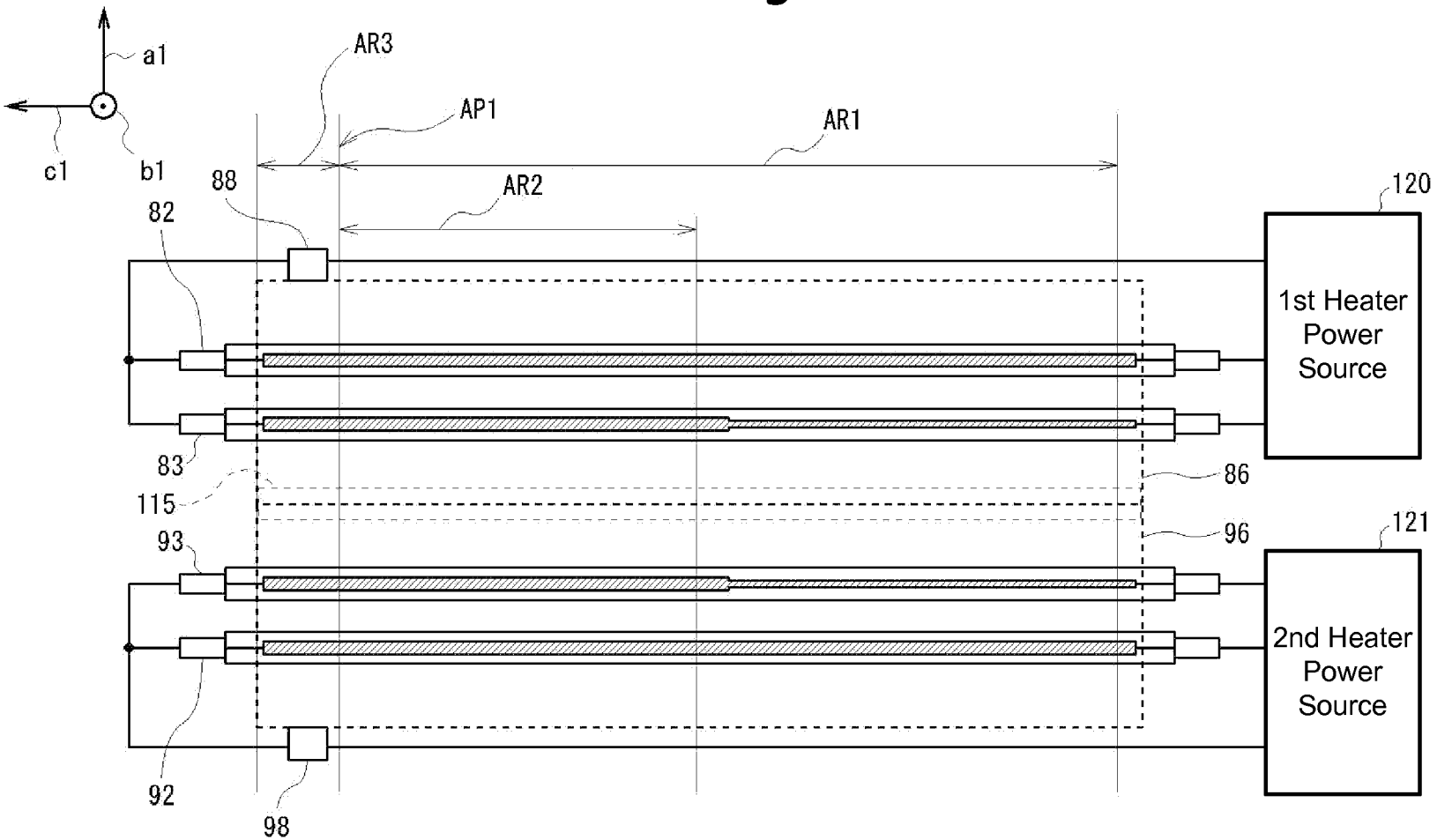
FIG. 10 illustrates a schematic front view for describing a sandwiching range and a heat application range of the fuser belt and the pressure application belt.

In the color printer 1, as described above, even when the recording sheets 5 of any size are loaded in the sheet feeding tray 52, sides of the recording sheets 5 on one side in the recording sheet width direction (that is, long sides of the recording sheets 5 positioned on the left side when the recording sheets 5 are loaded) are brought into contact with the left wall surface of the sheet feeding tray 52 and are aligned and, in this state, the recording sheets 5 are fed out from the sheet feeding tray 52 for the formation of the print image. Therefore, as illustrated in FIG. 10, in the fuser unit 16, even when the recording sheet 5 taken in from the transfer part 15 for fusing the toner images has a sheet width of any size, in the sandwiching part 115, the recording sheet 5 is sandwiched in a manner that a side of the recording sheet 5 on one side in the recording sheet width direction ((that is, a long side on the left side) substantially matches a predetermined position AP1 near the left ends of the outer surface of the fuser belt 86 and the outer surface of the pressure application belt 96 (that is, a predetermined position PA1 on inner sides of the outer surface of the fuser belt 86 and the outer surface of the inner side of the pressure application belt 96). Therefore, in the fuser unit 16, a medium carrying corresponding range AR1, AR2 of the outer surfaces of the fuser belt 86 and the pressure application belt 96 that rotate in mutually opposite directions when the recording sheet 5 is carried in a manner being sandwiched for applying heat and pressure thereto (that is, a range in which the recording sheet 5 is sandwiched between the outer surfaces; hereinafter, this is also referred to as a sandwiching range) becomes a range corresponding to the sheet width of the recording sheet 5 with the position AP1 near the left ends as a reference. In the following description, the predetermined position AP1 near the left ends of the outer surface of the fuser belt 86 and the outer surface of the pressure application belt 96 that is used as a reference for the sandwiching range AR1, AR2 when the recording sheet 5 is sandwiched for applying heat and pressure thereto is also referred to as a sandwiching range reference position PA1.

In practice, in the user unit 16, for example, when the recording sheet 5 having the widest sheet width is taken in, a range in the outer surface of the fuser belt 86 and the outer surface of the pressure application belt 96 from the sandwiching range reference position PA1 to a predetermined position near the right end corresponding to the sheet width of the recording sheet 5 becomes the sandwiching range AR1 where the recording sheet 5 is sandwiched for applying heat and pressure thereto. Further, in the fuser unit 16, for example, when the recording sheet 5 having a sheet width less than ½ the fuser belt width (or the pressure application belt width) is taken in, a range in the outer surface of the fuser belt 86 and the outer surface of the pressure application belt 96 from the sandwiching range reference position PA1 to a predetermined position of a central part corresponding to the sheet width of the recording sheet 5 becomes the sandwiching range AR2 where the recording sheet 5 is sandwiched for applying heat and pressure thereto. Therefore, in the fuser unit 16, a range in the outer surface of the fuser belt 86 and the outer surface of the pressure application belt 96 from the sandwiching range reference position PA1 to the left ends becomes a non-sandwiching range AR3 where the recording sheet 5 is not sandwiched for applying heat and pressure thereto. In the fuser unit 16, as described above, the fuser part first heater 82 is formed in the manner that substantially the entire heater body becomes the heat generation part, and is arranged in the manner that the heat generation part from one end to the other end opposes the inner surface of the fuser belt 86 from the left end to the right end. Further, in the fuser unit 16, as described above, the fuser part second heater 83 is formed in the manner that the portion of the heater body from the vicinity of one end to the central part becomes the heat generation part, and is arranged in the manner that the heat generation part from one end to the other end opposes the inner surface of the fuser belt 86 from the left end to the central part. Therefore, in the fuser unit 16, due to the fuser part first heater 82, the inner surface of the fuser belt 86 from the left end to the right end can be heated and, due to the fuser part second heater 83, the inner surface of the fuser belt 86 from the left end to the central part can be heated.

In the fuser unit 16, as described above, the pressure application part first heater 92 is formed in the manner that substantially the entire heater body becomes the heat generation part, and is arranged in the manner that the heat generation part from one end to the other end opposes the inner surface of the pressure application belt 96 from the left end to the right end. Further, in the fuser unit 16, as described above, the pressure application part second heater 93 is formed in the manner that the portion of the heater body from the vicinity of one end to the central part becomes the heat generation part, and is arranged in the manner that the heat generation part from one end to the other end opposes the inner surface of the pressure application belt 96 from the left end to the central part. Therefore, in the fuser unit 16, due to the pressure application part first heater 92, the inner surface of the pressure application belt 96 from the left end to the right end can be heated and, due to the pressure application part second heater 93, the inner surface of the pressure application belt 96 from the left end to the central part can be heated. Therefore, in the fuser unit 16, when the recording sheet 5 is sandwiched for fusing the toner images by the fuser belt 86 and the pressure application belt 96 that are rotating in opposite directions, according the sheet width of the recording sheet 5 (that is, the sandwiching range AR1, AR2 with respect to the recording sheet 5 in this case), the fuser part first heater 82 and the fuser part second heater 83 can be selectively used. Further, in the fuser unit 16, when the recording sheet 5 is sandwiched for fusing the toner images by the fuser belt 86 and the pressure application belt 96 that are rotating in opposite directions, according the sheet width of the recording sheet 5 (that is, the sandwiching range AR1, AR2 with respect to the recording sheet 5 in this case), the pressure application part first heater 92 and the pressure application part second heater 93 can also be selectively used. That is, in the fuser unit 16, for example, when the recording sheet 5 having a sheet width larger than substantially ½ of the fuser belt width (and the pressure application belt width) is sandwiched for fusing the toner images by the fuser belt 86 and the pressure application belt 96, the heat generation control current is supplied from the first heater power source 120 to the fuser part first heater 82 to generate heat and, thereby, the entire inner surface of the fuser belt 86 is heated as a heat application range and temperature is increased in the entire outer surface as a temperature raising range. Further, in the fuser unit 16, in this case, the heat generation control current is supplied from the second heater power source 121 to the pressure application part first heater 92 to generate heat and, thereby, the entire inner surface of the pressure application belt 96 is heated as a heat application range and temperature is increased in the entire outer surface as a temperature raising range.

In contrast, in the fuser unit 16, for example, when the recording sheet 5 having a sheet width less than ½ of the fuser belt width (and the pressure application belt width) is sandwiched for fusing the toner images by the fuser belt 86 and the pressure application belt 96, the heat generation control current is supplied from the first heater power source 120 to the fuser part second heater 83 to generate heat and, thereby, the inner surface of the fuser belt 86 from the left end to the central part is heated as a heat application range and temperature is increased in the outer surface from the left end to the central part as a temperature raising range. Further, in the fuser unit 16, in this case, the heat generation control current is supplied from the second heater power source 121 to the pressure application part second heater 93 to generate heat and, thereby, the inner surface of the pressure application belt 96 from the left end to the central part is heated as a heat application range and temperature is increased in the outer surface from the left end to the central part as a temperature raising range. In the fuser unit 16, although not particularly illustrated in the drawings, one end part and the other end part of each of the fuser part first reflection plate 84 and the fuser part second reflection plate 85 are arranged in a manner projecting outwardly from the left end and the right end of the fuser belt 86, and the radiant heat of the fuser part first heater 82 and the fuser part second heater 83 is reflected by the respective reflection surfaces of the fuser part first reflection plate 84 and the fuser part second reflection plate 85. Therefore, in the fuser unit 16, due to the fuser part first reflection plate 84 and the fuser part second reflection plate 85, not only the belt drive roller 80 and the fuser part driven roller 81 are protected from the radiant heat of the fuser part first heater 82 and the fuser part second heater 83, but also heat application efficiency of the entire fuser belt 86 or the portion of the fuser belt 86 from the left end to the central part is increased. Further, in the fuser unit 16, one end part and the other end part of each of the pressure application part first reflection plate 94 and the pressure application part second reflection plate 95 are arranged in a manner projecting outwardly from the left end and the right end of the pressure application belt 96, and the radiant heat of the pressure application part first heater 92 and the pressure application part second heater 93 is reflected by the respective reflection surfaces of the pressure application part first reflection plate 94 and the pressure application part second reflection plate 95. Therefore, in the fuser unit 16, due to the pressure application part first reflection plate 94 and the pressure application part second reflection plate 95, not only the pressure application roller 90 and the pressure application part driven roller 91 are protected from the radiant heat of the pressure application part first heater 92 and the pressure application part second heater 93, but also heat application efficiency of the entire pressure application belt 96 or the portion of the pressure application belt 96 from the left end to the central part is increased. In this way, in the fuser unit 16, during the formation of the print image, it can be avoided that the fuser belt 86 and the pressure application belt 96 are wastefully heated and power consumption is increased.

In the fuser unit 16, in this way, when the recording sheet 5 is sandwiched for applying heat and pressure thereto in the state in which the fuser belt 86 and the pressure application belt 96 are heated while being rotated, an amount of heat required for fusing the toner images (that is, required for melting the toners) is supplied to the recording sheet 5 from the sandwiching range AR1, AR2 where the recording sheet 5 is in contact with the outer surfaces of the fuser belt 86 and the pressure application belt 96. Therefore, in the fuser unit 16, there is a tendency on the outer surface of the fuser belt 86 and the outer surface of the pressure application belt 96, for example, that the temperature of the sandwiching range AR1, AR2 where the recording sheet 5 is in contact with is lowered/reduced more than the temperature of a portion in the temperature raising range where the recording sheet 5 is not in contact with like the non-sandwiching range AR3. Therefore, in the fuser unit 16, the controller 60 is caused to detect via the fuser part temperature sensor 87 the temperature of the outer surface of the fuser belt 86 and, in response to the detection result, control via the first heater power source 120 the heat generation of the fuser part first heater 82 and the fuser part second heater 83. Thereby, the temperature of the sandwiching range AR1, AR2 of the outer surface of the fuser belt 86 can be adjusted so as to not drop below a minimum temperature required for fusing the toner images (hereinafter, this is also referred to as a minimum fusing temperature). Further, in the fuser unit 16, the controller 60 is caused to detect via the pressure application part temperature sensor 97 the temperature of the outer surface of the pressure application belt 96 and, in response to the detection result, control via the second heater power source 121 the heat generation of the pressure application part first heater 92 and the pressure application part second heater 93. Thereby, the temperature of the sandwiching range AR1, AR2 of the outer surface of the pressure application belt 96 can be adjusted so as to not drop below the minimum fusing temperature.

However, in the fuser unit 16, even when either the fuser part first heater 82 and the pressure application part first heater 92, or the fuser part second heater 83 and the pressure application part second heater 93, are used for the heat application of the fuser belt 86 and the pressure application belt 96 according to the sheet width of the recording sheet 5 to which heat and pressure are applied, on the outer surface of the fuser belt 86 and the outer surface of the pressure application belt 96, it is necessary ti increase the temperature in at least a portion larger than the sandwiching range of the recording sheet 5 having the narrowest sheet width. Therefore, in the fuser unit 16 (FIG. 4), at positions opposing the sandwiching range of the recording sheet 5 having the narrowest sheet width on the outer surface of the fuser belt 86 and the outer surface of the pressure application belt 96, the fuser part temperature sensor 87 and the pressure application part temperature sensor 97 are arranged in a non-contact manner. As a result, even when heat and pressure are applied to the recording sheet 5 of any sheet width, the fuser unit 16 can cause the controller 60, through the fuser part temperature sensor 87 and the pressure application part temperature sensor 97, to respectively detect temperatures of the portions of the outer surface of the fuser belt 86 and the outer surface of the pressure application belt 96 that are in contact with the recording sheet 5.

In the fuser unit 16, for example, when, due to malfunction of the fuser part temperature sensor 87 and the pressure application part temperature sensor 97, the controller 60 erroneously detects via the fuser part temperature sensor 87 and the pressure application part temperature sensor 97 that the temperature of the outer surface of the fuser belt 86 and the temperature of the outer surface of the pressure application belt 96 are lower than actual temperatures, there is a possibility that, in order to apply heat to the fuser belt 86 and the pressure application belt 96, the fuser part first heater 82 and the fuser part second heater 83, and the pressure application part first heater 92 and the pressure application part second heater 93, are caused to continue to generate heat. In the fuser unit 16, as just described, when the fuser part first heater 82 and the fuser part second heater 83, and the pressure application part first heater 92 and the pressure application part second heater 93, are caused to continue to generate heat, there is a possibility that ambient temperatures (that is, temperature of the inner side of the fuser belt 86 and temperature of the inner side of the pressure application belt 96) significantly rise and cause damage to the fuser unit 16. Therefore, in the fuser unit 16, the fuser part thermostat 88 and the pressure application part thermostat 98 are provided capable of accurately detecting ambient temperatures of the fuser part first heater 82 and the fuser part second heater 83, and the pressure application part first heater 92 and the pressure application part second heater 93, as the temperatures of the outer surface of the fuser belt 86 and the temperatures of the outer surface of the pressure application belt 96.

In practice, in the fuser unit 16, as can be seen from FIG. 10, even when either the fuser part first heater 82 and the pressure application part first heater 92, or the fuser part second heater 83 and the pressure application part second heater 93, are used for the heat application of the fuser belt 86 and the pressure application belt 96 according to the sheet width of the recording sheet 5 to which heat and pressure are applied, heat is applied to portions of the respective inner surfaces of the fuser belt 86 and the pressure application belt 96 from the left ends to the central parts as a common heat application range, and temperature is increased in portions of the respective outer surfaces from the left ends to the central parts as a common temperature raising range. Therefore, in the fuser unit 16, when the recording sheet 5 is sandwiched for applying heat and pressure by the outer surface of the fuser belt 86 and the outer surface of the pressure application belt 96 while heat is suitably applied to the inner surface of the fuser belt 86 and the inner surface of the pressure application belt 96 by the fuser part first heater 82 and the pressure application part first heater 92 or by the fuser part second heater 83 and the pressure application part second heater 93, even when the temperature drops in the sandwiching range AR1, AR2 of the recording sheet 5, in the non-sandwiching range AR3 on the left side of the sandwiching range reference position PA1, without any drop in the temperature, the temperature remains at a temperature corresponding the heat applied. In other words, in the fuser unit 16, one end part of the heat generation part of the fuser part first heater 82 and one end part of the heat generation part of the fuser part second heater 83 oppose a left end part of the inner surface of the fuser belt 86 (that is, a portion on an under side of the non-sandwiching range AR3 of the outer surface), and heat is directly applied to the left end part of the inner surface of the fuser belt 86 by the fuser part first heater 82 or the fuser part second heater 83. In the fuser unit 16, in response to the heat application, although the temperature rises in the non-sandwiching range AR3, which is the left end part of the outer surface of the fuser belt 86, since temperature drop due to contact with the recording sheet 5 does not occur, it can be said that the temperature in the non-sandwiching range AR3 is a temperature that unerringly reflects the ambient temperature of the heat generation part of the fuser part first heater 82 or the fuser part second heater 83 (that is, the temperature of the inner side of the fuser belt 86).

Further, in the fuser unit 16, one end part of the heat generation part of the pressure application part first heater 92 and one end part of the heat generation part of the pressure application part second heater 93 oppose a left end part of the inner surface of the pressure application belt 96 (that is, a portion on an under side of the non-sandwiching range AR3 of the outer surface), and heat is directly applied to the left end part of the inner surface of the pressure application belt 96 by the pressure application part first heater 92 or the pressure application part second heater 93. In the fuser unit 16, in response to the heat application, although the temperature rises in the non-sandwiching range AR3, which is the left end part of the outer surface of the pressure application belt 96, since temperature drop due to contact with the recording sheet 5 does not occur, it can be said that the temperature in the non-sandwiching range AR3 is a temperature that unerringly reflects the ambient temperature of the heat generation part of the pressure application part first heater 92 or the pressure application part second heater 93 (that is, the temperature of the inner side of the pressure application belt 96).

Figure 11:
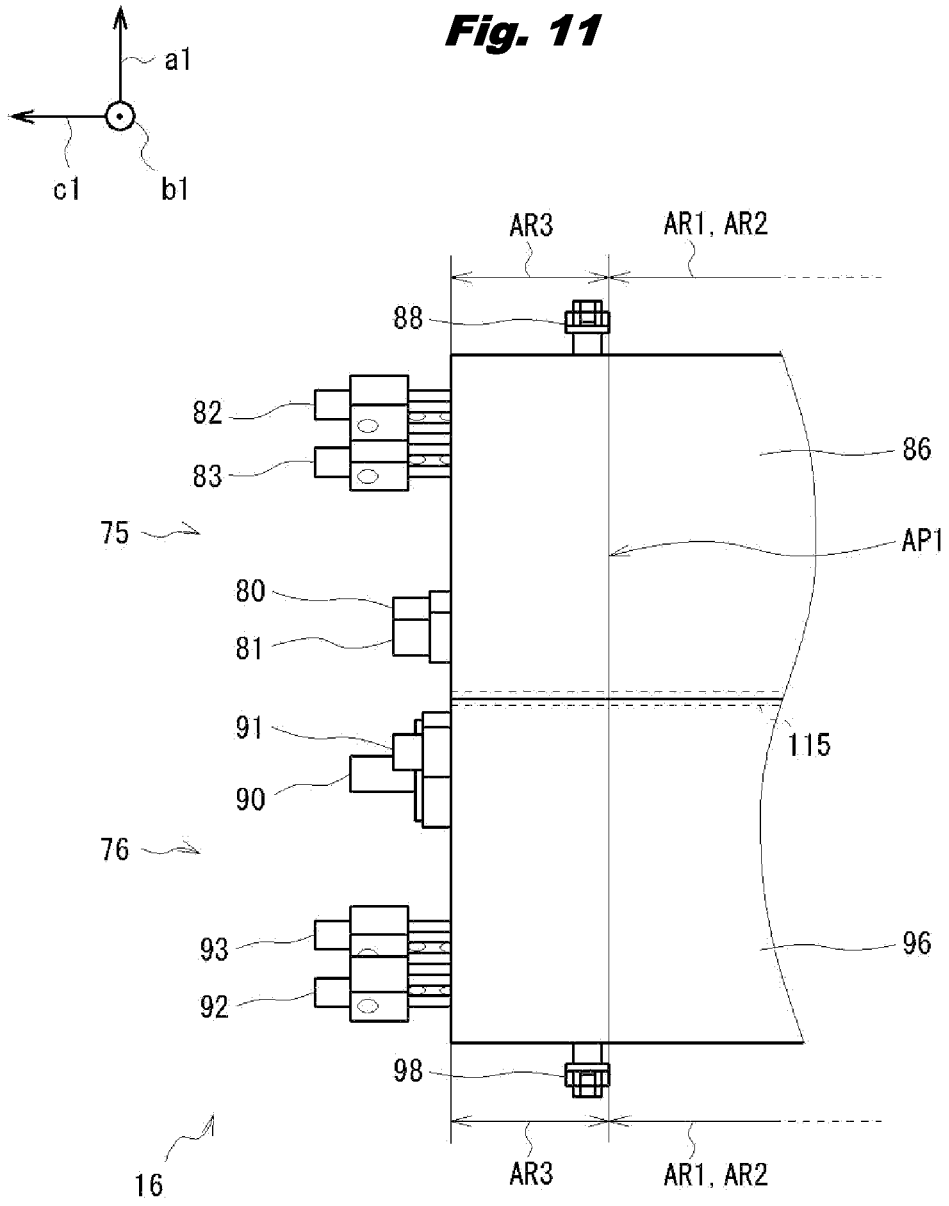
FIG. 11 illustrates a schematic front view for describing arrangement positions of the fuser part thermostat and the pressure application part thermostat.

Therefore, as illustrated in FIG. 11, in the fuser unit 16, the fuser part thermostat 88 is arranged in a manner that the front end of the heat sensing part 88B is in contact with the left end part (that is, the non-sandwiching range AR3) outside the sandwiching range AR1, AR2 of the outer surface of the fuser belt 86, even when heat and pressure are applied to the recording sheet 5 of any sheet width. As a result, in the fuser unit 16, due to the fuser part thermostat 88, the ambient temperature of the fuser part first heater 82 or the fuser part second heater 83 is accurately detected as the temperature in the non-sandwiching range AR3 on the outer surface of the fuser belt 86, which is not affected by the temperature drop due to contact with the recording sheet 5. Further, in the fuser unit 16, the pressure application part thermostat 98 is arranged in a manner that the front end of the heat sensing part 98B is in contact with the left end part (that is, the non-sandwiching range AR3) outside the sandwiching range AR1, AR2 of the outer surface of the pressure application belt 96, even when heat and pressure are applied to the recording sheet 5 of any sheet width. As a result, in the fuser unit 16, due to the pressure application part thermostat 98, the ambient temperature of the pressure application part first heater 92 or the pressure application part second heater 93 is accurately detected as the temperature in the non-sandwiching range AR3 on the outer surface of the pressure application belt 96, which is not affected by the temperature drop due to contact with the recording sheet 5. Further, in the fuser unit 16, for example, even when the outer surface of the fuser belt 86 and the outer surface of the pressure application belt 96 are worn and damaged due to sliding with respect to the front end of the heat sensing part 88B of the fuser part thermostat 88 and the front end of the heat sensing part 98B of the pressure application part thermostat 98, the contact positions of the front ends of the heat sensing parts 88B, 98B are in the non-sandwiching range AR3. Therefore, fusing failure of the toner images on the surface of the recording sheet 5 due to the wear and damage of the belts can be prevented from occurring.

Figure 12:
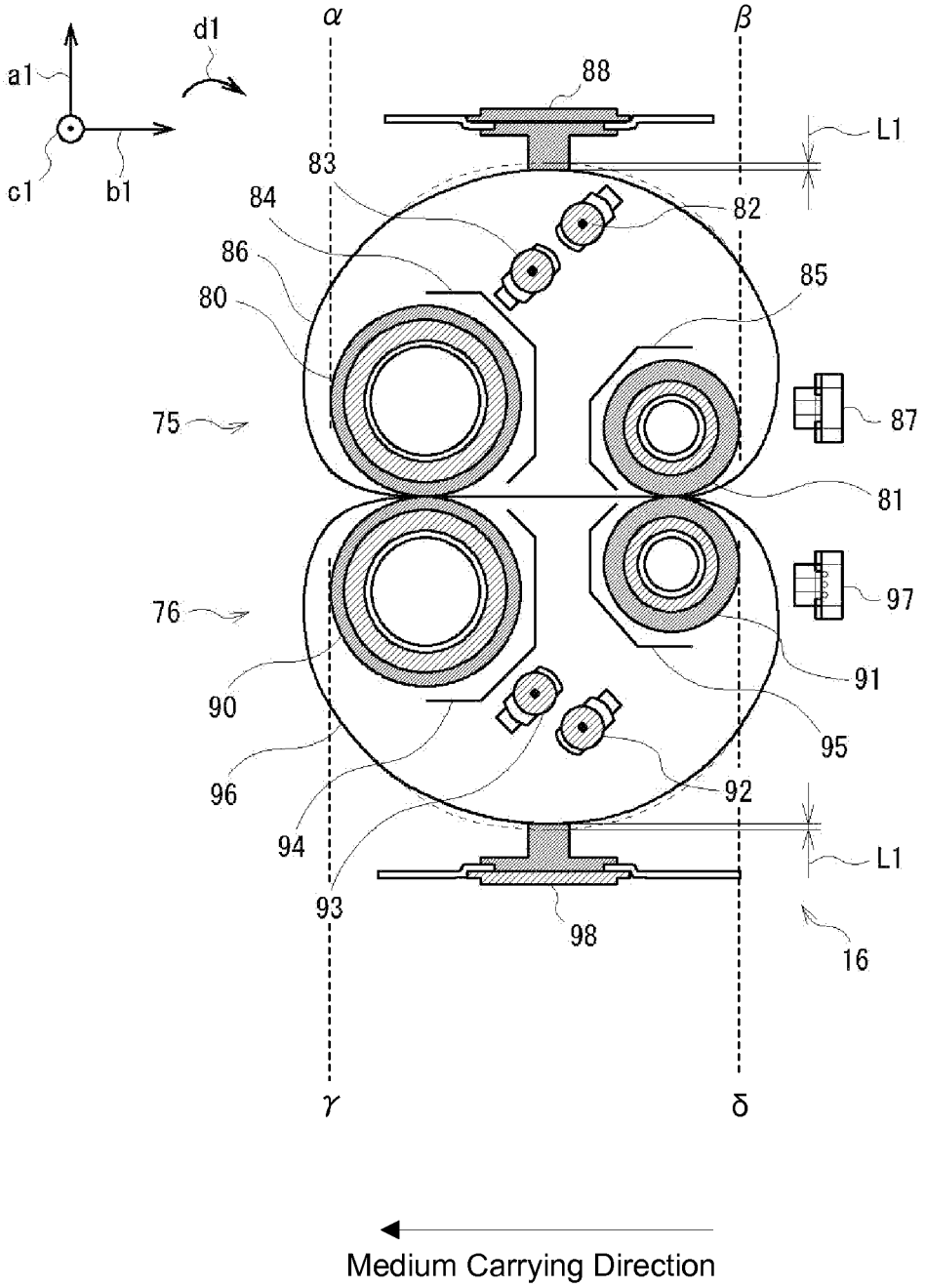
FIG. 12 illustrates a schematic cross-sectional view for describing arrangements for temperature detection of the fuser part thermostat and the pressure application part thermostat.

As illustrated in FIG. 12, the fuser belt 86 has a certain degree of elasticity and thus, in a state of being hung over the belt drive roller 80 and the fuser part driven roller 81, has a shape in which an upper side portion that opposes the sandwiching part 115 projects upwardly forming a bow-like shape (that is, a shape indicated by a dotted line in FIG. 12). When the fuser belt 86 rotates in the one rotation direction in response to driving of the belt drive roller 80, due to pulling by the belt drive roller 80 to rotate the fuser belt 86 in the one rotation direction, a front side portion and a side portion of the fuser belt 86 vibrate back and forth, and along with the vibration, it is possible that the upper side portion vibrates up and down. However, even when such vibration occurs in the fuser belt 86, since the vibration is due to the pulling by the belt drive roller 80, an amplitude of the up-down vibration of the upper side portion is significantly small as compared to an amplitude of the vibration of the front side portion and the rear side portion. Therefore, the fuser part thermostat 88 is fixed on the unit case 50 via the thermostat holding part 106 by pressing the front end of the heat sensing part 88B against the outer surface of the upper side portion of the fuser belt 86 in a state in which the upper side portion is pressed down by a predetermined amount L1 that is larger than the amplitude of the up-down vibration that is possible to occur in the upper side portion. As a result, in the fuser unit 16, the upper side portion of the fuser belt 86 does not vibrate and is constantly acted in a manner being pushed back upwardly due to the elasticity of the fuser belt 86 and thus, even when the fuser belt 86 rotates in the one rotation direction, the front end (that is, the heat sensing surface that is a circular end surface) of the heat sensing part 88B of the fuser part thermostat 88 can be stably in contact with the outer surface of the fuser belt 86.

On the surface of the heat sensing part 88B of the fuser part thermostat 88, a predetermined resin layer such as that of fluorine-based resin such as PFA or PTFE is formed (for example, using fluorine-based resin tube covering or fluorine-based resin coating) to improve adhesion of the front end of the heat sensing part 88B with respect to the outer surface of the fuser belt 86. As a result, even when the outer surface of the fuser belt 86 slides with respect to the front end of the heat sensing part 88B of the fuser part thermostat 88, that the outer surface of the fuser belt 86 is worn and damaged due to the front end is significantly reduced and the releasability of toner on the surface of the heat sensing part 88B is improved. Therefore, during the formation of the print image, it is avoided as much as possible that the accuracy of the temperature detection is reduced due to that wear powder and toner enter between the front end of the heat sensing part 88B of the fuser part thermostat 88 and the outer surface of the fuser belt 86 and the outer surface is damaged.

On the other hand, similar to the fuser belt 86, the pressure application belt 96 also has a certain degree of elasticity and thus, in a state of being hung over the pressure application roller 90 and the pressure application part driven roller 91, has a shape in which a lower side portion that opposes the sandwiching part 115 projects downwardly forming a bow-like shape (that is, a shape indicated by a dotted line in FIG. 12). When the pressure application belt 96 rotates in the other rotation direction in conjunction with the rotation of the fuser belt 86 in the one rotation direction, due to pulling by the fuser belt 86 to rotate the pressure application belt 96 in the other rotation direction, a front side portion and a side portion of the pressure application belt 96 vibrate back and forth, and along with the vibration, it is possible that the lower side portion vibrates up and down. However, even when such vibration occurs in the pressure application belt 96, since the vibration is due to the pulling by the fuser belt 86, an amplitude of the up-down vibration of the lower side portion is significantly small as compared to an amplitude of the vibration of the front side portion and the rear side portion. Therefore, the pressure application part thermostat 98 is fixed on the unit case 50 via the thermostat holding part 117 by pressing the front end of the heat sensing part 98B against the outer surface of the lower side portion of the pressure application belt 96 in a state in which the lower side portion is pressed down by the predetermined amount L1 that is larger than the amplitude of the up-down vibration that is possible to occur in the lower side portion. As a result, in the fuser unit 16, the lower side portion of the pressure application belt 96 does not vibrate and is constantly acted in a manner being pushed back downwardly due to the elasticity of the pressure application belt 96 and thus, even when the pressure application belt 96 rotates in the other rotation direction, the front end (that is, the heat sensing surface that is a circular end surface) of the heat sensing part 98B of the pressure application part thermostat 98 can be stably in contact with the outer surface of the pressure application belt 96. Similar to the fuser part thermostat 88, also on the surface of the heat sensing part 98B of the pressure application part thermostat 98, a predetermined resin layer such as that of fluorine-based resin such as PFA or PTFE is formed (for example, using fluorine-based resin tube covering or fluorine-based resin coating) to improve adhesion of the front end of the heat sensing part 98B with respect to the outer surface of the pressure application belt 96. As a result, also for the pressure application part thermostat 98, even when the outer surface of the pressure application part thermostat 98 slides with respect to the front end of the heat sensing part 98B, that the outer surface of the pressure application belt 96 is worn and damaged due to the front end is significantly reduced and the releasability of toner on the surface of the heat sensing part 98B is improved. Therefore, also for the pressure application part thermostat 98, during the formation of the print image, it is avoided as much as possible that the accuracy of the temperature detection is reduced due to that wear powder and toner enter between the front end of the heat sensing part 98B and the outer surface of the pressure application belt 96 and the outer surface is damaged.

The fuser part thermostat 88 is formed to detect, using the heat sensing part 88B, a predetermined temperature (hereinafter, this is also referred to as a damage prevention temperature) that is pre-selected for preventing damage by heat to the fuser unit 16, such as an upper limit temperature of a temperature range that is higher than the predetermined temperature required for fusing the toner images on the surface of the recording sheet 5 (that is, required for melting the toners) and, for example, allows the fuser unit 16 to safely operate. Further, the fuser part thermostat 88 is formed to block the heat generation control currents supplied by the first heater power source 120 to the fuser part first heater 82 and the fuser part second heater 83 by, for example, melting down the conductor in the body part 88A when it is detected by the heat sensing part 88B that the temperature of the outer surface of the fuser belt 86 has reached the damage prevention temperature. Further, similar to the fuser part thermostat 88, the pressure application part thermostat 98 also is formed to block the heat generation control currents supplied by the second heater power source 121 to the pressure application part first heater 92 and the pressure application part second heater 93 by melting down the conductor in the body part 98A when it is detected by the heat sensing part 98B that the temperature of the outer surface of the pressure application belt 96 has reached the damage prevention temperature. Therefore, in the fuser unit 16, for example, due to malfunction of the fuser part temperature sensor 87 and the pressure application part temperature sensor 97, the temperature of the outer surface of the fuser belt 86 and the temperature of the outer surface of the pressure application belt 96 are erroneously detected as temperatures lower than actual temperatures and, as a result, the fuser part first heater 82 or the fuser part second heater 83 and the pressure application part first heater 92 or the pressure application part second heater 93 are caused to continue to generate heat for applying heat to the fuser belt 86 and the pressure application belt 96; even in this case, when the temperatures of the outer surfaces of the fuser belt 86 and the pressure application belt 96 reach the damage prevention temperature, at this time, the heat generation of the fuser part first heater 82 or the fuser part second heater 83 and the pressure application part first heater 92 or the pressure application part second heater 93 can be interrupted. As a result, in the fuser unit 16, significant temperature rise due to heat generation of the fuser part first heater 82 and the fuser part second heater 83, and the pressure application part first heater 92 and the pressure application part second heater 93, can be prevented, and damage by heat to the fuser unit 16 can be prevented.

Figure 13:
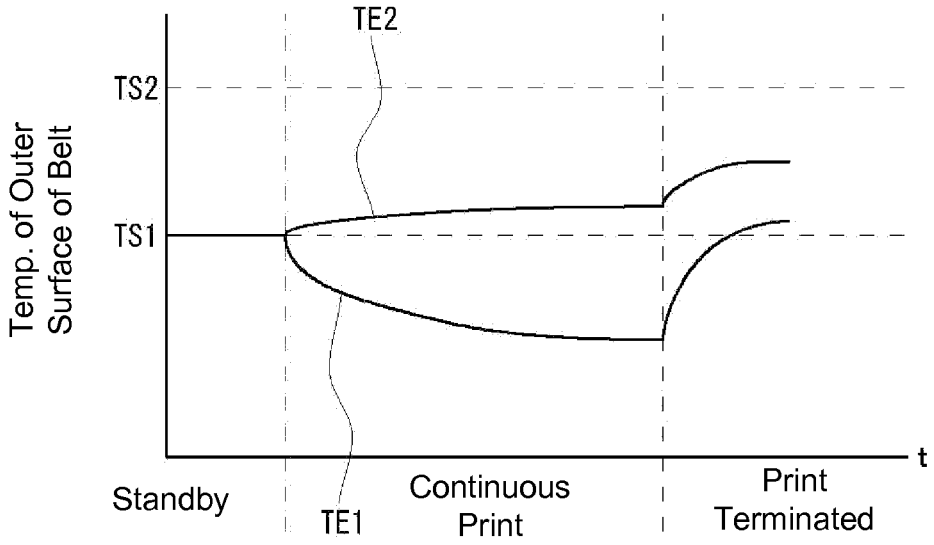
FIG. 13 illustrates a schematic diagram for describing control of temperature of outer surfaces of the fuser belt and the pressure application belt.

Here, a heat and pressure application process that in practice the controller 60 executes during the formation of the print image for causing the fuser unit 16 to operate to apply heat and pressure to the recording sheet 5 is described in detail. In the following, for example, the heat and pressure application process in a case where a print image is continuously formed (that is, continuous printed) on surfaces of a plurality of the recording sheets 5 is described. As illustrated in FIG. 13, during the formation of the print image, the controller 60 causes the fuser unit drive motor to operate to rotate in the fuser unit 16 the belt drive roller 80 in the one rotation direction and thereby, in conjunction with the rotation, the fuser part driven roller 81 and the fuser belt 86 are caused to rotate at a predetermined rotational speed in the one rotation direction. In this case, in conjunction with the rotation of the fuser belt 86 in the one rotation direction, the controller 60 causes the pressure application belt 96, together with the pressure application roller 90 and the pressure application part driven roller 91, to rotate in the other rotation direction at a rotational speed same as that of the fuser belt 86 in the state in which the outer surface of the pressure application belt 96 is pressed against the outer surface of the fuser belt 86.

Further, the controller 60 supplies the heat generation control current from the first heater power source 120 to one of the fuser part first heater 82 and the fuser part second heater 83 according to the sheet width of the recording sheet 5 of a print image formation target in this case to generate heat and begins applying heat to the fuser belt 86. Further, the controller 60 supplies the heat generation control current from the second heater power source 121 to one of the pressure application part first heater 92 and the pressure application part second heater 93 according to the sheet width of the recording sheet 5 of the print image formation target in this case to generate heat and begins applying heat to the pressure application belt 96. Further, the controller 60 detects, via the fuser part temperature sensor 87, the temperature of the outer surface of the fuser belt 86 and, in response to the detection result, suitably ON/OFF-controls the first heater power source 120. As a result, as illustrated by a sandwiching range temperature characteristic curve TE1 and a non-sandwiching range temperature characteristic curve TE2 in FIG. 12, the controller 60 adjusts the temperature of the sandwiching range AR1, AR2 and the temperature of the non-sandwiching range AR3 on the outer surface of the fuser belt 86 to a predetermined target temperature TS1. Further, the controller 60 detects, via the pressure application part temperature sensor 97, the temperature of the outer surface of the pressure application belt 96 and, in response to the detection result, suitably ON/OFF-controls the second heater power source 121. As a result, similar to that for the fuser belt 86, the controller 60 adjusts the temperature of the sandwiching range AR1, AR2 and the temperature of the non-sandwiching range AR3 on the outer surface of the pressure application belt 96 to the target temperature TS1. The target temperature TS1 is selected to be a predetermined temperature that is higher than the minimum fusing temperature in such a manner that, when the recording sheet 5 is sandwiched by the outer surface of the fuser belt 86 and the outer surface of the pressure application belt 96 for applying heat and pressure, the temperature of the sandwiching range AR1, AR2 does not drop below the minimum fusing temperature. In this way, when the controller 60 raises the temperature of the outer surface of the fuser belt 86 and the temperature of the outer surface of the pressure application belt 96 to the target temperature TS1 in the fuser unit 16, as described above, the recording sheet 5 is fed out from the sheet feeding tray 52, and the first-fourth image forming units 10-13 and the transfer part 15 transfer the toner images of the four colors to the surface of the recording sheet 5 by sequentially superimposing the toner images.

Next, in the fuser unit 16, the controller 60 takes in the recording sheet 5, to the surface of which the toner images of the four colors are transferred, from the recording sheet inlet 50AX. As a result, the controller 60 applies heat and pressure to the recording sheet 5 while carrying the recording sheet 5 by sandwiching the recording sheet 5 in the sandwiching part 115 between the outer surface of the fuser belt 86 and the outer surface of the pressure application belt 96 that are rotating in opposite direction in the fuser unit 16, and the toner images of the four colors are fused onto the surface of the recording sheet 5 by being temporarily melted once. Thereafter, the controller 60 feeds out the recording sheet 5 from the recording sheet outlet 50CX to the ejection carrying path. In this way, the controller 60 can form the color print image on the surface of the recording sheet 5 in the fuser unit 16, the color print image being the toner images of the four colors that are fused onto the surface of the recording sheet 5. Thereafter, each time the recording sheet 5, to the surface of which the toner images of the four colors are transferred, is taken in from the recording sheet inlet 50AX, similarly, heat and pressure are applied to the recording sheet 5 and the recording sheet is fed out from the recording sheet outlet 50CX to the ejection carrying path.

In the fuser unit 16, in the case of such continuous print, each time the recording sheet 5 is sandwiched between the outer surface of the fuser belt 86 and the outer surface of the pressure application belt 96, an amount of heat required for fusing the toner images is supplied from the sandwiching range AR1, AR2 to the recording sheet 5. Thereby, there is a tendency that the temperature of the sandwiching range AR1, AR2 that has been adjusted to the target temperature TS1 gradually drops. When the controller 60 detects via the fuser part temperature sensor 87 that, in practice, the temperature of the sandwiching range AR1, AR2 of the outer surface of the fuser belt 86 has dropped due to that the recording sheet 5 is sandwiched between the outer surface of the fuser belt 86 and the outer surface of the pressure application belt 96, in response to the detection result, the controller 60 repeatedly ON/OFF-controls the first heater power source 120. As a result, the controller 60 intermittently causes, via the first heater power source 120, the fuser part first heater 82 or the fuser part second heater 83 to generate heat to apply heat to the fuser belt 86. In this way, during continuous print, even when the temperature of the sandwiching range AR1, AR2 of the outer surface of the fuser belt 86 gradually drops, during this period, the controller 60 intermittently causes the fuser part first heater 82 or the fuser part second heater 83 to generate heat to apply heat to the fuser belt 86 and thereby the temperature of the sandwiching range AR1, AR2 can be maintained at a temperature that is higher to some extent than the minimum fusing temperature. Further, when the controller 60 detects via the pressure application part temperature sensor 97 that, in practice, the temperature of the sandwiching range AR1, AR2 of the outer surface of the pressure application belt 96 has dropped due to that the recording sheet 5 is sandwiched between the outer surface of the fuser belt 86 and the outer surface of the pressure application belt 96, in response to the detection result, the controller 60 repeatedly ON/OFF-controls the second heater power source 121. As a result, the controller 60 intermittently causes, via the second heater power source 121, the pressure application part first heater 92 or the pressure application part second heater 93 to generate heat to apply heat to the pressure application belt 96. In this way, during continuous print, even when the temperature of the sandwiching range AR1, AR2 of the outer surface of the pressure application belt 96 gradually drops, during this period, the controller 60 intermittently causes the pressure application part first heater 92 or the pressure application part second heater 93 to generate heat to apply heat to the pressure application belt 96 and thereby, similar to the case of the fuser belt 86, the temperature of the sandwiching range AR1, AR2 can also be maintained at a temperature that is higher to some extent than the minimum fusing temperature.

However, in this case, when the controller 60 intermittently causes, via the first heater power source 120, the fuser part first heater 82 or the fuser part second heater 83 to generate heat to apply heat to the fuser belt 86, since there is no factor that particularly causes the temperature of the non-sandwiching range AR3 on the outer surface of the fuser belt 86 to drop, the temperature of the non-sandwiching range AR3 on the outer surface of the fuser belt 86 gradually rises to above the target temperature TS1. Further, when the controller 60 intermittently causes, via the second heater power source 121, the pressure application part first heater 92 or the pressure application part second heater 93 to generate heat to apply heat to the pressure application belt 96, since there is no factor that particularly causes the temperature of the non-sandwiching range AR3 on the outer surface of the pressure application belt 96 to drop, the temperature of the non-sandwiching range AR3 on the outer surface of the pressure application belt 96 also gradually rises to above the target temperature TS1. Since the controller 60 intermittently causes the fuser part first heater 82 or the fuser part second heater 83 to generate heat and also intermittently causes the pressure application part first heater 92 or the pressure application part second heater 93 to generate heat, the temperature of the non-sandwiching range AR3 on the outer surface of the fuser belt 86 and the outer surface of the pressure application belt 96 can be made substantially constant while has not been raised too high. When the continuous print ends, the controller 60 terminates supply of the heat generation control current from the first heater power source 120 to the fuser part first heater 82 or the fuser part second heater 83 and causes the fuser part first heater 82 or the fuser part second heater 83 to terminate heat generation. Further, in this case, the controller 60 also terminates supply of the heat generation control current from the second heater power source 121 to the pressure application part first heater 92 or the pressure application part second heater 93 and causes the pressure application part first heater 92 or the pressure application part second heater 93 to terminate heat generation.

As described above, when the fuser part first heater 82 and the fuser part second heater 83, and the pressure application part first heater 92 and the pressure application part second heater 93, are formed as halogen lamps, because of characteristics of the halogen lamps, even when the supply of the heat generation control currents from the first heater power source 120 and the second heater power source 121 is terminated to terminate heat generation, the temperatures of the fuser part first heater 82 and the fuser part second heater 83, and the pressure application part first heater 92 and the pressure application part second heater 93, cannot immediately drop. Therefore, even when the continuous print terminates and the heat generation of the fuser part first heater 82 and the fuser part second heater 83, and the pressure application part first heater 92 and the pressure application part second heater 93, are terminated, due to the heat generated by the fuser part first heater 82 and the fuser part second heater 83, and the pressure application part first heater 92 and the pressure application part second heater 93, it is possible that the temperatures of the sandwiching range AR1, AR2 and the non-sandwiching range AR3 on the outer surfaces of the fuser belt 86 and the pressure application belt 96 rise slightly above the temperatures at the time when the heat generation is terminated. Therefore, the above-described damage prevention temperature TS2 is suitably selected by also taking into account the characteristics of such fuser part first heater 82, fuser part second heater 83, pressure application part first heater 92 and pressure application part second heater 93 as halogen lamps.

However, although not particularly illustrated in the drawings, for example, when, due to malfunction of the fuser part temperature sensor 87, the controller 60 erroneously detects the temperature of the sandwiching range AR1, AR2 of the outer surface of the fuser belt 86 as a temperature lower than an actual temperature, depending on the erroneously detected temperature (that is, the erroneously detected temperature is relatively low), the controller 60 continuously supplies the heat generation control current from the first heater power source 120 to the fuser part first heater 82 or the fuser part second heater 83 to generate heat and thereby it is possible that the ambient temperature of the fuser part first heater 82 or the fuser part second heater 83 (that is, the temperature on the inner side of the fuser belt 86) significantly rises. In this way, when the ambient temperature of the fuser part first heater 82 or the fuser part second heater 83 (that is, the temperature on the inner side of the fuser belt 86) rises, this temperature can be reflected in the temperature of the non-sandwiching range AR3 on the outer surface of the fuser belt 86. Therefore, even when the ambient temperature of the fuser part first heater 82 or the fuser part second heater 83 (that is, the temperature on the inner side of the fuser belt 86) rises, when the temperature of the non-sandwiching range AR3 on the outer surface of the fuser belt 86 that reflects the temperature on the inner side of the fuser belt 86 reaches the damage prevention temperature TS2, by detecting this, the fuser part thermostat 88 can forcibly block the supply of the heat generation control current from the first heater power source 120 to the fuser part first heater 82 or the fuser part second heater 83. As a result, the fuser part thermostat 88 interrupts the heat generation of the fuser part first heater 82 or the fuser part second heater 83, and a significant temperature rise around the fuser part first heater 82 or the fuser part second heater 83 (that is, on the inner side of the fuser belt 86) can be prevented.

Further, for example, when, due to malfunction of the pressure application part temperature sensor 97, the controller 60 erroneously detects the temperature of the sandwiching range AR1, AR2 of the outer surface of the pressure application belt 96 as a temperature lower than an actual temperature, depending on the erroneously detected temperature, the controller 60 continuously supplies the heat generation control current from the second heater power source 121 to the pressure application part first heater 92 or the pressure application part second heater 93 to generate heat and thereby it is possible that the ambient temperature of the pressure application part first heater 92 or the pressure application part second heater 93 (that is, the temperature on the inner side of the pressure application belt 96) significantly rises. In this way, when the ambient temperature of the pressure application part first heater 92 or the pressure application part second heater 93 (that is, the temperature on the inner side of the pressure application belt 96) rises, this temperature can be reflected in the temperature of the non-sandwiching range AR3 on the outer surface of the pressure application belt 96. Therefore, even when the ambient temperature of the pressure application part first heater 92 or the pressure application part second heater 93 (that is, the temperature on the inner side of the pressure application belt 96) rises, when the temperature of the non-sandwiching range AR3 on the outer surface of the pressure application belt 96 that reflects the temperature on the inner side of the pressure application belt 96 reaches the damage prevention temperature TS2, by detecting this, the pressure application part thermostat 98 can forcibly block the supply of the heat generation control current from the second heater power source 121 to the pressure application part first heater 92 or the pressure application part second heater 93. As a result, the pressure application part thermostat 98 interrupts the heat generation of the pressure application part first heater 92 or the pressure application part second heater 93, and a significant temperature rise around the pressure application part first heater 92 or the pressure application part second heater 93 (that is, on the inner side of the pressure application belt 96) can be prevented. In this way, even when the ambient temperatures of the fuser part first heater 82 or the fuser part second heater 83 and the ambient temperature of the pressure application part first heater 92 or the pressure application part second heater 93 rise, the fuser part thermostat 88 and the pressure application part thermostat 98 can accurately detect the ambient temperatures and interrupt the heat generation, and thus damage to the fuser unit 16 can be prevented from occurring.

(1-3) Operation and Effect of First Embodiment

In the above-describe configuration, in the color printer 1, in the fuser unit 16, the fuser belt 86 is provided rotatable in the one rotation direction, and the pressure application belt 96 is provided rotatable in the other rotation direction in the state in which a portion of the outer surface of the pressure application belt 96 is pressed against a portion of the outer surface of the fuser belt 86. Further, in the color printer 1, in the fuser unit 16, the fuser part first heater 82 and the fuser part second heater 83 are provided inside the fuser belt 86, and the pressure application part first heater 92 and the pressure application part second heater 93 are provided inside the pressure application belt 96. Further, in the color printer 1, in the fuser unit 16, the fuser part temperature sensor 87 is provided capable of detecting the temperature of the sandwiching range AR1, AR2 of the outer surface of the fuser belt 86, and the pressure application part temperature sensor 97 is provided capable of detecting the temperature of the sandwiching range AR1, AR2 of the outer surface of the pressure application belt 96.

During the formation of the print image, while causing the fuser belt 86 and the pressure application belt 96 to rotate in mutually opposite directions in the fuser unit 16, the color printer 1 detects, via the fuser part temperature sensor 87, the temperature of the sandwiching range AR1, AR2 of the outer surface of the fuser belt 86 and, in response to the detection result, causes the fuser part first heater 82 or the fuser part second heater 83 to generate heat to apply heat to the fuser belt 86. Further, in this case, in the fuser unit 16, the color printer 1 detects, via the pressure application part temperature sensor 97, the temperature of the sandwiching range AR1, AR2 of the outer surface of the pressure application belt 96 and, in response to the detection result, causes the pressure application part first heater 92 or the pressure application part second heater 93 to generate heat to apply heat to the pressure application belt 96.

In this state, in the fuser unit 16, the color printer 1 applies heat and pressure to the recording sheet 5, to the surface of which the toner images are transferred, while carrying the recording sheet 5 in the manner sandwiching the recording sheet 5 between the sandwiching range AR1, AR2 of the outer surface of the fuser belt 86 and the sandwiching range AR1, AR2 of the outer surface of the pressure application belt 96. As a result, in the fuser unit 16, the color printer 1 can form the print image by fusing the toner images onto the surface of the recording sheet 5 by temporarily melting once the toner images. In the color printer 1, in the fuser unit 16, the fuser part thermostat 88 is provided in the manner that the front end of the heat sensing part 88B is in contact with the left end part (the non-sandwiching range AR3) outside the sandwiching range AR1, AR2 of the outer surface of the fuser belt 86 for detecting, when the temperature of the outer surface of the fuser belt 86 has reached the damage prevention temperature TS2, the temperature of the outer surface that has reached the damage prevention temperature TS2 and, in response to the detection result, interrupting the heat generation of the fuser part first heater 82 or the fuser part second heater 83. Further, in the color printer 1, in the fuser unit 16, the pressure application part thermostat 98 is provided in the manner that the front end of the heat sensing part 98B is in contact with the left end part (the non-sandwiching range AR3) outside the sandwiching range AR1, AR2 of the outer surface of the pressure application belt 96 for detecting, when the temperature of the outer surface of the pressure application belt 96 has reached the damage prevention temperature TS2, the temperature of the outer surface that has reached the damage prevention temperature TS2 and, in response to the detection result, interrupting the heat generation of the pressure application part first heater 92 or the pressure application part second heater 93.

Therefore, during the formation of the print image, regardless whether or not the recording sheet 5 is carried for applying heat and pressure thereto by the fuser belt 86 and the pressure application belt 96, when the ambient temperature of the fuser part first heater 82 or the fuser part second heater 83 rises, the color printer 1 can accurately detect the ambient temperature as the temperature of the outer surface of the fuser belt 86 without being influenced by the temperature drop due to contact with the recording sheet 5 and interrupt the heat generation of the fuser part first heater 82 or the fuser part second heater 83, and thus a significant temperature rise of the fuser unit 16 can be prevented from occurring. Further, regardless whether or not the recording sheet 5 is carried for applying heat and pressure thereto by the fuser belt 86 and the pressure application belt 96, due to the pressure application part thermostat 98, when the ambient temperature of the pressure application part first heater 92 or the pressure application part second heater 93 rises, the color printer 1 can accurately detect the ambient temperature as the temperature of the outer surface of the pressure application belt 96 without being influenced by the temperature drop due to contact with the recording sheet 5 and interrupt the heat generation of the pressure application part first heater 92 or the pressure application part second heater 93, and thus a significant temperature rise of the fuser unit 16 can be prevented from occurring.

According to the above-described configuration, in the color printer 1, in the fuser unit 16, the fuser belt 86 and the pressure application belt 96 are provided rotatable in mutually opposite the one rotation direction and the other rotation direction for carrying the recording sheet 5, for carrying the recording sheet 5, to the surface of which the toner images are transferred, by sandwiching the recording sheet 5 between the sandwiching range AR1, AR2 of the outer surface of the fuser belt 86 and the sandwiching range AR1, AR2 of the outer surface of the pressure application belt 96; the fuser part first heater 82 and the fuser part second heater 83 are provided inside the fuser belt 86 for applying heat to the fuser belt 86 and the pressure application part first heater 92 and the pressure application part second heater 93 are provided inside the pressure application belt 96 for applying heat to the pressure application belt 96; and further, the fuser part thermostat 88 is provided in the manner that the front end of the heat sensing part 88B is in contact with the left end part outside the sandwiching range AR1, AR2 of the outer surface of the fuser belt 86, for detecting that the temperature of the outer surface of the fuser belt 86 has reached the damage prevention temperature TS2 and interrupting the heat generation of the fuser part first heater 82 and the fuser part second heater 83, and the pressure application part thermostat 98 is provided in the manner that the front end of the heat sensing part 98B is in contact with the left end part outside the sandwiching range AR1, AR2 of the outer surface of the pressure application belt 96, for detecting that the temperature of the outer surface of the pressure application belt 96 has reached the damage prevention temperature TS2 and interrupting the heat generation of the pressure application part first heater 92 and the pressure application part second heater 93.

As a result, during the formation of the print image, regardless whether or not the recording sheet 5 is carried for applying heat and pressure thereto by the fuser belt 86 and the pressure application belt 96, when the ambient temperature of the fuser part first heater 82 and the fuser part second heater 83 and the ambient temperature of the pressure application part first heater 92 and pressure application part second heater 93 rise, the color printer 1 can accurately detect the ambient temperatures as the temperature of the outer surface of the fuser belt 86 and the temperature of the outer surface of the pressure application belt 96 without being influenced by the temperature drop due to contact with the recording sheet 5 and interrupt the heat generation of the fuser part first heater 82 and the fuser part second heater 83, and the pressure application part first heater 92 and the pressure application part second heater 93. Therefore, the color printer 1 can prevent damage to the fuser unit 16 due to a significant temperature rise from occurring.

In the color printer 1, as described above, the fuser part first heater 82 and the fuser part second heater 83 are provided inside the fuser belt 86 for applying heat to the fuser belt 86, and the pressure application part first heater 92 and the pressure application part second heater 93 are provided inside the pressure application belt 96 for applying heat to the pressure application belt 96. Therefore, when applying heat and pressure to the recording sheet 5 while carrying the recording sheet 5 by sandwiching the recording sheet 5 between the fuser belt 86 and the pressure application belt 96 that rotate in mutually opposite directions, the color printer 1 can efficiently apply heat to the recording sheet 5 from its front surface and back surface.

Further, in the color printer 1, as described above, the front end of the heat sensing part 88B of the fuser part thermostat 88 is in contact with the non-sandwiching range AR3 for detecting the temperature of the outer surface of the fuser belt 86, and the front end of the heat sensing part 98B of the pressure application part thermostat 98 is in contact with the non-sandwiching range AR3 for detecting the temperature of the outer surface of the pressure application belt 96. Therefore, in the color printer 1, even when the outer surface of the fuser belt 86 and the outer surface of the pressure application belt 96 are worn and damaged due to sliding with respect to the front end of the heat sensing part 88B of the fuser part thermostat 88 and the front end of the heat sensing part 98B of the pressure application part thermostat 98, fusing failure of the toner images on the surface of the recording sheet 5 due to the wear and damage of the belts can be prevented from occurring.

In addition, according to the configuration of the color printer 1, the fuser part thermostat 88 and the pressure application part thermostat 98 are arranged on the outer surface sides of the fuser belt 86 and the pressure application belt 96. Therefore, that the fuser part thermostat 88 and the pressure application part thermostat 98 deteriorates and malfunctions due to heat being directly applied thereto by the fuser part first heater 82 and the fuser part second heater 83, and the pressure application part first heater 92 and the pressure application part second heater 93, can be prevented. Further, in the color printer 1, the temperatures of the outer surfaces of the fuser belt 86 and the pressure application belt 96 are lower than the temperatures of the inner surfaces of the fuser belt 86 and the pressure application belt 96, to which heat is directly applied by the fuser part first heater 82 and the fuser part second heater 83, and the pressure application part first heater 92 and the pressure application part second heater 93. Therefore, the temperature to be detected by the fuser part thermostat 88 and the pressure application part thermostat 98 for preventing damage to the fuser unit 16 (that is, the damage prevention temperature TS2) can be lowered as compared to a case where the detection is performed on the inner surfaces. In other words, even without a configuration that allows the fuser part thermostat 88 and the pressure application part thermostat 98 to operate in a high temperature environment (that is, with a simple configuration), the color printer 1 can accurately detect the ambient temperature of the fuser part first heater 82 and the fuser part second heater 83 and the ambient temperature of the pressure application part first heater 92 and the pressure application part second heater 93.

Further, in the color printer 1, the one end parts of the respective heat generation parts of the fuser part first heater 82 and the fuser part second heater 83 are arranged to oppose the left end part of the inner surface, which is the under side of the non-sandwiching range AR3 of the outer surface, of the fuser belt 86, and the one end parts of the respective heat generation parts of the pressure application part first heater 92 and the pressure application part second heater 93 are arranged to oppose the left end part of the inner surface, which is the under side of the non-sandwiching range AR3 of the outer surface, of the pressure application belt 96. Therefore, in the color printer 1, in the temperature of the non-sandwiching range AR3 of the outer surface of the fuser belt 86 and the temperature of the non-sandwiching range AR3 of the outer surface of the pressure application belt 96, which are to be detected by the fuser part thermostat 88 and the pressure application part thermostat 98 as the ambient temperatures of the fuser part first heater 82 and the fuser part second heater 83, and the pressure application part first heater 92 and the pressure application part second heater 93, these ambient temperatures that change due to the heat generation of the fuser part first heater 82 and the fuser part second heater 83, and the pressure application part first heater 92 and the pressure application part second heater 93, can be unerringly reflected. Therefore, in the color printer 1, regardless whether or not the recording sheet 5 is carried for applying heat and pressure thereto by the fuser belt 86 and the pressure application belt 96, the detection accuracy of the ambient temperature of the fuser part first heater 82 and the fuser part second heater 83 and the ambient temperature of the pressure application part first heater 92 and the pressure application part second heater 93 by the fuser part thermostat 88 and the pressure application part thermostat 98 can be further improved.

Further, in the color printer 1, the fuser belt 86 is hung in the state in which a tensional force is not applied to the belt drive roller 80 and the fuser part driven roller 81, and the pressure application belt 96 is hung in the state in which a tensional force is not applied to the pressure application roller 90 and the pressure application part driven roller 91. By pressing the pressure application roller 90 and the pressure application part driven roller 91 sequentially via the pressure application belt 96 and the fuser belt 86 against the belt drive roller 80 and the fuser part driven roller 81, the sandwiching part 115 in which the recording sheet 5 is sandwiched by the pressure application belt 96 and the fuser belt 86 is formed. In color printer 1, the fuser part thermostat 88 is fixed by pressing the front end of the heat sensing part 88B against the outer surface of the portion (that is, the upper side portion) of the fuser belt 86 that opposes the sandwiching part 115 in the state in which the opposing portion is displaced (that is, pressed down), and the pressure application part thermostat 98 is fixed by pressing the front end of the heat sensing part 98B against the outer surface of the portion (that is, the lower side portion) of the pressure application belt 96 that opposes the sandwiching part 115 in the state in which the opposing portion is displaced (that is, pressed up).

Therefore, in the color printer 1, regardless whether or not the recording sheet 5 is carried for applying heat and pressure thereto by the fuser belt 86 and the pressure application belt 96, the front end of the heat sensing part 88B of the fuser part thermostat 88 can be stably in contact with the outer surface of the fuser belt 86, and the front end of the heat sensing part 98B of the pressure application part thermostat 98 can be stably in contact with the outer surface of the pressure application belt 96. Therefore, in the color printer 1, regardless whether or not the recording sheet 5 is carried for applying heat and pressure thereto by the fuser belt 86 and the pressure application belt 96, the ambient temperature of the fuser part first heater 82 and fuser part second heater 83 can be further accurately detected as the temperature of the outer surface of the fuser belt 86 by the fuser part thermostat 88, and the ambient temperature of the pressure application part first heater 92 and the pressure application part second heater 93 can be further accurately detected as the temperature of the outer surface of the pressure application belt 96 by the pressure application part thermostat 98.

In the color printer 1, the resin layers are formed on the surface of the heat sensing part 88B of the fuser part thermostat 88 and the surface of the heat sensing part 98B of the pressure application part thermostat 98. Therefore, in the color printer 1, the adhesion of the front end of the heat sensing part 88B of the fuser part thermostat 88 and the front end of the heat sensing part 98B of the pressure application part thermostat 98 with respect to the outer surface of the fuser belt 86 and the outer surface of the pressure application belt 96 is improved and, even when the outer surfaces of the fuser belt 86 and the pressure application belt 96 slide with respect to the front ends of the heat sensing parts 88B, 98B, that the outer surfaces of the fuser belt 86 and the pressure application belt 96 are worn and damaged due to the front ends can be significantly reduced and the releasability of toner on the surfaces of the heat sensing parts 88B, 98B can be improved. As a result, in the color printer 1, during the formation of the print image, it can be avoided as much as possible that the accuracy of the temperature detection is reduced due to that wear powder and toner enter or the outer surfaces are damaged, the wear powder entering between the front end of the heat sensing part 88B of the fuser part thermostat 88 and the outer surface of the fuser belt 86 or between the front end of the heat sensing part 98B of the pressure application part thermostat 98 and the outer surface of the pressure application belt 96.

Further, in the color printer 1, the fuser part first reflection plate 84 and the fuser part second reflection plate 85 are arranged on the inner side of the fuser belt 86, and the pressure application part first reflection plate 94 and the pressure application part second reflection plate 95 are arranged on the inner side of the pressure application belt 96. Therefore, in the color printer 1, a part of the radiant heat of the fuser part first heater 82 and the fuser part second heater 83 can be reflected by the reflection surface of the fuser part first reflection plate 84 and the reflection surface of the fuser part second reflection plate 85 toward the inner surface of the fuser belt 86 and a part of the radiant heat of the pressure application part first heater 92 and the pressure application part second heater 93 can be reflected by the reflection surface of the pressure application part first reflection plate 94 and the reflection surface of the pressure application part second reflection plate 95 toward the inner surface of the pressure application belt 96, and thus heat can be efficiently applied to the fuser belt 86 and the pressure application belt 96. In the color printer 1, the fuser part first reflection plate 84 and the fuser part second reflection plate 85 are formed to be longer than the fuser belt width, and one end part and the other end part of each of the fuser part first reflection plate 84 and the fuser part second reflection plate 85 are arranged in the manner projecting outwardly from the left end and the right end of the fuser belt 86; and the pressure application part first reflection plate 94 and the pressure application part second reflection plate 95 are formed to be longer than the pressure application belt width, and one end and the other end of each of the pressure application part first reflection plate 94 and the pressure application part second reflection plate 95 are arranged in the manner projecting outwardly from the left end and the right end of the of the pressure application belt 96. Therefore, in the color printer 1, in the temperature of the non-sandwiching range AR3 of the outer surface of the fuser belt 86 and the temperature of the non-sandwiching range AR3 of the outer surface of the pressure application belt 96, which are to be detected by the fuser part thermostat 88 and the pressure application part thermostat 98 as the ambient temperatures of the fuser part first heater 82 and the fuser part second heater 83, and the pressure application part first heater 92 and the pressure application part second heater 93, the ambient temperature of the heat generation of the fuser part first heater 82 and the fuser part second heater 83 and the ambient temperature of the pressure application part first heater 92 and the pressure application part second heater 93 can be further unerringly reflected.

In addition, in the color printer 1, the fuser part first reflection plate 84 is arranged between the fuser part first heater 82 and the fuser part second heater 83 and the belt drive roller 80 in the manner that the back surface of the fuser part first reflection plate 84 is brought close to the outer peripheral surface of the belt drive roller 80; and the fuser part second reflection plate 85 is arranged between the fuser part first heater 82 and the fuser part second heater 83 and the fuser part driven roller 81 in the manner that the back surface of the fuser part second reflection plate 85 is brought close to the outer peripheral surface of the fuser part driven roller 81. Further, in the color printer 1, the pressure application part first reflection plate 94 is arranged between the pressure application part first heater 92 and the pressure application part second heater 93 and the pressure application roller 90 in the manner that the back surface of the pressure application part first reflection plate 94 is brought close to the outer peripheral surface of the pressure application roller 90; and the pressure application part second reflection plate 95 is arranged between the pressure application part first heater 92 and the pressure application part second heater 93 and the pressure application part driven roller 91 in the manner that the back surface of the pressure application part second reflection plate 95 is brought close to the outer peripheral surface of the pressure application part driven roller 91. Therefore, in the color printer 1, the belt drive roller 80 and the fuser part driven roller 81 can be protected from the radiant heat of the fuser part first heater 82 and the fuser part second heater 83, and the pressure application roller 90 and the pressure application part driven roller 91 can be protected from the radiant heat of the pressure application part first heater 92 and the pressure application part second heater 93.

(2) Second Embodiment

(2-1) Internal Configuration of Color Printer

Next, an internal configuration of a color printer 150 (FIG. 1) according a second embodiment is described. The color printer 150 according to the second embodiment is configured in the same way as the above-described color printer 1 according to the first embodiment except a part of a configuration of a fuser unit 151 (FIG. 1) and a part of a process that a controller 152 executes. The color printer 150 according to the second embodiment, basically, operates in the same way as the above-described color printer 1 according to the first embodiment to form a print image on the surface of the recording sheet 5. Therefore, for details of the configuration of the color printer 150 according to the second embodiment, see the description of the configuration of the color printer 1 according to the first embodiment described above using FIG. 1. A description about the details of the configuration of the color printer 150 is omitted here.

(2-2) Configuration of Fuser Unit

Figure 14:
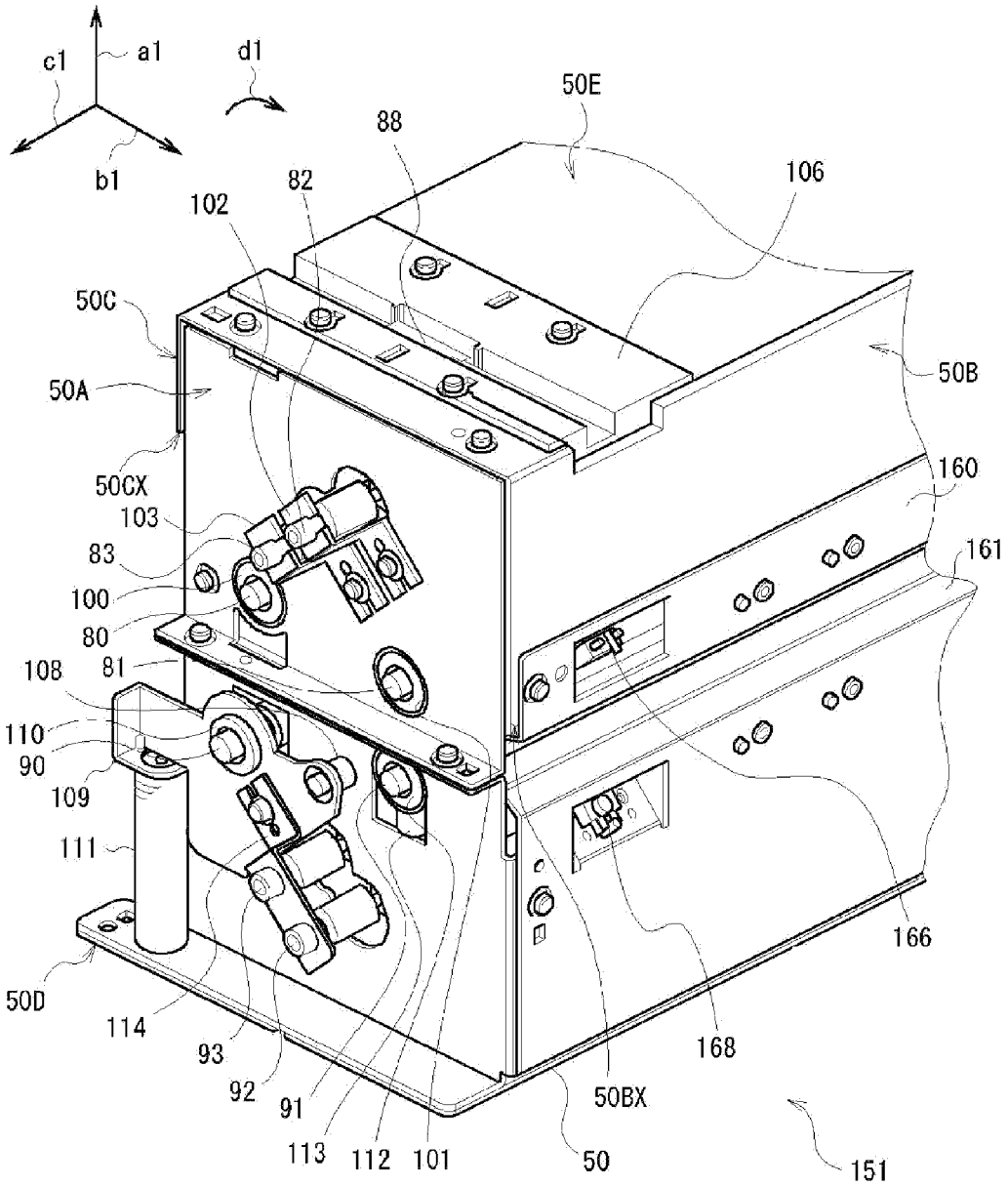
FIG. 14 illustrates a schematic perspective view of an external configuration of a fuser unit according to a second embodiment.
Figure 15:
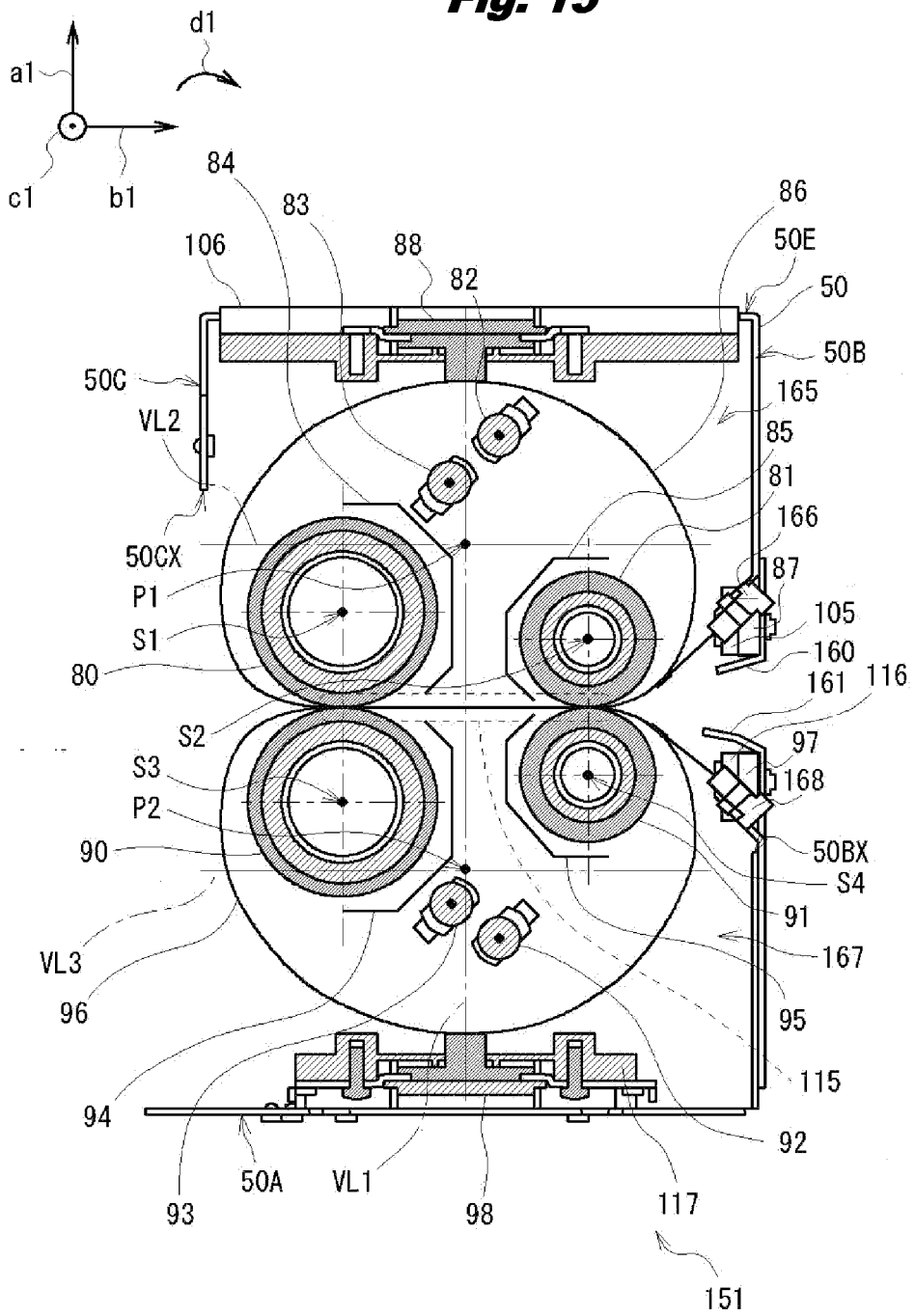
FIG. 15 illustrates a schematic side view of an internal configuration (1) of the fuser unit according to the second embodiment.
Figure 16:
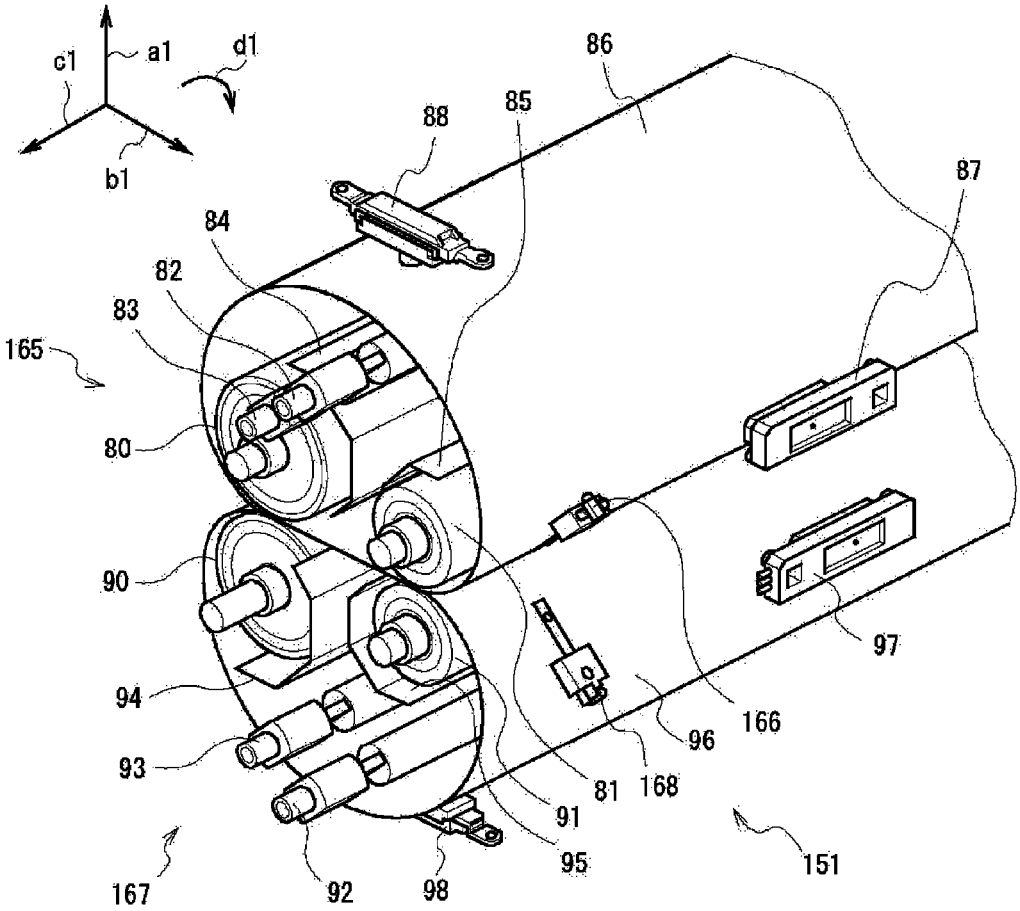
FIG. 16 illustrates a schematic perspective view of an internal configuration (2) of the fuser unit according to the second embodiment.

Next, the configuration of the fuser unit 151 is described. As illustrated in FIGS. 14-16, in which the same reference numeral symbols are used to indicate corresponding parts in FIGS. 2-4, the fuser unit 151 has an upper side inlet guide 160 and a lower side inlet guide 161 that ate provided on the unit case 50 and have configurations partially different from those of the above-described upper side inlet guide 70 and lower side inlet guide 71 according to the first embodiment. The upper side inlet guide 160 has a substantially U-shaped slit formed at a predetermined position of a left end part of the upper side inlet guide 160, and a base of a plate part (hereinafter, this is also referred to as an upper side sensor holding part) for holding a sensor in the slit is bent at a predetermined angle. As a result, the upper side inlet guide 160 enters into the unit case 50 in a manner that the upper side sensor holding part is parallel to an obliquely rearward and downward direction. Further, the lower side inlet guide 161 has a substantially U-shaped slit formed at a predetermined position directly below the upper side sensor holding part, and a base of a plate part (hereinafter, this is also referred to as a lower side sensor holding part) for holding a sensor in the slit is bent at a predetermined angle. As a result, the lower side inlet guide 161 enters into the unit case 50 in a manner that the lower side sensor holding part is parallel to an obliquely rearward and upward direction.

In addition to the above-described fuser part temperature sensor (hereinafter, this is also particularly referred to as a fuser part first temperature sensor) 87 for detecting the temperature of the outer surface of the fuser belt 86 in a non-contact manner, a fuser part 165 also has a temperature sensor (hereinafter, this is also referred to as a fuser part second temperature sensor) 166 for detecting the temperature of the outer surface of the fuser belt 86 for controlling a heat and pressure application process. The fuser part second temperature sensor 166 is formed by providing a substantially plate-like elastic sensor lever of a predetermined length on one end of a sensor body. The fuser part second temperature sensor 166 is installed in the upper side sensor holding part of the upper side inlet guide 160 in a manner that a front end part of the sensor lever is oriented toward an obliquely rearward and downward side and is in contact with a portion on an obliquely forward and downward side of the outer surface of the fuser belt 86.

On the other hand, in addition to the above-described pressure application part temperature sensor (hereinafter, this is also particularly referred to as a pressure application part first temperature sensor) 97 for detecting the temperature of the outer surface of the pressure application belt 96 in a non-contact manner, a pressure application part 167 also has a temperature sensor (hereinafter, this is also referred to as a pressure application part second temperature sensor) 168 for detecting the temperature of the outer surface of the pressure application belt 96 for controlling the heat and pressure application process. The pressure application part second temperature sensor 168 is formed in the same manner as the fuser part second temperature sensor 166. That is, the pressure application part second temperature sensor 168 is formed by providing a substantially plate-like elastic sensor lever of a predetermined length on one end of a sensor body. The pressure application part second temperature sensor 168 is installed in the lower side sensor holding part of the lower side inlet guide 161 in a manner that a front end part of the sensor lever is oriented toward an obliquely rearward and upward side and is in contact with a portion on an obliquely forward and upward side of the outer surface of the pressure application belt 96.

Figure 17:
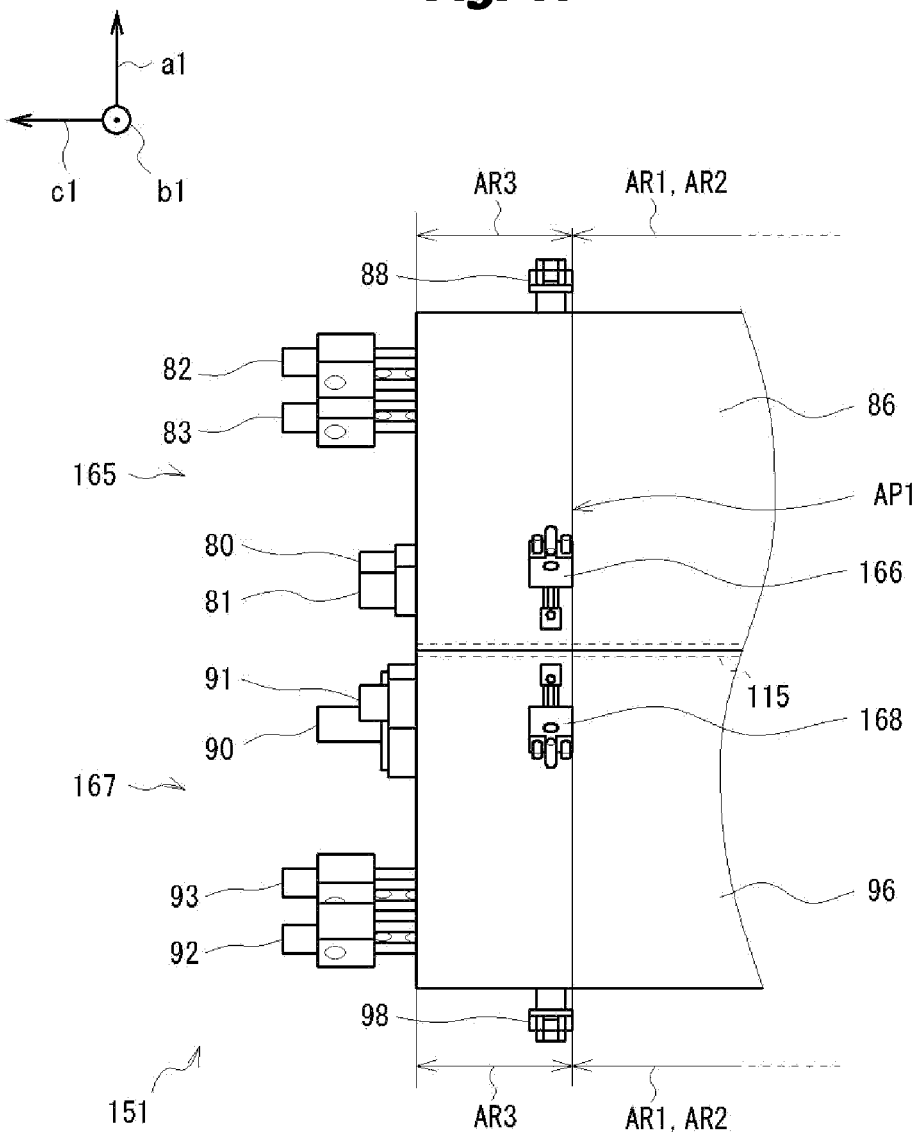
FIG. 17 illustrates a schematic front view for describing arrangement positions of a fuser part second temperature sensor and a pressure application part second temperature sensor.
Figure 18:
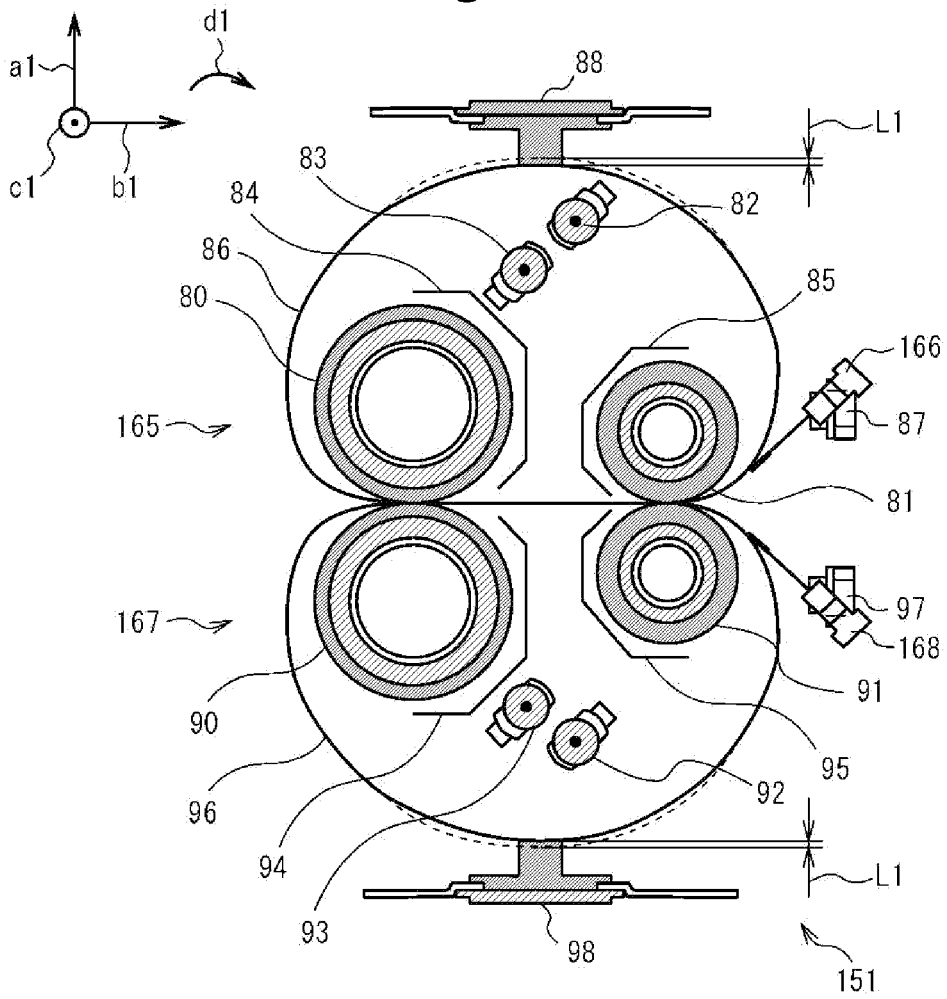
FIG. 18 illustrates a schematic cross-sectional view for describing arrangements for temperature detection of the fuser part second temperature sensor and the pressure application part second temperature sensor.

As illustrated in FIG. 17, in which the same reference numeral symbols are used to indicate corresponding parts in FIG. 11, the front end part of the sensor lever of the fuser part second temperature sensor 166 is in contact with the left end part (that is, the non-sandwiching range AR3) outside of the sandwiching range AR1, AR2 of the outer surface of the fuser belt 86, even when heat and pressure are applied to the recording sheet 5 of any sheet width. Further, the front end part of the sensor lever of the pressure application part second temperature sensor 168 is in contact with the left end part (that is, the non-sandwiching range AR3) outside of the sandwiching range AR1, AR2 of the outer surface of the pressure application belt 96, even when heat and pressure are applied to the recording sheet 5 of any sheet width. More specifically, as illustrated in FIG. 18, in which the same reference numeral symbols are used to indicate corresponding parts in FIG. 12, the fuser part second temperature sensor 166 is fixed on the upper side sensor holding part in a manner that the front end part of the sensor lever is pressed against the outer surface of the portion on the obliquely forward and downward side of the fuser belt 86 with a predetermined pressing force. Therefore, in fuser unit 151, when the fuser belt 86 rotates in the one rotation direction, the outer surface of the fuser belt 86 can slide from the base side toward the front end side of the sensor lever with respect to the front end part of the sensor lever of the fuser part second temperature sensor 166. In the fuser unit 151, since the sensor lever of the fuser part second temperature sensor 166 is elastic, even when the front side portion of the fuser belt 86 that is rotating in the one rotation direction vibrates back and forth, the front end part of the sensor lever can be suitably displaced so as to match the vibration. Therefore, in the fuser unit 151, the front end part of the sensor lever of the fuser part second temperature sensor 166 can be stably in contact with the non-sandwiching range AR3 of the outer surface of the fuser belt 86. As a result, in the fuser unit 151, the temperature of the outer surface of the fuser belt 86 can be accurately detected by the fuser part second temperature sensor 166 without being influenced by the temperature drop due to contact with the recording sheet 5.

On the front end part of the sensor lever of the fuser part second temperature sensor 166, a predetermined resin layer such as that of fluorine-based resin such as PFA or PTFE is formed (for example, using fluorine-based resin tube covering or fluorine-based resin coating) to improve adhesion of the front end part of the sensor lever with respect to the outer surface of the fuser belt 86. As a result, even when the outer surface of the fuser belt 86 slides with respect to the front end part of the sensor lever of the fuser part second temperature sensor 166, that the outer surface of the fuser belt 86 is worn and damaged due to the front end part is significantly reduced and the releasability of toner on the front end part of the sensor lever is improved. Therefore, during the formation of the print image, it is avoided as much as possible that the accuracy of the temperature detection is reduced due to that wear powder and toner enter between the front end part of the sensor lever of the fuser part second temperature sensor 166 and the outer surface of the fuser belt 86 and the outer surface is damaged. Further, even when the outer surface of the fuser belt 86 is damaged due to sliding with respect to the front end part of the sensor lever of the fuser part second temperature sensor 166, a contact position of the front end part of the sensor lever is in the non-sandwiching range AR3. Therefore, fusing failure of the toner images on the surface of the recording sheet 5 due to the damage can also be prevented from occurring.

On the other hand, the pressure application part second temperature sensor 168 is fixed on the lower side sensor holding part in a manner that the front end part of the sensor lever is pressed against the outer surface of the portion on the obliquely forward and upward side of the pressure application belt 96 with a predetermined pressing force. Therefore, in fuser unit 151, when the pressure application belt 96 rotates in the other rotation direction, the outer surface of the pressure application belt 96 can slide from the base side toward the front end side of the sensor lever with respect to the front end part of the sensor lever of the pressure application part second temperature sensor 168. In the fuser unit 151, since the sensor lever of the pressure application part second temperature sensor 168 is elastic, even when the front side portion of the pressure application belt 96 that is rotating in the other rotation direction vibrates back and forth, the front end part of the sensor lever can be suitably displaced so as to match the vibration. Therefore, in the fuser unit 151, the front end part of the sensor lever of the pressure application part second temperature sensor 168 can be stably in contact with the non-sandwiching range AR3 of the outer surface of the pressure application belt 96. As a result, in the fuser unit 151, similar to the case of the fuser part second temperature sensor 166, the temperature of the outer surface of the pressure application belt 96 can be accurately detected by the pressure application part second temperature sensor 168 without being influenced by the temperature drop due to contact with the recording sheet 5.

Similar to the fuser part second temperature sensor 166, on the front end part of the sensor lever of the pressure application part second temperature sensor 168, a predetermined resin layer such as that of fluorine-based resin such as PFA or PTFE is formed (for example, using fluorine-based resin tube covering or fluorine-based resin coating) to improve adhesion of the front end part of the sensor lever with respect to the outer surface of the pressure application belt 96. As a result, even when the outer surface of the pressure application belt 96 slides with respect to the front end part of the sensor lever of the pressure application part second temperature sensor 168, that the outer surface of the pressure application belt 96 is worn and damaged due to the front end part is significantly reduced and the releasability of toner on the front end part of the sensor lever is improved. Therefore, during the formation of the print image, it is avoided as much as possible that the accuracy of the temperature detection is reduced due to that wear powder and toner enter between the front end part of the sensor lever of the pressure application part second temperature sensor 168 and the outer surface of the pressure application belt 96 and the outer surface is damaged. Further, similar to the fuser part second temperature sensor 166, even when the outer surface of the pressure application belt 96 is damaged due to sliding with respect to the front end part of the sensor lever of the pressure application part second temperature sensor 168, a contact position of the front end part of the sensor lever is in the non-sandwiching range AR3. Therefore, pressure application failure of the toner images on the surface of the recording sheet 5 due to the damage can also be prevented from occurring.

When the fuser unit 151 is installed in the color printer 150, together with the fuser part first temperature sensor 87 and the pressure application part first temperature sensor 97, the fuser part second temperature sensor 166 and the pressure application part second temperature sensor 168 are also electrically connected to the controller 152. Therefore, in the fuser unit 151, similar to the case of the above-described first embodiment, the controller 152 detects, via the fuser part first temperature sensor 87, the temperature of the outer surface of the fuser belt 86 and, in response to the detection result, ON/OFF-controls the first heater power source 120 to adjust the temperature of the outer surface of the fuser belt 86 to a temperature required for fusing the toner images onto the recording sheet 5. Further, in the fuser unit 151, similar to the case of the above-described first embodiment, the controller 152 detects, via the pressure application part first temperature sensor 97, the temperature of the outer surface of the pressure application belt 96 and, in response to the detection result, ON/OFF-controls the second heater power source 121 to adjust the temperature of the outer surface of the pressure application belt 96 to a temperature required for fusing to the toner images on the recording sheet 5.

In addition, in the fuser unit 151, the controller 152 detects, via the fuser part second temperature sensor 166, the temperature of the outer surface of the fuser belt 86 and detects, via the pressure application part second temperature sensor 168, the temperature of the outer surface of the pressure application belt 96 and, in response to the detection results, switches a processing mode of the heat and pressure application process. Here, as the processing modes of the heat and pressure application process, for example, when the heat and pressure are applied to the recording sheet 5 while the recording sheet 5 is carried in a manner being sandwiched in the sandwiching part 115 of the fuser belt 86 and the pressure application belt 96 that are rotating in opposite directions, there are two kinds of processing modes (a first processing mode and a second processing mode) for which carrying speeds are different. The first processing mode is, for example, a mode in which heat and pressure are applied to the recording sheet 5 while the recording sheet 5 is carried by the sandwiching part 115 at a predetermined carrying speed (hereinafter, this is also referred to as a first carrying speed) by causing the fuser belt 86 and the pressure application belt 96 to rotate in mutually opposite directions at a rotational speed (hereinafter, this is also referred to as a first rotational speed) that is the same as in the case of the above-described first embodiment. Further, the second processing mode is, for example, a mode in which heat and pressure are applied to the recording sheet 5 while the recording sheet 5 is carried by the sandwiching part 115 at a predetermined carrying speed (hereinafter, this is also referred to as a second carrying speed) that is slower than the first carrying speed by causing the fuser belt 86 and the pressure application belt 96 to rotate in mutually opposite directions at a rotational speed (hereinafter, this is also referred to as a second rotational speed) that is slower than the first rotational speed.

Figure 19:
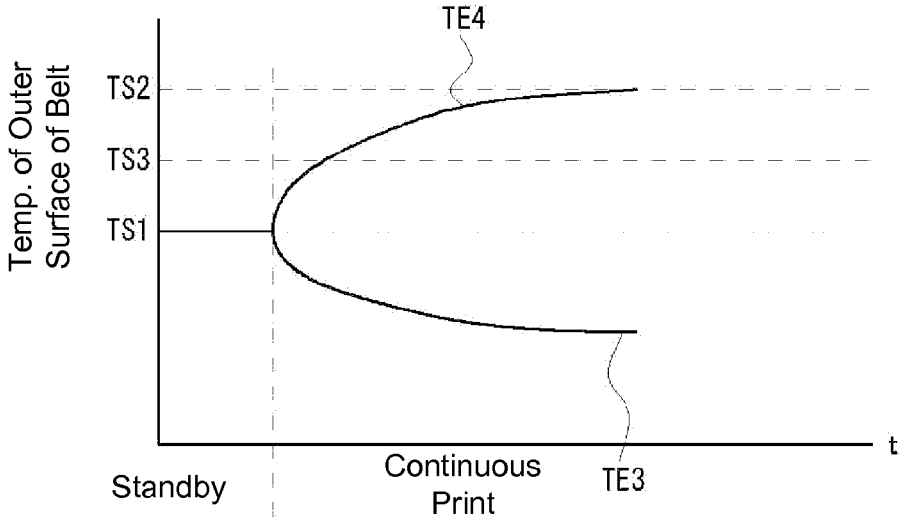
FIG. 19 illustrates a schematic diagram for describing control of temperature of outer surfaces of the fuser belt and the pressure application belt.

In practice, as illustrated in FIG. 19, during the formation of the print image, in the fuser unit 151, the controller 152 starts the heat and pressure application process in the first processing mode. As a result, similar to the case of the above-described first embodiment, the controller 152 causes the fuser belt 86 to rotate in the one rotation direction at the first rotational speed and, in conjunction with this, causes the pressure application belt 96 to rotate in the other rotation direction at the first rotational speed. Further, the controller 152 supplies the heat generation control current from the first heater power source 120 to one of the fuser part first heater 82 and the fuser part second heater 83 according to the sheet width of the recording sheet 5 of a print image formation target in this case to generate heat and begins applying heat to the fuser belt 86. Further, the controller 152 supplies the heat generation control current from the second heater power source 121 to one of the pressure application part first heater 92 and the pressure application part second heater 93 according to the sheet width of the recording sheet 5 of the print image formation target in this case to generate heat and begins applying heat to the pressure application belt 96.

Further, the controller 152 detects, via the fuser part first temperature sensor 87, the temperature of the outer surface of the fuser belt 86 and, in response to the detection result, suitably ON/OFF-controls the first heater power source 120, and thereby, as illustrated in FIG. 12 by a sandwiching range temperature characteristic curve TE3 and a non-sandwiching range temperature characteristic curve TE4, adjusts the temperature of the sandwiching range AR1, AR2 and the temperature of the non-sandwiching range AR3 of the outer surface of the fuser belt 86 to the predetermined target temperature TS1. Further, the controller 152 detects, via the pressure application part first temperature sensor 97, the temperature of the outer surface of the pressure application belt 96 and, in response to the detection result, suitably ON/OFF-controls the second heater power source 121, and thereby, similar to the fuser belt 86, also adjusts the temperature of the sandwiching range AR1, AR2 and the temperature of the non-sandwiching range AR3 of the outer surface of the pressure application belt 96 to the predetermined target temperature TS1. In this way, when the controller 152 raises the temperature of the outer surface of the fuser belt 86 and the temperature of the outer surface of the pressure application belt 96 to the target temperature TS1 in the fuser unit 151, similar to the case of the above-described first embodiment, in the fuser unit 151, the controller 152 sequentially applies, via the fuser belt 86 and the pressure application belt 96, heat and pressure to the recording sheet 5 to form a color print image on the surface of the recording sheet 5.

In this case, when the controller 152 detects, via the fuser part first temperature sensor 87, that the temperature of the sandwiching range AR1, AR2 of the outer surface of the fuser belt 86 has dropped, in response to the detection, the controller 152 repeatedly ON/OFF-controls the first heater power source 120, and thereby causes the fuser part first heater 82 or the fuser part second heater 83 to intermittently generate heat to apply heat to the fuser belt 86. Further, when the controller 152 detects, via the pressure application part first temperature sensor 97, that the temperature of the sandwiching range AR1, AR2 of the outer surface of the pressure application belt 96 has dropped, in response to the detection, the controller 152 repeatedly ON/OFF-controls the second heater power source 121, and thereby causes the pressure application part first heater 92 or the pressure application part second heater 93 to intermittently generate heat to apply heat to the pressure application belt 96. In this way, similar to the case of the above-described first embodiment, during continuous print, even when the temperatures of the sandwiching ranges AR1, AR2 of the outer surfaces of the fuser belt 86 and the pressure application belt 96 gradually drop, by applying heat to the fuser belt 86 and the pressure application belt 96, the controller 152 can maintain the temperatures of the sandwiching ranges AR1, AR2 at temperatures that are higher to some extent than the minimum fusing temperature.

However, in the fuser unit 151, for example, the relatively more the number of the recording sheets 5 that are continuously printed, the larger the drop amount of the temperature of the sandwiching range AR1, AR2 of the outer surface of the fuser belt 86 and the pressure application belt 96 (that is, the drop amount of the temperature from the target temperature TS1). Further, for example, the more the temperature of the sandwiching range AR1, AR2 of the outer surfaces of the fuser belt 86 and the pressure application belt 96 is close to the minimum fusing temperature, the more the controller 152 shortens the time interval of the ON/OFF-control with respect to the first heater power source 120 and the second heater power source 121. As a result, the controller 152 shortens the time interval between heat generation and pause of the fuser part first heater 82 or the fuser part second heater 83 and the pressure application part first heater 92 or the pressure application part second heater 93 to increase the heat generation amount, and maintains the temperature of the sandwiching range AR1, AR2 of the outer surfaces of the fuser belt 86 and the pressure application belt 96 at a temperature that is higher to some extent than the minimum fusing temperature.

Further, similar to the case of the above-described first embodiment, when, due to malfunction of the fuser part first temperature sensor 87 and the pressure application part first temperature sensor 97, the controller 152 erroneously detects the temperature of the sandwiching range AR1, AR2 of the outer surfaces of the fuser belt 86 and the pressure application belt 96 as a temperature lower than an actual temperature, depending on the erroneously detected temperature, the controller 152 continuously ON-controls the first heater power source 120 and the second heater power source 121, and thereby causes the fuser part first heater 82 or the fuser part second heater 83 and the pressure application part first heater 92 or the pressure application part second heater 93 to continuously generate heat to increase the heat generation amount. In this way, the controller 152 increases the heat generation amount of the fuser part first heater 82 or the fuser part second heater 83 and the pressure application part first heater 92 or the pressure application part second heater 93 by adjusting the time interval of the ON/OFF-control, or the continuous ON-control, of the first heater power source 120 and the second heater power source 121.

Therefore, during the formation of the print image, the controller 152 detects, via the fuser part second temperature sensor 166, the ambient temperature of the fuser part first heater 82 or the fuser part second heater 83 (that is, the temperature on the inner side of the fuser belt 86) as the temperature of the non-sandwiching range AR3 of the outer surface of the fuser belt 86 that reflects the temperature on the inner side of the fuser belt 86. For example, when the temperature that is detected by the controller 152 via the fuser part second temperature sensor 166 reaches a predetermined temperature (hereinafter, this is also referred to as a mode switching judging temperature) TS3 for processing mode switching judging that is pre-selected as a temperature that higher than the target temperature TS1 and lower than the damage prevention temperature TS2, the controller 152 switches the heat and pressure application process from the first processing mode to the second processing mode and continues to execute the heat and pressure application process.

Further, the controller 152 detects, via the pressure application part second temperature sensor 168, the ambient temperature of the pressure application part first heater 92 or the pressure application part second heater 93 (that is, the temperature on the inner side of the pressure application belt 96) as the temperature of the non-sandwiching range AR3 of the outer surface of the pressure application belt 96 that reflects the temperature on the inner side of the pressure application belt 96. Also when the temperature that is detected by the controller 152 via the pressure application part second temperature sensor 168 reaches the mode switching judging temperature TS3, similarly, the controller 152 switches the heat and pressure application process from the first processing mode to the second processing mode and continues to execute the heat and pressure application process.

In this way, when the controller 152 switches the processing mode of the heat and pressure application process from the first processing mode to the second processing mode, the controller 152 controls the fuser unit drive motor to slow the rotational speed of the belt drive roller 80 in the one rotation direction. As a result, the controller 152 switches from the first rotational speed to the second rotational speed to rotate the fuser belt 86 in the one rotation direction and, in conjunction with this, also switches from the first rotational speed to the second rotational speed to rotate the pressure application belt 96 in the other rotation direction, to apply heat and pressure to the recording sheet 5 while carrying the recording sheet 5 in the sandwiching part 115 at the second carrying speed, which is slower than the first carrying speed.

Here, the larger the amount of heat is supplied from the sandwiching range AR1, AR2 of the outer surfaces of the fuser belt 86 and the pressure application belt 96, the shorter the time period is required for the toner (that is, toner images) on the surface of the recording sheet 5 to melt. In other words, in the fuser unit 151, when the temperature of the sandwiching range AR1, AR2 of the outer surfaces of the fuser belt 86 and the pressure application belt 96 is higher than the minimum fusing temperature, the toner images can be fused onto the surface of the recording sheet 5 by temporarily melting once the toner images even when the carrying speed at which the recording sheet 5 is carried in the sandwiching part 115 for applying heat and pressure thereto is increased to some extent. Further, in the fuser unit 151, when the temperature of the sandwiching range AR1, AR2 of the outer surfaces of the fuser belt 86 and the pressure application belt 96 is close to the minimum fusing temperature, even when the carrying speed at which the recording sheet 5 is carried in the sandwiching part 115 for applying heat and pressure thereto is reduced to some extent, the toner images can be fused onto the surface of the recording sheet 5 by temporarily melting once the toner images.

Therefore, when the recording sheet 5 is carried in the sandwiching part 115 at the second carrying speed, the controller 152 increases the time interval of an ON/OFF-control of the first heater power source 120 and the second heater power source 121 or switches from a continuous ON-control to an ON/OFF-control. As a result, while reducing the heat generation amount of the fuser part first heater 82 or the fuser part second heater 83 and the heat generation amount of the pressure application part first heater 92 or the pressure application part second heater 93 to cause the ambient temperatures thereof to drop, the controller 152 performs control in a manner that the temperature of the sandwiching range AR1, AR2, which is detected via the fuser part first temperature sensor 87 and the pressure application part first temperature sensor 97, does not drop below the minimum fusing temperature.

Therefore, in this case, when the fuser part first temperature sensor 87 and the pressure application part first temperature sensor 97 do not malfunction in any way, while the controller 152 controls in a manner that the ambient temperature of the fuser part first heater 82 or the fuser part second heater 83 and the ambient temperature of the pressure application part first heater 92 or the pressure application part second heater 93 do not significantly rise, print images can be continuously formed on the surfaces of a plurality of the recording sheets 5. Further, in this case, even when the fuser part first temperature sensor 87 and pressure application part first temperature sensor 97 malfunction, when the actual temperature of the sandwiching range AR1, AR2 of the outer surfaces of the fuser belt 86 and the pressure application belt 96 is not below the minimum fusing temperature, similarly, while the controller 152 controls in the manner that the ambient temperature of the fuser part first heater 82 or the fuser part second heater 83 and the ambient temperature of the pressure application part first heater 92 or the pressure application part second heater 93 do not significantly rise, print images can be continuously formed on the surfaces of a plurality of the recording sheets 5.

In this way, even when the ambient temperature of the fuser part first heater 82 or the fuser part second heater 83 and the ambient temperature of the pressure application part first heater 92 or the pressure application part second heater 93 gradually rise, when the temperature of the non-sandwiching range AR3 of the outer surface of the fuser belt 86 and the temperature of the non-sandwiching range AR3 of the pressure application belt 96, which reflect the ambient temperatures, reach the mode switching judging temperature TS3, the controller 152 controls the heat generation of the fuser part first heater 82 or the fuser part second heater 83 and the heat generation of the pressure application part first heater 92 or the pressure application part second heater 93 to suppress the rising the ambient temperatures. As a result, the controller 152 can avoid, or delay, as much as possible that the fuser part thermostat 88 and the pressure application part thermostat 98 function to interrupt the heat generation of the fuser part first heater 82 or the fuser part second heater 83 and the pressure application part first heater 92 or the pressure application part second heater 93, and can continue as much as possible to perform the continuous print, and thus print images can be sequentially formed on the surfaces of a plurality of the recording sheets 5.

However, for example, when the fuser part second temperature sensor 166 malfunctions and the controller 152 erroneously detects, via the fuser part second temperature sensor 166, the temperature of the non-sandwiching range AR3 of the outer surface of the fuser belt 86 as a temperature lower than an actual temperature, similar to the case of the above-described first embodiment, at the time when it is detected that the temperature of the non-sandwiching range AR3 has reached the damage prevention temperature TS2, the fuser part thermostat 88 can forcibly block the supply of the heat generation control current from the first heater power source 120 to the fuser part first heater 82 or the fuser part second heater 83. Further, for example, when the pressure application part second temperature sensor 168 malfunctions and the controller 152 erroneously detects, via the pressure application part second temperature sensor 168, the temperature of the non-sandwiching range AR3 of the outer surface of the pressure application belt 96 as a temperature lower than an actual temperature, similar to the case of the above-described first embodiment, at the time when it is detected that the temperature of the non-sandwiching range AR3 has reached the damage prevention temperature TS2, the pressure application part thermostat 98 can forcibly block the supply of the heat generation control current from the second heater power source 121 to the pressure application part first heater 92 or the pressure application part second heater 93. In this way, the fuser part thermostat 88 and the pressure application part thermostat 98 can prevent damage to the fuser unit 151 due a significant temperature rise from occurring.

(2-3) Operation and Effect of Second Embodiment

In the above-described configuration, in the fuser unit 151 of the color printer 150, in addition to the configuration of the fuser unit 16 according to the above-described first embodiment, the fuser part second temperature sensor 166 is provided in the manner that the front end part of the sensor lever is in contact with the left end part (the non-sandwiching range AR3) outside the sandwiching range AR1, AR2 of the outer surface of the fuser belt 86. Further, in the fuser unit 151 of the color printer 150, the pressure application part second temperature sensor 168 is provided in the manner that the front end part of the sensor lever is in contact with the left end part (the non-sandwiching range AR3) outside the sandwiching range AR1, AR2 of the outer surface of the pressure application belt 96.

When the color printer 150 detects, via the fuser part second temperature sensor 166, the ambient temperature of the fuser part first heater 82 or the fuser part second heater 83 as the temperature of the non-sandwiching range AR3 of the outer surface of the fuser belt 86 and the detected temperature reaches the mode switching judging temperature TS3, the color printer 150 reduces the rotational speeds of the fuser belt 86 and the pressure application belt 96 that are caused to rotate in mutually opposite directions and also reduces the carrying speed of the recording sheet 5. Further, also when the color printer 150 detects, via the pressure application part second temperature sensor 168, the ambient temperature of the pressure application part first heater 92 or the pressure application part second heater 93 as the temperature of the non-sandwiching range AR3 of the outer surface of the pressure application belt 96 and the detected temperature reaches the mode switching judging temperature TS3, the color printer 150 reduces the rotational speeds of the fuser belt 86 and the pressure application belt 96 that are caused to rotate in mutually opposite directions and also reduces the carrying speed of the recording sheet 5. When, as described above, the carrying speed of the recording sheet 5 is reduced, the color printer 150 controls the heat generation of the fuser part first heater 82 and the fuser part second heater 83 and the heat generation of the pressure application part first heater 92 and the pressure application part second heater 93 to reduce the heat generation amount. Therefore, even when the ambient temperature of the fuser part first heater 82 and the fuser part second heater 83 and the ambient temperature of the pressure application part first heater 92 and the pressure application part second heater 93 gradually rise, the color printer 150 can accurately detect the ambient temperatures as the temperature of the outer surface of the fuser belt 86 and the temperature of the outer surface of the pressure application belt 96 without being influenced by the temperature drop due to contact with the recording sheet 5, and suppress the rising of the ambient temperatures.

According to the above-described configuration, in the fuser unit 151 of the color printer 150, in addition to the configuration of the fuser unit 16 according to the above-described first embodiment, the fuser part second temperature sensor 166 is provided in the manner that the front end part of the sensor lever is in contact with the left end part (the non-sandwiching range AR3) outside the sandwiching range AR1, AR2 of the outer surface of the fuser belt 86, and the pressure application part second temperature sensor 168 is provided in the manner that the front end part of the sensor lever is in contact with the left end part (the non-sandwiching range AR3) outside the sandwiching range AR1, AR2 of the outer surface of the pressure application belt 96. As a result, in the color printer 150, effects that are the same as those obtained by the above-described first embodiment can be obtained and, in addition, even when the ambient temperature of the fuser part first heater 82 and the fuser part second heater 83 and the ambient temperature of the pressure application part first heater 92 and the pressure application part second heater 93 gradually rise, the color printer 150 can accurately detect the ambient temperatures as the temperature of the outer surface of the fuser belt 86 and the temperature of the outer surface of the pressure application belt 96 without being influenced by the temperature drop due to contact with the recording sheet 5, and suppress the rising of the ambient temperatures. Therefore, the color printer 150 can avoid, or delay, as much as possible that the fuser part thermostat 88 and the pressure application part thermostat 98 function to interrupt the heat generation of the fuser part first heater 82 and the fuser part second heater 83 and the heat generation of the pressure application part first heater 92 and the pressure application part second heater 93, and can continue as much as possible to perform the continuous print, and thus can improve convenience.

(3) Other Embodiments

(3-1) First Other Embodiment

Figure 20:
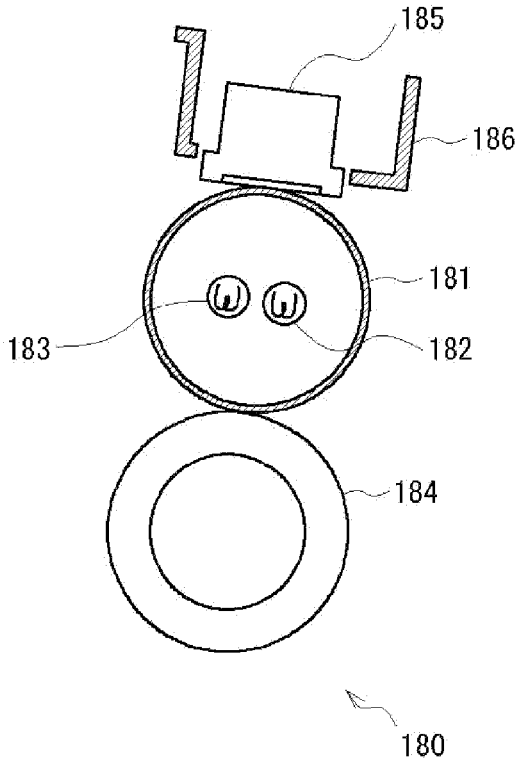
FIG. 20 illustrates a schematic side view of a configuration of a fuser unit according to another embodiment.

In the above-described first and second embodiments, the case is described where, in the fuser unit 16, 151, the fuser part 75, 165 that has the belt drive roller 80, the fuser part driven roller 81, the fuser part first heater 82, the fuser part second heater 83, the fuser belt 86 and the fuser part thermostat 88, and the pressure application part 76, 167 that has the pressure application roller 90, the pressure application part driven roller 91, the pressure application part first heater 92, the pressure application part second heater 93, the pressure application belt 96 and the pressure application part thermostat 98 are provided. However, the present invention is not limited to this. For example, as illustrated in FIG. 20, in a fuser unit 180, a cylindrical roller (hereinafter, this is also referred to as a heat application roller) 181 having a length longer than the sheet width for applying heat to the recording sheet 5 is provided rotatable in the one rotation direction; and, inside the heat application roller 181, two heaters, a first heater 182 and a second heater 183, each of which having a light emitting part of a different length, are arranged; and further, a temperature sensor (not illustrated in the drawings) for detecting temperature of an outer peripheral surface of the heat application roller 181 is provided. Further, in the present invention, a cylindrical or column-shaped roller (hereinafter, this is also referred to as a pressure application roller) 184 having a length longer than the sheet width for applying pressure to the recording sheet 5 is provided rotatable in the other rotation direction that is opposite to the rotation direction of the heat application roller 181 in a state in which a portion of an outer peripheral surface of the pressure application roller 184 is pressed against a portion of the outer peripheral surface of the heat application roller 181 with a predetermined pressing force. By causing the heat application roller 181 and the pressure application roller 184 to rotate in mutually opposite directions, the recording sheet 5 can be carried in a manner being sandwiched by the heat application roller 181 and the pressure application roller 184. In the present invention, it is also possible that a thermostat 185 is provided via a thermostat holding part 186 in a manner that a front end (that is, a heat sensing surface) of a heat sensing part of the thermostat 185 is brought into contact with one end part outside a sandwiching range of the recording sheet 5 on the outer peripheral surface of the heat application roller 181. In the present invention, such a configuration also allows a function substantially the same as that of the above described fuser unit 16, 151 of the first and second embodiments to be realized, and the same effects to be achieved. In the present invention, in the case of such a configuration, by making structures of the first heater 182 and the second heater 183 and positional relations of the first heater 182 and the second heater 183 with respect to the heat application roller 181 to be the same as the structures of the above-described fuser part first heater 82 and fuser part second heater 83 and the positional relations of the above-described fuser part first heater 82 and fuser part second heater 83 with respect to the fuser belt 86, similar to the above-described fuser unit 16, 151 of the first and second embodiments, detection accuracy of the ambient temperature of the first heater 182 and the ambient temperature of the second heater 183 can be significantly improved.

In addition, in the present invention, in the fuser unit 16, 151, it is also possible that, on at least one of the inner side of the fuser belt 86 and the inner side of the pressure application belt 96, one or a plurality of pressing parts are provided in a manner being pressed against the inner surface of the fuser belt 86 and the inner surface of the pressure application belt 96 with a predetermined pressing force, to apply a tensional force to the fuser belt 86 and the pressure application belt 96. Further, in the present invention, it is also possible that, in the fuser unit 16, 151, such pressing parts are provided in place of the fuser part driven roller 81 and the pressure application part driven roller 91. Further, in the present invention, it is also possible that, in the fuser unit 16, 151, a pressure application roller having an outer diameter larger than that of the belt drive roller 80 is provided in place of the pressure application belt 96, or a heat application roller having an outer diameter larger than that of the pressure application roller 90 is provided in place of the fuser belt 86. Further, in the present invention, for example, it is also possible that the pressure application part first heater 92 and the pressure application part second heater 93 are not provided on the inner side of the pressure application belt 96, and the fuser part first heater 82 and the fuser part second heater 83 for applying heat to the recording sheet 5 are provided only on the inner side of the fuser belt 86. That is, in the present invention, in the fuser unit, as far as the function of applying heat and pressure to the recording sheet 5 and the function of detecting the ambient temperature of a heat generation part such as a heater for applying heat to the recording sheet 5 can be realized, similarly to the above-described first and second embodiments, as the fuser unit, various other kinds of configurations can be suitably applied. In the present invention, such various configurations also allow effects the same as those achieved by the above-described first and second embodiments to be achieved.

(3-2) Second Other Embodiment

In the above-described first and second embodiments, the case is described where the fuser according to the present invention is applied to the fuser unit 16, 151, 180 that is removably installed in the color printer 1, 150 that is described in the above with reference to FIGS. 1-20. However, the present invention is not limited to this, but can be broadly applied to fusers of various other kinds of configurations such as a fuser unit that is fixedly provided in the color printer 1, 150 and fuser units that are removably installed or fixedly provided in image forming apparatuses that form print images, such as a black-and-white electrophotographic printer, a multifunction printer, a facsimile, a multifunction machine, and a copying machine.

(3-3) Third Other Embodiment

Further, in the above-described first and second embodiments, the case is described where the image forming apparatus according to the present invention is applied to the color printer 1, 150 that is described in the above with reference to FIGS. 1-20. However, the present invention is not limited to this, but can be broadly applied to image forming apparatuses of various other kinds of configurations such as a black-and-white electrophotographic printer, a multifunction printer, a facsimile, a multifunction machine, and a copying machine.

(3-4) Fourth Other Embodiment

Further, in the above-described first and second embodiments, the case is described where, as a medium for forming a print image, the recording sheet 5 that is described in the above with reference to FIGS. 1-20 is applied. However, the present invention is not limited to this, but can broadly apply various other kinds of media such as an OHP sheet, a letter sheet and a disk-like medium.

(3-5) Fifth Other Embodiment

Further, in the above-described first and second embodiments, the case is described where, as a pressure application part for applying pressure for forming a print image on a medium, the pressure application belt 96 that is described in the above with reference to FIGS. 1-20 is applied. However, the present invention is not limited to this, but can broadly apply pressure application parts of various other kinds of configurations such as a pressure application belt that is formed by directly laminating a release layer on an entire outer surface of an annular belt body of a predetermined thickness without laminating an elastic layer, and a pressure application roller that is pressed against the fuser belt 86 or a heat application roller.

(3-6) Sixth Other Embodiment

Further, in the above-described first and second embodiments, the case is described where, as an annular body that is rotatably supported for carrying a medium by sandwiching the medium between the annular body and a pressure application part for applying heat to the medium for forming a print image, the fuser belt 86 that is described in the above with reference to FIGS. 1-20 is applied. However, the present invention is not limited to this, but can broadly apply annular bodies of various other kinds of configurations such as a fuser belt that is formed by directly laminating a release layer on an entire outer surface of an annular belt body of a predetermined thickness without laminating an elastic layer, and a heat application roller against which the pressure application belt 96 or a pressure application roller is pressed.

(3-7) Seventh Other Embodiment

Further, in the above-described first and second embodiments, the case is described where, as a heat generation part that is arranged on an inner side of an annular body and generates heat to apply heat to the annular body, the fuser part first heater 82 and the fuser part second heater 83 that are described in the above with reference to FIGS. 1-20 are applied. However, the present invention is not limited to this, but can broadly apply heat generation parts of various other configurations and various other numbers of heat generation parts, such as a heater formed by one or three or more halogen lamps, and, for example, one or a plurality of planer heat generation bodies that are formed by embedding resistance wires for heat generation in a substantially rectangular body part of a multilayer structure.

(3-8) Eighth Other Embodiment

Further, in the above-described first and second embodiments, the case is described where, as a heat generation interruption part that is arranged in a manner that a temperature detection end thereof is in contact with one end part outside a medium carrying corresponding range of an annular body and that interrupts heat generation of a heat generation part in response to temperature of the annular body that is detected via the temperature detection end, the fuser part thermostat 88 that is described in the above with reference to FIGS. 1-20 is applied. However, the present invention is not limited to this, but can broadly apply heat generation interruption parts of various other kinds of configurations such as a heat generation interruption part that is arranged in a manner that a temperature detection end thereof is in contact with an inner surface of an annular body.

(3-9) Ninth Other Embodiment

Further, in the above-described first and second embodiments, the case is described where, as a drive roller driving an annular body to rotate, the belt drive roller 80 that is described in the above with reference to FIGS. 1-20 is applied. However, the present invention is not limited to this, but can broadly apply drive rollers of various other kinds of configurations such as belt drive rollers having, for example, a core part formed by an aluminum pipe, a core part formed by pure sulfur and sulfur free-cutting steel composite steel (SUM: Steel Use Machinability), and a core part formed by pure stainless steel.

(3-10) Tenth Other Embodiment

Further, in the above-described first and second embodiments, the case is described where, as a reflection part that is arranged on an inner side of an annular body and, together with at least a medium carrying corresponding range of the annular body, reflects radiant heat of a heat generation part toward one end part, the fuser part first reflection plate 84 and the fuser part second reflection plate 85 that are described in the above with reference to FIGS. 1-20 are applied. However, the present invention is not limited to this, but can broadly apply reflection parts of various other configurations and various other numbers of reflection parts, such as a reflection plate that is formed by vapor depositing silver on one surface of a plate part to form a reflection layer, a reflection plate that is formed by stainless steel (SUS304BA) in a manner that one surface thereof becomes a reflection surface, a reflection plate that is formed in a manner that a reflection surface is formed by subjecting one surface of a plate part that is formed by stainless steel (SUS304BA) to mirror polishing of about class #700 or class #800, a reflection plate capable of collectively covering the belt drive roller 80 and the fuser part driven roller 81, and a block-shaped reflection part of a predetermined shape that is formed as a pressing part that is pressed against the inner surface of the fuser belt 86 to apply a tensional force thereto.

(3-11) Eleventh Other Embodiment

Further, in the above-described first and second embodiments, the case is described where, as a temperature sensor that is arranged in a manner that a temperature detection end thereof is in contact with one end part outside a medium carrying corresponding range of an annular body for detecting, via the temperature detection end, temperature of the annular body, the fuser part second temperature sensor 166 that is described in the above with reference to FIGS. 1-20 is applied. However, the present invention is not limited to this, but can broadly apply temperature sensors of various other kinds of configurations such as a temperature sensor that is arranged, for example, in a manner that a temperature detection end thereof is in contact with an inner surface of an annular body, and a thermocouple.

(3-12) Twelfth Other Embodiment

Further, in the above-described first and second embodiments, the case is described where, as another heat generation part that is arranged on an inner side of a pressure application annular body and generates heat to apply heat to the pressure application annular body, the pressure application part first heater 92 and the pressure application part second heater 93 that are described in the above with reference to FIGS. 1-20 are applied. However, the present invention is not limited to this, but can broadly apply other heat generation parts of various other configurations and various other numbers of other heat generation parts, such as a heater formed by one or three or more halogen lamps, and, for example, one or a plurality of planer heat generation bodies that are formed by embedding resistance wires for heat generation in a substantially rectangular body part of a multilayer structure.

(3-13) Thirteenth Other Embodiment

Further, in the above-described first and second embodiments, the case is described where, as another heat generation interruption part that is arranged in a manner that a temperature detection end thereof is in contact with one end part outside a medium carrying corresponding range of a pressure application annular body and that interrupts heat generation of another heat generation part in response to temperature of the pressure application annular body that is detected via the temperature detection end, the pressure application part thermostat 98 that is described in the above with reference to FIGS. 1-20 is applied. However, the present invention is not limited to this, but can broadly apply other heat generation interruption parts of various other kinds of configurations such as a heat generation interruption part that is arranged in a manner that a temperature detection end thereof is in contact with an inner surface of a pressure application annular body.

(3-14) Fourteenth Other Embodiment

Further, in the above-described first and second embodiments, the case is described where, as a pressure application roller that is supported rotatable in an opposite rotation direction for applying pressure to a medium, the pressure application roller 90 that is described in the above with reference to FIGS. 1-20 is applied. However, the present invention is not limited to this, but can broadly apply pressure application rollers of various other kinds of configurations such as pressure application rollers having, for example, a core part formed by an aluminum pipe, a core part formed by pure sulfur and sulfur free-cutting steel composite steel, and a core part formed by pure stainless steel.

(3-15) Fifteenth Other Embodiment

Further, in the above-described first and second embodiments, the case is described where, as another reflection part that is arranged on an inner side of a pressure application annular body and, together with at least a medium carrying corresponding range of the pressure application annular body, reflects radiant heat of another heat generation part toward one end part, the pressure application part first reflection plate 94 and the pressure application part second reflection plate 95 that are described in the above with reference to FIGS. 1-20 are applied. However, the present invention is not limited to this, but can broadly apply other reflection parts of various other configurations and various other numbers of other reflection parts, such as a reflection plate that is formed by vapor depositing silver on one surface of a plate part to form a reflection layer, a reflection plate that is formed by stainless steel (SUS304BA) in a manner that one surface thereof becomes a reflection surface, a reflection plate that is formed in a manner that a reflection surface is formed by subjecting one surface of a plate part that is formed by stainless steel (SUS304BA) to mirror polishing of about class #700 or class #800, a reflection plate capable of collectively covering the pressure application roller 90 and the pressure application part driven roller 91, and a block-shaped reflection part of a predetermined shape that is formed as a pressing part that is pressed against the inner surface of the pressure application belt 96 to apply a tensional force thereto.

(3-16) Sixteenth Other Embodiment

Further, in the above-described first and second embodiments, the case is described where, as another temperature sensor that is arranged in a manner that a temperature detection end thereof is in contact with one end part outside a medium carrying corresponding range of a pressure application annular body for detecting, via the temperature detection end, temperature of the pressure application annular body, the pressure application part second temperature sensor 168 that is described in the above with reference to FIGS. 1-20 is applied. However, the present invention is not limited to this, but can broadly apply other temperature sensors of various other kinds of configurations such as a temperature sensor that is arranged, for example, in a manner that a temperature detection end thereof is in contact with an inner surface of a pressure application annular body, and a thermocouple.

INDUSTRIAL APPLICABILITY

The present invention is applicable to a fuser unit provided in an image forming apparatus such as a color electrophotographic printer, a black-and-white electrophotographic printer, a multifunction printer, a facsimile, a multifunction machine and a copying machine, and to an image forming apparatus such as the color electrophotographic printer, the black-and-white electrophotographic printer, the multifunction printer, the facsimile, the multifunction machine and the copying machine.

In the present invention, the fuser part driven roller is a form of a fuser contact member. A place where the fuser part driven roller and the pressure application part driven roller sandwich the fuser belt and the pressure application belt is a second sandwiching point (pt2). A place where the belt drive roller and the pressure application roller sandwich the fuser belt and the pressure application belt is a first sandwiching point (pt1).

The form of the fuser contact member is not limited to a roller, but can be any structure capable of pairing with an opposing pressure application part to apply a predetermined pressure to an annular body passing through therebetween.

As illustrated in FIG. 3, the flexible portion of the fuser belt is a first flexible portion (1utp), and the flexible portion of the pressure application belt is a second flexible portion (2utp).

What is claimed is:

1. A fuser comprising:

a pressure application part that applies pressure to a medium for forming a print image;

an annular body that is rotatably supported for carrying the medium in a manner that the medium is sandwiched between the annular body and the pressure application part for applying heat to the medium for forming the print image;

a fuser part heat generation body that is arranged on an inner side of the annular body for generating heat to apply heat to the annular body;

a first temperature detection end that is arranged in contact with one end part outside a medium carrying corresponding range of a surface of the annular body and detects temperature of the annular body outside the medium carrying corresponding range, the medium carrying corresponding range being a range in which the medium is carried;

a heat generation interruption part that, in response to the temperature of the annular body that is detected via the first temperature detection end, interrupts heat generation of the fuser part heat generation body; and a reflection part that is arranged on an inner side of the annular body, and reflects radiant heat of the fuser part heat generation body toward at least the medium carrying corresponding range of the annular body and the one end part.

2. The fuser according to claim 1, wherein the fuser part heat generation body is arranged directly to apply the heat to the medium carrying corresponding range and the one end part of the annular body.

3. The fuser according to claim 1, wherein the heat generation interruption part is arranged in a manner that the first temperature detection end is in contact with the one end part that is an outer surface of the annular body.

4. The fuser according to claim 1, wherein in the heat generation interruption part, a predetermined resin layer is formed on a surface of the first temperature detection end.

5. The fuser according to claim 1, further comprising;

a drive roller that drives the annular body to rotate; and a fuser contact member that is arranged at a predetermined distance from the drive roller, wherein the annular body is an annular belt, the drive roller and the fuser contact member are arranged on an inner side of the belt, and further the belt rotates in accordance with rotation of the drive roller, the drive roller and the fuser contact member both oppose the pressure application part and the belt is sandwiched therebetween, and thereby a predetermined pressure is applied to the belt and the carried medium, and here a sandwiching part is formed between a first sandwiching point (pt1) where the drive roller and the pressure application part press against each other and a second sandwiching point (pt2) where the fuser contact member and the pressure application part press against each other, and the heat generation interruption part is arranged in a manner that the first temperature detection end is pressed against a portion opposing the sandwiching part on an outer surface of the belt.

6. The fuser according to claim 5, wherein the fuser contact member is a fuser part driven roller, the fuser part driven roller rotates in response to the rotation of the drive roller, and the second sandwiching point (pt2) is formed between the fuser part driven roller and the pressure application part.

7. The fuser according to claim 6, wherein the fuser contact member is a driven roller that rotates in conjunction with the rotation of the drive roller, and the first temperature detection end is positioned on the first flexible portion, which is between a vertical tangential line ($\alpha$) at a most downstream position in a medium carrying direction on an outer periphery of the drive roller and a vertical tangential line ($\beta$) at a most upstream position in the medium carrying direction on an outer side of the fuser part driven roller.

8. The fuser according to claim 1, further comprising;

a drive roller that drives the annular body to rotate; and a fuser contact member that is arranged at a predetermined distance from the drive roller, wherein the annular body is an annular belt, the drive roller and the fuser contact member are arranged on an inner side of the belt, and further the belt rotates in accordance with rotation of the drive roller, the drive roller and the fuser contact member both oppose the pressure application part and the belt is sandwiched therebetween, and thereby a predetermined pressure is applied to the belt and the carried medium, and here a sandwiching part is formed between a first sandwiching point (pt1) where the drive roller and the pressure application part press against each other and a second sandwiching point (pt2) where the fuser contact member and the pressure application part press against each other, and the heat generation interruption part is arranged in a manner that the first temperature detection end is pressed against a first flexible portion (1utp) that is a portion other than the sandwiching part on an outer surface of the belt.

9. The fuser according to claim 8, wherein the fuser contact member is a fuser part driven roller, the fuser part driven roller rotates in response to the rotation of the drive roller, and the second sandwiching point (pt2) is formed between the fuser part driven roller and the pressure application part.

10. The fuser according to claim 1, further comprising:

a temperature sensor that is arranged in a manner that a first temperature detection end is in contact with the one end part outside the medium carrying corresponding range of the annular body for detecting, via the first temperature detection end, the temperature of the annular body; and a controller that detects, via the temperature sensor, the temperature of the annular body and in response to a result of the detection, switches a processing mode of a heat and pressure application process in which heat and pressure are applied to the medium while the medium is carried in a manner being sandwiched by the annular body and the pressure application part.

11. The fuser according to claim 10, wherein the controller, when the processing mode of the heat and pressure application process is switched, controls a carrying speed at which the medium is carried by the annular body and controls the fuser part heat generation body.

12. The fuser according to claim 11, wherein the controller, when it is detected via the temperature sensor that the temperature of the annular body has reached a predetermined temperature that is higher than a minimum temperature required for applying heat to the medium, controls to reduce the carrying speed of the medium to a speed slower than the carrying speed before the detection and controls the fuser part heat generation body to reduce a heat generation amount to an amount smaller than the heat generation amount before the detection.

13. The fuser according to claim 1, wherein the pressure application part is a pressure application annular body that is supported in a manner rotatable in a rotation direction opposite to a rotation direction of the annular body and in a manner that an outer surface of the pressure application annular body is pressed against an outer surface of the annular body.

14. A fuser comprising:

a pressure application part that applies pressure to a medium for forming a print image;

an annular body that is rotatably supported for carrying the medium in a manner that the medium is sandwiched between the annular body and the pressure application part for applying heat to the medium for forming the print image;

a fuser part heat generation body that is arranged on an inner side of the annular body for generating heat to apply heat to the annular body;

a first temperature detection end that is arranged in contact with one end part outside a medium caring corresponding range of a surface of the annular body and detects temperature of the annular body outside the medium carrying corresponding range, the medium carrying corresponding range being a range in which the medium is carried; and a heat generation interruption part that, in response to the temperature of the annular body that is detected via the first temperature detection end, interrupts heat generation of the fuser part heat generation body, wherein the pressure application part is a pressure application annular body that is supported in a manner rotatable in a rotation direction opposite to a rotation direction of the annular body and in a manner that an outer surface of the pressure application annular body is pressed against an outer surface of the annular body, and the fuser further comprises:

a pressure application part heat generation body that is arranged on an inner side of the pressure application annular body and generates heat to apply heat to the pressure application annular body; and a pressure application part heat generation interruption part that is arranged in a manner that a second temperature detection end is in contact with one end part outside a medium carrying corresponding range of the pressure application annular body and, in response to temperature of the pressure application annular body that is detected via the second temperature detection end, interrupts heat generation of the pressure application part heat generation body.

15. The fuser according to claim 14, wherein the pressure application part heat generation body is arranged directly to apply the heat to the medium carrying corresponding range and the one end part of the pressure application annular body.

16. The fuser according to claim 14 wherein the pressure application part heat generation interruption part is arranged in a manner that the second temperature detection end is in contact with the one end part of an outer surface of the pressure application annular body.

17. The fuser according to claim 16, wherein the pressure application annular body comprises:

a pressure application roller that is supported rotatable in the opposite rotation direction for applying pressure to the medium;

a pressure application contact member that is arranged at a predetermined distance from the pressure application roller; and an annular pressure application belt that applies pressure to the medium by being pressed against the annular body via the pressure application roller in a state being hung on the pressure application roller, wherein the pressure application roller and the pressure application contact part are arranged on an inner side of the pressure application belt, the pressure application roller and the pressure application contact part respectively oppose the drive roller and the fuser contact member and sandwich the annular body therebetween, and here a sandwiching part is formed between a first sandwiching point (pt1) where the drive roller and the pressure application roller press against each other and a second sandwiching point (pt2) where the fuser contact member and the pressure application contact part press against each other, and the pressure application part heat generation interruption part is arranged in a manner that the second temperature detection end is pressed against a portion opposing the sandwiching part on an outer surface of the pressure application belt.

18. The fuser according to claim 16, wherein the pressure application annular body comprises:

a pressure application roller that is supported rotatable in the opposite rotation direction for applying pressure to the medium;

a pressure application contact member that is arranged at a predetermined distance from the pressure application roller; and an annular pressure application belt that applies pressure to the medium by being pressed against the annular body via the pressure application roller in a state being hung on the pressure application roller, wherein the pressure application roller and the pressure application contact part are arranged on an inner side of the pressure application belt, the pressure application roller and the pressure application contact part respectively oppose the drive roller and the fuser contact member and sandwich the annular body therebetween, and here a sandwiching part is formed between a first sandwiching point (pt1) where the drive roller and the pressure application roller press against each other and a second sandwiching point (pt2) where the fuser contact member and the pressure application contact part press against each other, and the pressure application part heat generation interruption part is arranged in a manner that the second temperature detection end is pressed against a second flexible portion (2utp) that is other than the sandwiching part on the outer surface of the pressure application belt.

19. The fuser according to claim 16, wherein the pressure application contact member is a pressure application driven roller that rotates in conjunction with the rotation of the drive roller, and the second temperature detection end is positioned on the flexible portion, which is between a vertical tangential line at a most downstream position in a medium carrying direction on an outer periphery of the pressure application roller and a vertical tangential line at a most upstream position in the medium carrying direction on an outer periphery of the pressure application part driven roller.

20. The fuser according to claim 18, wherein the pressure application contact member is a pressure application part driven roller, the pressure application part driven roller rotates in response to the rotation of the drive roller, and the second sandwiching point (pt2) is formed between the pressure application part driven roller and the driven roller.

21. A fuser comprising:

a pressure application part that applies pressure to a medium for forming a print image;

an annular body that is rotatably supported for carrying the medium in a manner that the medium is sandwiched between the annular body and the pressure application part for applying heat to the medium for forming the print image;

a fuser part heat generation body that is arranged on an inner side of the annular body for generating heat to apply heat to the annular body;

a first temperature detection end that is arranged in contact with one end part outside a medium carrying corresponding range of a surface of the annular body and detects temperature of the annular body outside the medium carrying corresponding range, the medium carrying corresponding range being a range in which the medium is carried;

a heat generation interruption part that, in response to the temperature of the annular body that is detected via the first temperature detection end, interrupts heat generation of the fuser part heat generation body;

a drive roller that drives the annular body to rotate; and a fuser contact member that is arranged at a predetermined distance from the drive roller, wherein the annular body is an annular belt, the drive roller and the fuser contact member are arranged on an inner side of the belt, and further the belt rotates in accordance with rotation of the drive roller, the drive roller and the fuser contact member both oppose the pressure application part and the belt is sandwiched therebetween, and thereby a predetermined pressure is applied to the belt and the carried medium, and here a sandwiching part is formed between a first sandwiching point (pt1) where the drive roller and the pressure application part press against each other and a second sandwiching point (pt2) where the fuser contact member and the pressure application part press against each other, and the heat generation interruption part is arranged in a manner that the first temperature detection end is pressed against a first flexible portion (1utp) that is a portion other than the sandwiching part on an outer surface of the belt.

* * * * *